US006997272B2

(12) United States Patent
Eppink

(10) Patent No.: US 6,997,272 B2
(45) Date of Patent: Feb. 14, 2006

(54) METHOD AND APPARATUS FOR INCREASING DRILLING CAPACITY AND REMOVING CUTTINGS WHEN DRILLING WITH COILED TUBING

(75) Inventor: Jay M. Eppink, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 188 days.

(21) Appl. No.: 10/405,400

(22) Filed: Apr. 2, 2003

(65) Prior Publication Data

US 2004/0195007 A1 Oct. 7, 2004

(51) Int. Cl.
*E21B 21/06* (2006.01)

(52) U.S. Cl. ..... 175/61; 175/207; 175/215

(58) Field of Classification Search ..... 175/61, 175/215, 207, 320, 325.1
See application file for complete search history.

(56) References Cited

U.S. PATENT DOCUMENTS

| | | | |
|---|---|---|---|
| 2,765,146 | A | 10/1956 | Williams, Jr. |
| 2,833,517 | A | 5/1958 | Bobo |
| 3,823,788 | A | 7/1974 | Garrison et al. |
| 4,373,582 | A | 2/1983 | Bednar et al. |
| 4,436,166 | A | 3/1984 | Hayatdavondi et al. |
| 5,269,377 | A | 12/1993 | Martin |
| 5,318,137 | A | 6/1994 | Johnson et al. |
| 5,318,138 | A | 6/1994 | Dewey et al. |
| 5,332,048 | A | 7/1994 | Underwood et al. |
| 5,465,787 | A | 11/1995 | Roth |
| 5,536,183 | A | 7/1996 | Brandolf |
| 5,627,343 | A | 5/1997 | Brandolf |
| 5,730,222 | A | 3/1998 | Rike, Jr. |
| 5,732,776 | A | 3/1998 | Tubel et al. |
| 5,909,098 | A | 6/1999 | Konecny et al. |
| 5,979,572 | A | 11/1999 | Boyd et al. |
| 5,984,011 | A | 11/1999 | Misselbrook et al. |
| 5,988,992 | A | 11/1999 | Tetzlaff et al. |
| 6,043,995 | A | 3/2000 | Leuthen |
| 6,105,690 | A | 8/2000 | Biglin, Jr. et al. |
| 6,296,066 | B1 | 10/2001 | Terry et al. |
| 6,488,104 | B1 | 12/2002 | Eppink et al. |
| 6,607,044 | B1 | 8/2003 | Eppink et al. |

(Continued)

OTHER PUBLICATIONS

SPE/CoTA Coiled Tubing Roundtable (SPE 54469); *The All Electric BHA: Recent Developments Toward an Intelligent Coiled–Tubing Drilling System*; D. Turner, et al; May 25–26, 1999;(pp. 1–10).

(Continued)

*Primary Examiner*—William Neuder
(74) *Attorney, Agent, or Firm*—Conley Rose, P.C.

(57) ABSTRACT

An assembly for drilling a deviated borehole includes a bottom hole assembly connected to a string of coiled tubing and includes a bit driven by a downhole motor powered by drilling fluids. A surface pump pumps the drilling fluids downhole through a cross valve to provide a first path directing drilling fluids down the coiled tubing flowbore and a second path directing drilling fluids down the annulus. The bottom hole assembly has a downhole valve allowing flow between the flowbore and the annulus. A first flow passageway directs drilling fluids down the coiled tubing flow bore and then up the annulus and a second flow passageway directs drilling fluids down the annulus and the up the flowbore. The bottom hole assembly includes a subsurface pump capable of pumping drilling fluids from the second fluid passageway to the surface. The bottom hole assembly includes an electric motor to rotate the subsurface pump and the motor is provided with power conduits embedded in a wall of the coiled tubing. Another subsurface pump may be provided, such that the subsurface pumps pump drilling fluid with cuttings to the surface and/or pump clean drilling fluids into the downhole motor to aid drilling.

143 Claims, 38 Drawing Sheets

U.S. PATENT DOCUMENTS

| | | | | |
|---|---|---|---|---|
| 6,659,200 | B1 | 12/2003 | Eppink | |
| 2002/0007970 | A1 | 1/2002 | Terry et al. | |
| 2004/0040749 | A1 * | 3/2004 | Terry et al. | 175/320 |
| 2004/0104052 | A1 * | 6/2004 | Livingstone | 175/61 |
| 2004/0112645 | A1 * | 6/2004 | Eppink et al. | 175/61 |

OTHER PUBLICATIONS

SPE/CoTA Coiled Tubing Roundtable (SPE 68441); *Electric Coiled Tubing Drilling (E–CTD) Project Update*; P Head, et al.; Mar. 7–8, 2001; (pp. 1–9).

SPE/CoTA Coiled Tubing Roundtable (SPE 68489); *New DC Motor for Downhole Drilling and Pumping Applications*; D. Turner, et al.; Mar. 7–8, 2001; (pp. 1–7).

SPE/CoTA Coiled Tubing Roundtable (SPE 68507); *Slim-clearance–Small Diameter Reeled Exploration Wells and Conventional Wellss*; P. Head, et al.; Mar. 7–8, 2001; (pp. 1–5).

XL Technology Ltd.; *Downhole Vacuum Cleaning Service*; (Undated) (pp. 1).

* cited by examiner

METHOD AND APPARATUS FOR INCREASING DRILLING CAPACITY AND REMOVING CUTTINGS WHEN DRILLING WITH COILED TUBING

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to methods and apparatus for increasing drilling capacity and/or removing cuttings from a deviated wellbore when drilling with coiled tubing.

2. Description of the Related Art

Historically, oil and gas were produced from subsurface formations by drilling a substantially vertical borehole from a surface location above the formation to the desired hydrocarbon zone at some depth below the surface. Modern drilling technology and techniques allow for the drilling of boreholes that deviate from vertical. In particular, deviated or horizontal wellbores may be drilled from a convenient surface location to the desired hydrocarbon zone. It is also common to drill "sidetrack" boreholes within existing wellbores to access other hydrocarbon formations.

During such drilling operations, it may be economically infeasible to use jointed drill pipe as the drill string or work string. Therefore, tools and methods have been developed for drilling boreholes using coiled tubing, which is a single length of continuous, unjointed tubing spooled onto a reel for storage in sufficient quantities to exceed the length of the borehole. Although the coiled tubing may be metal coiled tubing, preferably the coiled tubing is composite coiled tubing. An exemplary composite coiled tubing drilling operation is depicted in FIG. 1 comprising a coiled tubing system 100 on the surface 10 and a drilling assembly, also called a bottomhole assembly 200 (BHA), drilling a subsurface deviated wellbore 170. The coiled tubing system 100 includes a power supply 110, a surface processor 120, and a coiled tubing spool 130. An injector head unit 140 on the wellhead 134 feeds and directs the coiled tubing 150 from the spool 130 into the well 160. The power supply 110 is connected by electrical conduits 112, 114 to electrical conduits disposed in the wall of the composite coiled tubing 150. Further, the surface processor 120 includes data transmission conduits 122, 124 connected to data transmission conduits also housed in the wall of the composite coiled tubing 150. It should be appreciated that metal coiled tubing with conductors extending interiorly or exteriorly of the work string may also be used. See U.S. Pat. No. 6,296,066 and U.S. patent application Ser. No. 09/911,963 filed Jul. 23, 2001 and entitled "Well System", both hereby incorporated herein by reference. One or more surface pumps 132 are connected to the coiled tubing string 150 and wellhead 134 to supply drilling fluids during operation.

The BHA 200, which includes a drilling motor 205 and a drill bit 210, connects to the lower end of the coiled tubing 150 and extends into the deviated borehole 170 being drilled. Since coiled tubing 150 does not rotate in the wellbore 170, the drilling motor 205 drives the drill bit 210, which drills into the formation 173 forming a wellbore wall 175 and creating cuttings 180. The drilling motor 205 is powered by drilling fluid 176 pumped from the surface 10 through the coiled tubing 150. The drilling fluid 176 flows through the drilling motor 205, out through nozzles 212 in the drill bit 210, and into the wellbore annulus 165 that is formed between the coiled tubing 150 and the wall 175 of the deviated wellbore 170 back up to the surface 10.

When using drill pipe that rotates during the drilling process, cuttings 180 do not tend to accumulate in the annulus 165 of the wellbore 170. In such rotary drilling operations, the rotation of the pipe working against the cuttings 180 tends to stir up the cuttings 180 so that they are more easily carried away by the drilling fluid as it flows through the wellbore annulus 165 to the surface 10. However, when drilling with coiled tubing 150, which does not rotate, the cuttings 180 tend to accumulate in the wellbore annulus 165 whenever the wellbore 170 deviates from vertical by approximately fifteen degrees (15°) or more. In particular, the cuttings 180 accumulate on the low side 172 of the wellbore 170 as shown in cross section in FIG. 2, which is taken along section line A—A of FIG. 1. As the wellbore 170 is drilled, the cuttings beds 180 continue to grow along and around the coiled tubing 150. If not removed, these cuttings 180 will cause the coiled tubing 150 and/or BHA 200 to become buried and get stuck.

One method for removing cuttings 180 from a deviated wellbore 170 is to periodically perform wiper trips. To conduct a wiper trip, drilling is halted, and the coiled tubing 150 is pulled to drag the BHA 200 through the previously drilled wellbore 170 to stir up the cuttings 180 while continuing to circulate drilling fluid so that the drilling fluid can carry those cuttings 180 back to the surface 10. Wiper trips are undesirable because they consume valuable drilling time and can cause damage to the components of the BHA 200, such as the drill bit 210.

Another method for removing cuttings from a deviated wellbore without using wiper trips comprises increasing the flow rate in the wellbore annulus 165 to provide a fluid velocity sufficient to lift the cuttings 180 off lower side 172 of borehole wall 175 and carry them back to the surface 10. Referring again to FIG. 1, during a typical drilling operation, drilling fluid flows through the flow bore 322 of the coiled tubing 150 and through the BHA 200 along path 155 to power the drilling motor 205 and drill bit 210. After exiting the drill bit 210, the drilling fluid flows back to the surface 10 along path 185 through the wellbore annulus 165. As the drilling fluid 176 flows along path 185, it must have a minimum velocity in the annulus to lift the cuttings 180 that accumulate in the wellbore annulus 165 and carry them back to the surface 10. This minimum annulus velocity will vary, as for example, with borehole inclination, size of the cuttings 180, geometry of the deviated borehole 170, and drilling fluid properties.

However, there are several factors that restrict the maximum flow rate. These factors include preventing erosion or abrasion of the coiled tubing 150 or the internal components of the BHA 200, preventing erosion of the wellbore wall 175, not exceeding the maximum flow rate capacity of the downhole motor 205, and not exceeding the maximum collapse and burst pressure ratings of the coiled tubing 150. Accordingly, the maximum flow rate of the drilling fluid 176 flowing along path 155 through the BHA 200 is limited by operational considerations. If this maximum operational flow rate does not provide at least the minimum annulus flow velocity required to carry the cuttings 180 to the surface 10, the cuttings 180 will accumulate in the wellbore annulus 165.

U.S. Pat. No. 5,984,011 to Misselbrook et al., hereby incorporated herein by reference for all purposes, discloses one method of diverting flow into the wellbore upstream of the drill motor. The method comprises ceasing drilling, pumping fluid into the drill string at a critical level of flow that exceeds the drilling flow rate, and valving at least a portion of the fluid to bypass the drilling motor and sweep out any cuttings that have accumulated in the borehole. Misselbrook teaches that the critical velocity is in the range of 3–5 feet/second in order to keep all cuttings suspended in the drilling fluid. Misselbrook also teaches that drilling is ceased so that additional cuttings are not generated while removing the existing cuttings from the wellbore.

U.S. Pat. No. 5,979,572 to Boyd et al., hereby incorporated herein by reference for all purposes, discloses another bypass valving apparatus. Boyd teaches that, except during drilling, it is desirable to suspend operation of the drill motor to prolong its useful operating life. Therefore, the by-pass valving arrangement is positioned upstream of the motor so that fluid may be circulated into the wellbore while by-passing the drilling equipment. According to Boyd, the bypass valving apparatus allows for increased mud flow rates during circulating operations, thereby increasing the removal efficiency of the cuttings, while also increasing the motor life since not all of the mud flowing at the higher circulating rates must pass through the motor.

These apparatus and methods therefore eliminate the need for wiper trips, but each recommends disrupting drilling to sweep the borehole clean of cuttings. Further, even if drilling progresses when fluid is diverted to the wellbore annulus for cuttings removal, it is difficult to achieve an adequate fluid velocity in the wellbore annulus 165 to sweep cuttings to the surface 10 without starving the drill motor 205. Thus, it would be desirable to provide an effective cuttings removal apparatus and method that does not disrupt drilling or reduce drilling efficiency.

The present invention overcomes the deficiencies of the prior art.

SUMMARY OF THE INVENTION

The present invention features an assembly for drilling a deviated borehole from the surface using drilling fluids. The assembly includes a bottom hole assembly connected to a string of coiled tubing extending to the surface. The coiled tubing has a flowbore for the passage of drilling fluids. The bottom hole assembly includes a bit driven by a downhole motor powered by the drilling fluids. The bottom hole assembly and string form an annulus with the borehole. A surface pump at the surface pumps the drilling fluids downhole. A first cross valve associated with the surface pump provides a first path directing drilling fluids down the flowbore and a second path directing drilling fluids down the annulus. A second cross valve adjacent the bottom hole assembly has an open position allowing flow through an opening between the flowbore and the annulus above the downhole motor and a closed position preventing flow through the opening. A first flow passageway directs drilling fluids through the first path, through the bottom hole assembly, and then up the annulus. A second flow passageway directs drilling fluids through the second path and the second cross valve in the open position and then up the flowbore.

The bottom hole assembly further includes a velocity sensitive check valve. The velocity sensitive check valve includes a housing with a fluid passageway therethrough. A flapper valve is disposed in the fluid passageway and a sleeve is reciprocally disposed in the fluid passageway. A flow nozzle is disposed in the sleeve and the sleeve has a first position within the housing holding the flapper valve in an open position and a second position within the housing allowing the flapper valve to close off the fluid passageway.

The bottom hole assembly includes a subsurface pump capable of pumping drilling fluids through the second fluid passageway to the surface. The bottom hole assembly includes an electric motor to rotate the subsurface pump. Power conduits embedded in a wall of the coiled tubing extend from the surface to the electric motor providing electrical power to the motor. The bottom hole assembly may include another subsurface pump capable of pumping drilling fluids from the first flow passageway and into the downhole motor.

The bottom hole assembly includes various flow passageways including a by-pass passageway extending between the flow bore and the downhole motor, bypassing the subsurface pump and a pump passageway extending between the flow bore and passing through the pump and downhole motor, and a branch passageway extending from the pump passageway to ports communicating with the annulus. A plurality of valves are used to direct flow through the passageways and pumps. The valves may allow the subsurface pump to pump drilling fluid with cuttings to the surface or may allow another subsurface pump to pump drilling fluids into the downhole motor to aid drilling, or both. The bottom hole assembly may further include a check valve disposed between the subsurface pump and the downhole motor.

The bottom hole assembly may also include a cuttings crushing assembly for crushing cuttings prior to passing through the subsurface pump. In one embodiment, the cuttings crushing assembly includes rotating discs rotating as well as gyrating eccentrically with respect to stationary discs. The rotating discs may have holes therethrough and include teeth on their outside diameter, while the stationary discs may have holes therethrough and include teeth on their inside diameter. The teeth of the rotating and stationary discs interact so as to crush the cuttings that pass between the discs. In another embodiment, the cuttings crushing assembly includes rotating discs rotating concentrically with respect to stationary discs. The rotating discs and stationary discs may have holes therethrough so as to shear the cuttings as they pass through the holes. In yet another embodiment, the cuttings crushing assembly includes a series of discs with rotating cutters and spaces around the cutters. As fluid flows through the spaces, the cutters rotate relative to one another in a four-point pattern so as to interact and crush the cuttings.

A cuttings filter may also be included in the bottom hole assembly for filtering cuttings in drilling fluids used for drilling the wellbore. The cuttings filter is disposed in the bottom hole assembly adjacent apertures in the wall of the bottom hole assembly. The filter has a conical shape and is made of a mesh material with a plurality of holes therethrough having a predetermined size. The conical mesh filters and separates the drilling fluids passing through the apertures into drilling fluids with cuttings smaller than the predetermined size and drilling fluids with cuttings greater than the predetermined size. The drilling fluids with cuttings smaller than the predetermined size are directed to the downhole motor, and the drilling fluids with cuttings greater than the predetermined size are directed to the surface.

Thus, the present invention comprises a combination of features and advantages that enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 31 depicts a cross-sectional side view of a two pump assembly, operating in the standard and reverse flow directions simultaneously with both pumps on;

FIG. 32 depicts a cross-sectional side view of the two pump assembly of FIG. 31, operating in the standard flow direction with the upper pump off and the lower pump on;

FIG. 38 depicts a cross-sectional side view of still another embodiment of a two pump assembly where both pumps are driven by a single motor, with both pumps on;

DETAILED DESCRIPTION OF THE INVENTION

Figure 1:
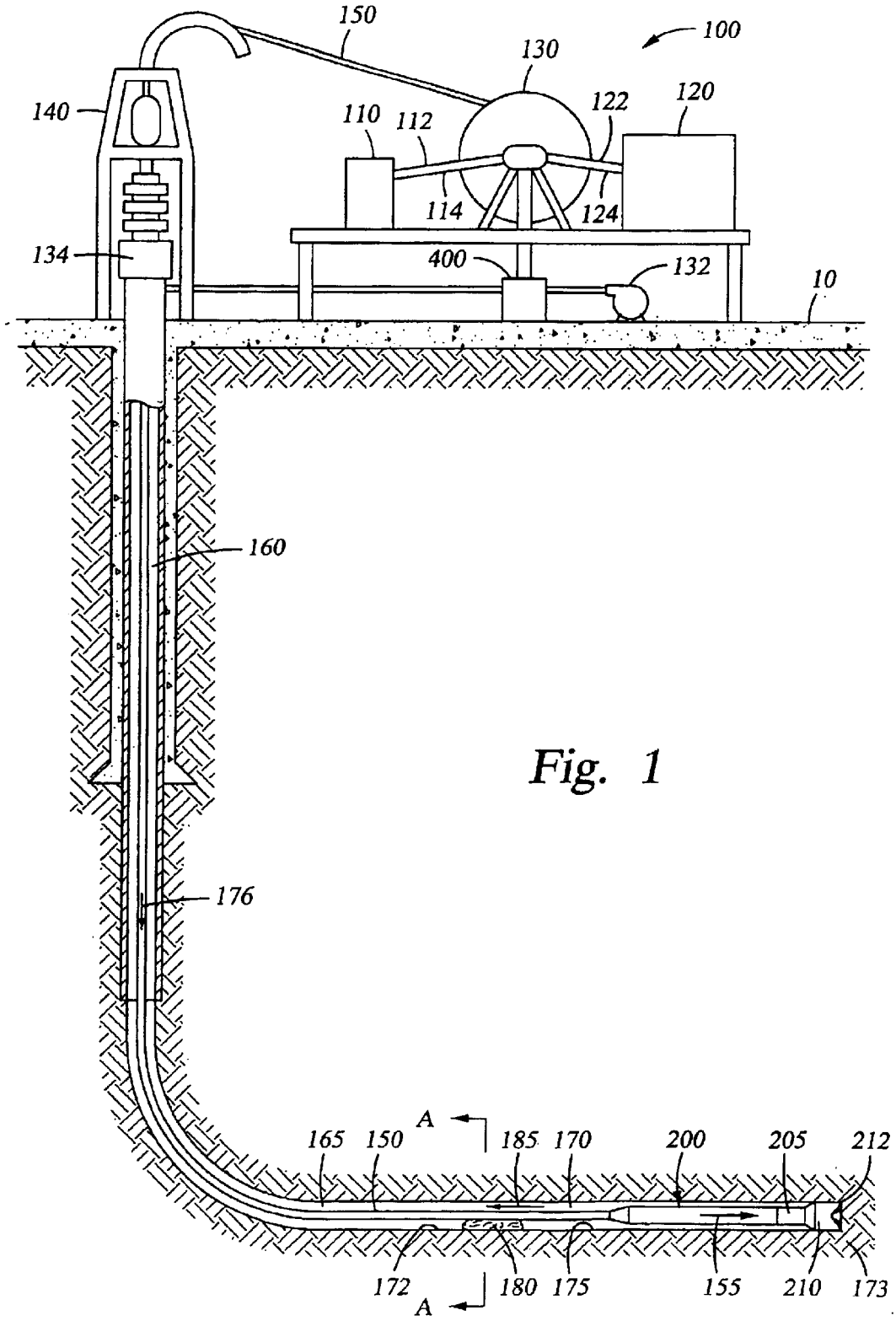
FIG. 1 depicts an exemplary coiled tubing drilling system and bottomhole assembly (BHA) drilling a deviated wellbore.
Figure 2:
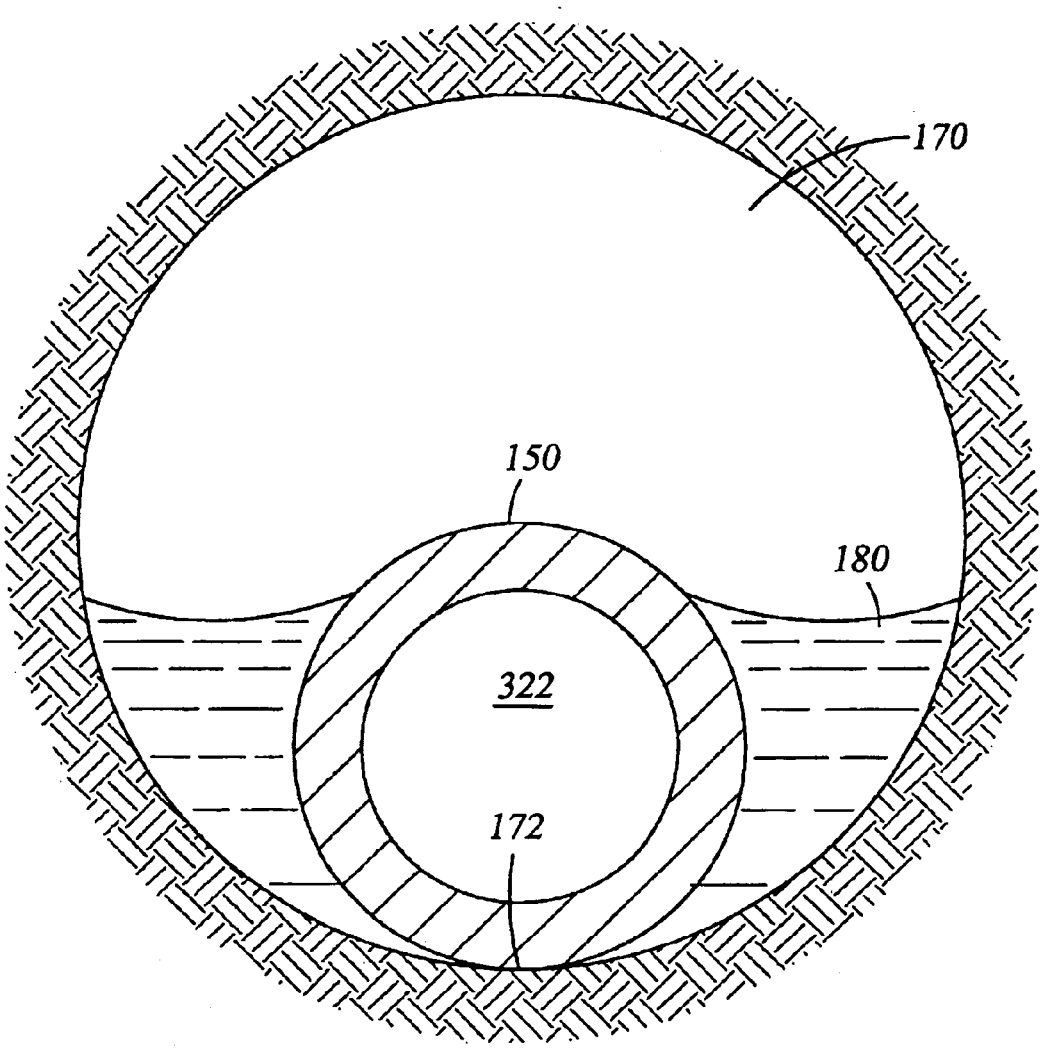
FIG. 2 depicts a cross-sectional end view of a coiled tubing within a wellbore, such as at section A—A in FIG. 1, with cuttings disposed along the lower portion of the wellbore.

In the description that follows, like parts are marked throughout the specification and drawings with the same reference numerals, respectively. The drawings are not necessarily to scale. Certain features of the invention may be shown exaggerated in scale or in somewhat schematic form, and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

The following definitions will be followed in the specification. As used herein, the term "wellbore" refers to a wellbore or borehole being provided or drilled in a manner known to those skilled in the art. A trip into the wellbore may be defined as the operation of lowering or running the bit into the wellbore on a work string. A trip includes lowering and retrieving the bit on the work string. As used herein, the term "work string" is understood to include a string of tubular members, such as jointed drill pipe, metal coiled tubing, composite coiled tubing, drill collars, subs and other drill or tool members, extending between the surface and a tool on the lower end of the work string, normally utilized in wellbore operations. It should be appreciated that the work string may include casing, tubing, drill pipe, or coiled tubing, each of which may be made of steel, a steel alloy, a composite, fiberglass, or other suitable material. A "drill string" is a work string used for drilling. Reference to up or down will be made for purposes of description with the terms "above", "up", "upward", "upper", or "upstream" meaning away from the bottom of the wellbore along the longitudinal axis of the work string and "below", "down", "downward", "lower", or "downstream" meaning toward the bottom of the wellbore along the longitudinal axis of the work string.

In particular, various embodiments of the present invention provide a number of different methods and apparatus for removing cuttings from a wellbore with coiled tubing and for increasing drilling capacity. The concepts of the invention are discussed in the context of a deviated wellbore, but the use of the concepts of the present invention is not limited to this particular application and may be applied in any wellbore. The concepts disclosed herein may find application with drilling operations other than using coiled tubing.

In one aspect, the embodiments of the present invention are directed to the removal of cuttings from a wellbore annulus when drilling a deviated wellbore with coiled tubing. The cuttings removal may be performed while drilling progresses, or when drilling has ceased, depending upon the design and operation of a particular embodiment. Further, cuttings removal may be performed with drilling fluids circulating in the standard flow direction, i.e. downwardly through the drill string flowbore and then upwardly through the wellbore annulus to the surface, or circulating in the reverse flow direction, i.e. downwardly through the wellbore annulus and upwardly through the drill string flowbore to the surface.

Removing cuttings in the reverse flow direction is advantageous for many reasons. In particular, because the coiled tubing flow bore is ⅛ to ¾ the cross-sectional flow area of the wellbore annulus flow area, i.e., smaller than the annulus cross-section, the flow rates required to keep the cuttings suspended in the drilling fluid can be proportionately reduced to achieve the same velocity, which is preferably at least 5 feet per second. For example, the flow rate required to keep the cuttings suspended in the coiled tubing flow bore is ⅛ to ¾ of the flow rate required in the wellbore annulus, depending upon the difference in flow area between the coiled tubing and the wellbore annulus. The lower flow rate is desirable to reduce erosion within the coiled tubing, and reduce the likelihood that the coiled tubing will collapse due to differential pressure. Further, the circular cross section of the coiled tubing flow bore provides a more efficient flow path than the annular cross-section of the wellbore annulus, and minimizes "dead spaces", i.e. areas of blockage where little or no flow can get through, which is where the cuttings may become trapped. Additionally, the flow area in the coiled tubing flow bore is the same size along the entire flow path, whereas the wellbore annulus increases in size from the bottom to the top of the wellbore, thereby increasing the likelihood that cuttings will fall out of suspension in the larger areas.

In some embodiments, cuttings removal is further improved by utilizing a subsurface pump disposed in the BHA. In such embodiments, the drill string preferably comprises composite coiled tubing with an electric power conductor embedded within the wall of the coiled tubing, thereby eliminating the need for a wireline extending through the drill string flowbore to provide power to the subsurface pump. A wireline is undesirable because it can interfere with the movement of the cuttings through the drill string flowbore and can create dead spots in the flow area. If the wireline is positioned so as to create dead spots, then an accumulation of cuttings may block an area of the circular cross-section of the drill string bore. Accordingly, by using composite coiled tubing, the use of a wireline may be eliminated.

In another aspect, the embodiments of the present invention are directed to increasing drilling capacity by disposing a subsurface pump in the BHA that can boost the pressure of the drilling fluid. By providing a subsurface pump, the drilling depth capacity of the BHA drilling with coiled tubing significantly increases. The pumps at the surface cause the drilling fluids to enter the coiled tubing at a high pressure, which is limited by the pressure capacity of the coiled tubing. The pressure decreases as the drilling fluids flow down the well and through the downhole motor. However, when the BHA includes a subsurface pump, the pressure of the drilling fluid may be boosted and increased by the subsurface pump back up to the same high pressure entering the coiled tubing at the surface, thereby maintaining the horsepower of the downhole motor and allowing the BHA to drill more borehole and continue drilling ahead. The subsurface pump is preferably a moineau pump such that the number of stages determines how much pressure drop the pump provides and how much horsepower is required to operate it. Further, the subsurface pump is preferably driven by a motor with a variable speed drive so that the motor speed is controllable to change the pressure output of the subsurface pump. Preferably the subsurface pump is monitored and controlled from the surface.

To further improve cuttings removal and simultaneously increase drilling capacity, another preferred embodiment of the invention provides two subsurface pumps in the BHA, one that rotates in the reverse flow direction to move cuttings upwardly through the drill string flowbore, and another that rotates in the standard flow direction to boost the flow rate of the drilling fluid supplied to the drilling motor. The most preferred embodiment of the invention provides two subsurface pumps that are independent of one another to allow for continued operation should one pump fail.

Figure 3:
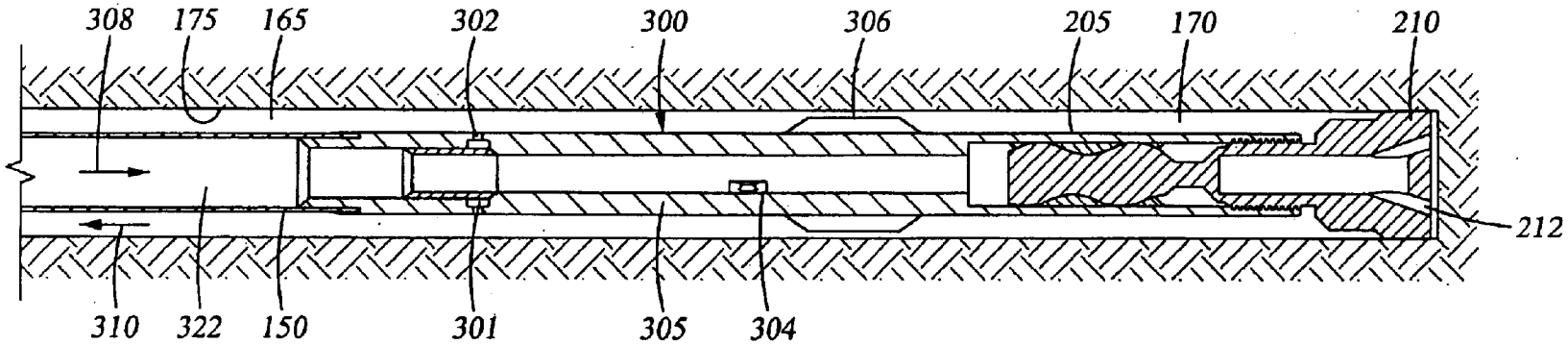
FIG. 3 depicts a cross-sectional side view of one embodiment of a bottom hole assembly (BHA) operating in a standard flow direction.
Figure 4:
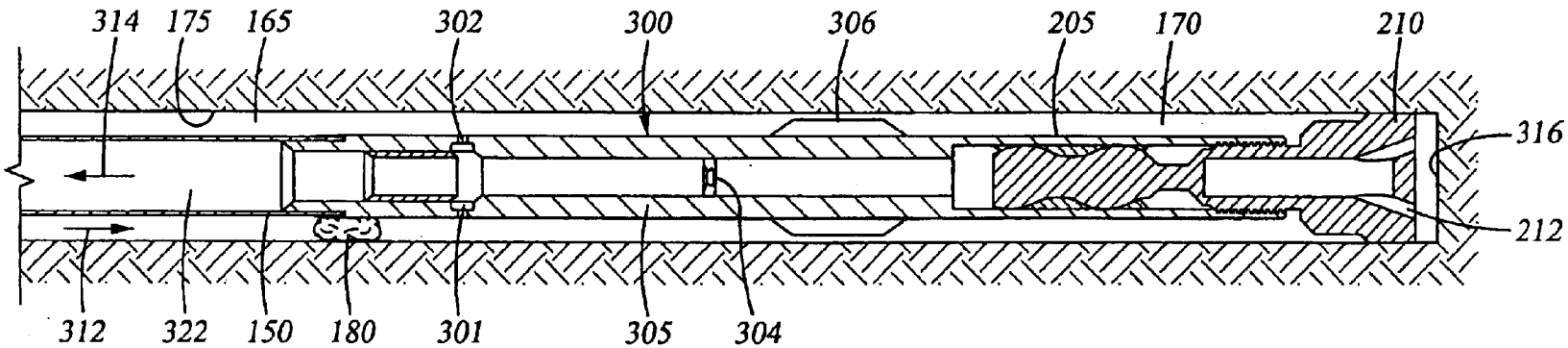
FIG. 4 depicts a cross-sectional side view of the BHA of FIG. 3 operating in a reverse flow direction.

In more detail, FIG. 3 and FIG. 4 depict the operation of one embodiment of a BHA 300 during drilling of the deviated wellbore 170 and during cuttings removal, respectively. The BHA 300 is connected to a coiled tubing drill string 150 and comprises a circulation valve 302, a check valve 304, a stabilizer 306, a drill motor 205, and a drill bit 210 having nozzles 212. This embodiment includes no subsurface pump to aid with drilling or cuttings removal. FIG. 3 depicts the operation of the BHA 300 during drilling of a deviated wellbore 170, when cuttings removal is not occurring. The circulation valve 302 selectively opens and closes ports 301 extending through the wall of the housing 305 of the BHA 300. Ports 301 provide fluid communication between the coiled tubing flowbore 322 and the wellbore annulus 165, thereby allowing drilling fluids to by-pass the drilling motor 205 when the circulation valve 302 is open. The stabilizer 306 centers the BHA 300 within the deviated borehole 170 and has as one of its objectives to keep ports 301 clear of the borehole wall 175.

In this configuration, drilling fluid 176 flows in the standard flow direction 308, and is circulated downwardly through the coiled tubing 150 and into the BHA 300. The drilling fluid flows through the open check valve 304 to drive the drill motor 205, which in turn rotates the drill bit 210. Then drilling fluid passes through nozzles 212 and flows upwardly through the wellbore annulus 165 along path 310 to the surface 10. During drilling, the circulation valve 302 is closed.

FIG. 4 depicts the operation of the BHA 300 when cuttings removal is occurring. In this configuration, drilling has stopped, the drill bit 210 is drawn off the bottom 316 of the wellbore 170, the check valve 304 is closed, and the circulation valve 302 is open. Circulation has been reversed such that the drilling fluid 176 flows downwardly through the wellbore annulus 165 along path 312 from the surface 10 through the open ports 301 and the circulation valve 302 and ports. 301 and upwardly through the coiled tubing flowbore 322 along path 314. As the drilling fluid circulates in the reverse flow direction 312, 314, it carries with it the cuttings 180 that were generated by drill bit 210 during the drilling of the wellbore 170. The check valve 304 is closed during reverse flow to prevent cuttings 180 from migrating into the drill motor 205, which can cause damage to the motor 205. Thus, in the reverse flow direction, the check valve 304 is closed, and the flow of drilling fluid is directed along path 312, through the circulation valve 302 and up through the coiled tubing 150 along path 314 to the surface, and no flow moves downwardly through the drill motor 205 and bit 210.

Figure 5:
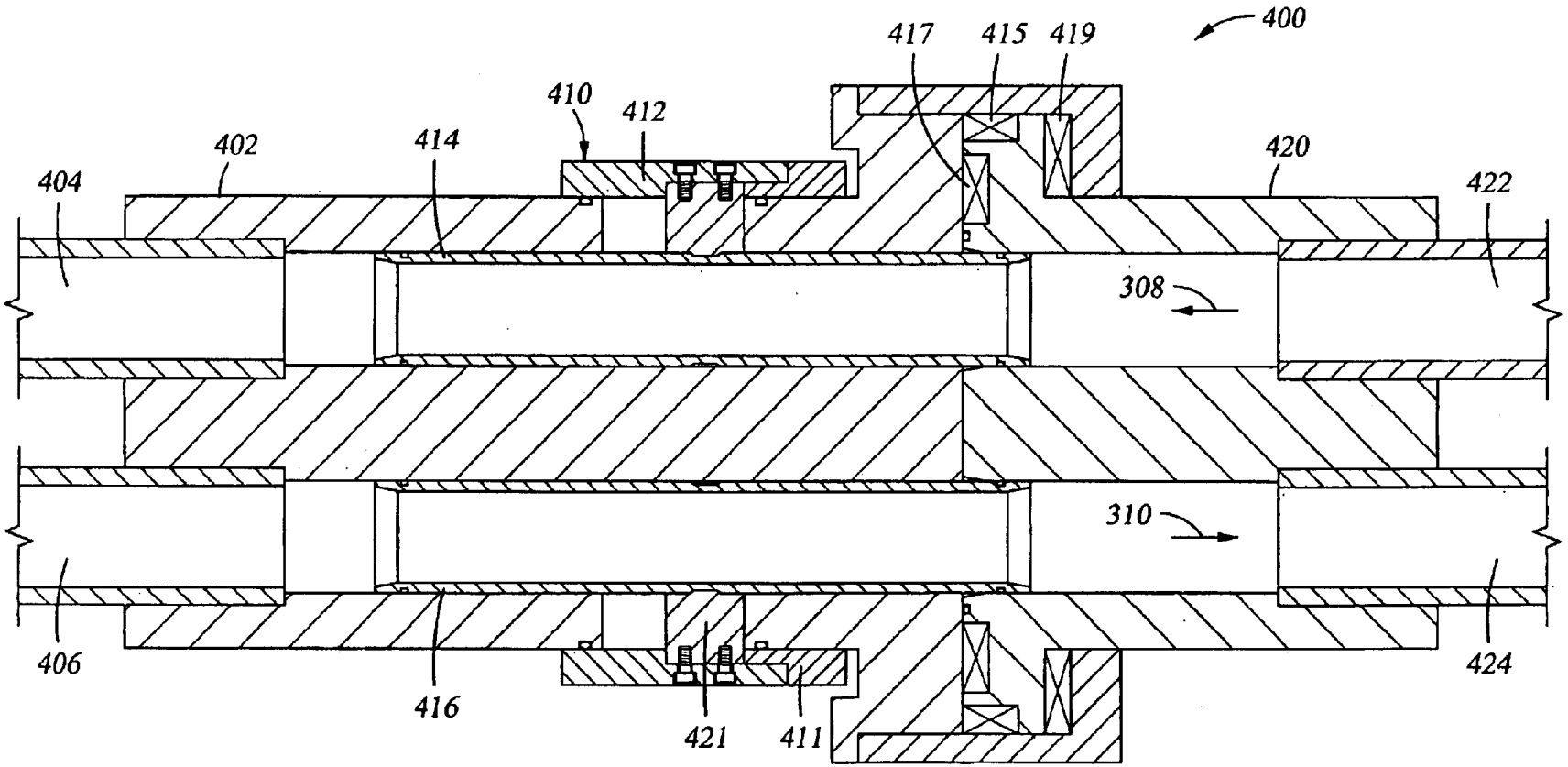
FIG. 5 depicts a cross-sectional side view of a cross-over valve, aligned and locked into place for the standard flow direction shown in FIG. 3.
Figure 6:
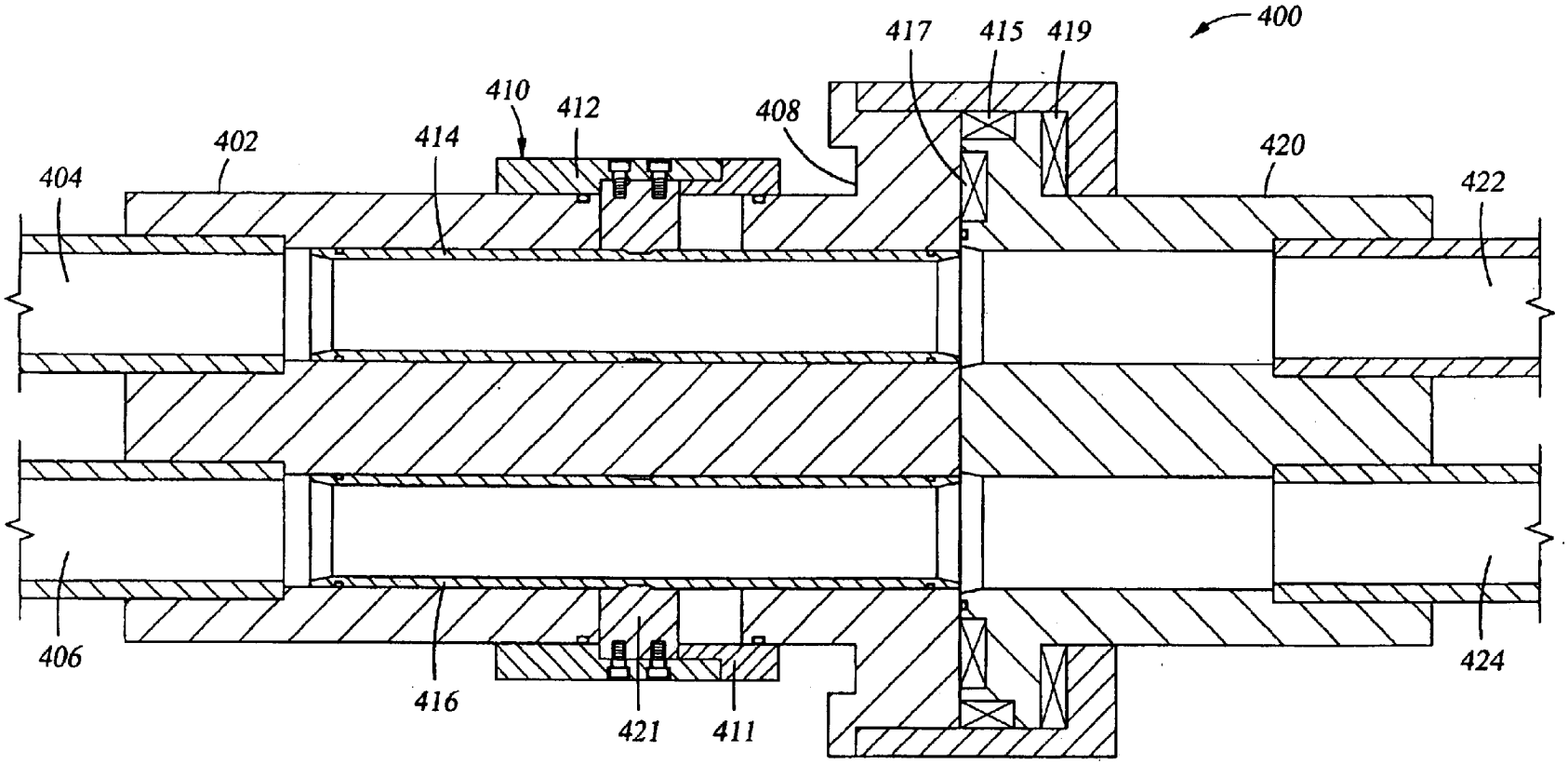
FIG. 6 depicts a cross-sectional side view of the cross-over valve of FIG. 5 in the unlocked position.
Figure 7:
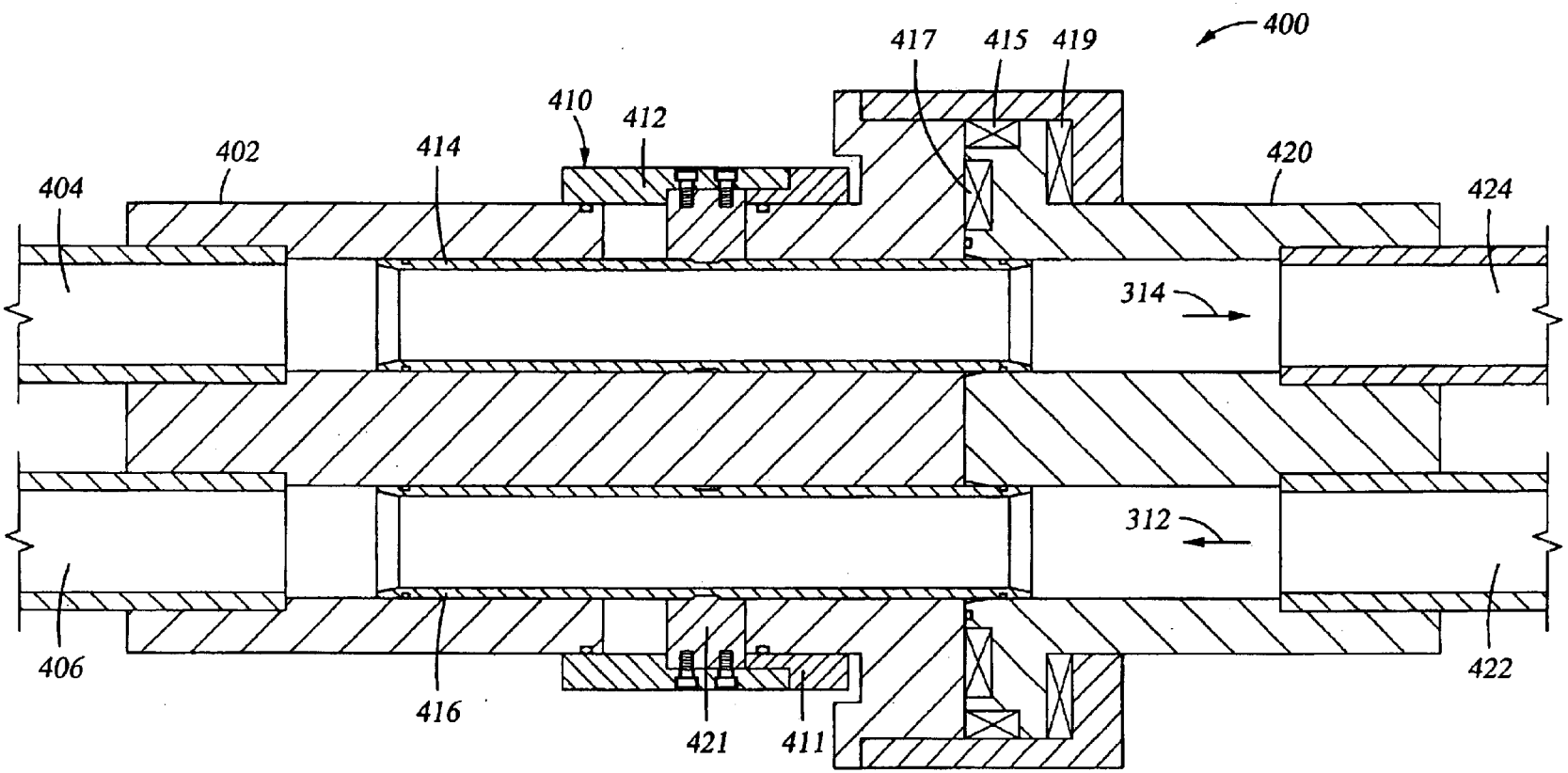
FIG. 7 depicts a cross-sectional side view of the cross-over valve of FIG. 5, aligned and locked into place for the reverse flow direction shown in FIG. 4.

In the configuration of FIGS. 3 and 4, no subsurface pump is provided such that only the surface pumps 132 pump the drilling fluids downhole for the standard and reverse flow directions. To direct the flow in the standard 308, 310 or reverse 312, 314 flow directions, preferably flow is redirected at the surface between the surface pumps 132 and the wellhead 134. Redirection of the flow may be accomplished, for example, using a cross flow valve 400. FIGS. 5–7 show a sequence of alignment for a cross-flow valve 400 designed to reverse the flow of fluid at the surface, such that the surface pumps 132 operate in the same direction, but fluid can be redirected between the coiled tubing flowbore 322 and the wellbore annulus 165 allowing redirection from the standard flow direction 308, 310 to the reverse flow direction 312, 314. The cross-flow valve 400 comprises a housing 402, a locking assembly 410, and a rotational upper portion 420. The housing 402 includes passageways 404, 406 that connect to the coiled tubing flowbore 322 and the wellbore annulus 165, respectively. The locking assembly 410 comprises an outer cylinder 412 connected to sleeves or tubular conduits 414, 416 that extend into the passageways 404, 406 of the housing 402 in the locked position. The cylinder 412 and tubular conduits 414, 416 are moveable axially with respect to both the housing 402 and the rotational upper portion 420. The upper portion 420 comprises passageways 422, 424 that connect to the inlet and exit of the surface pumps, respectively, and align with the tubular conduits 414, 416 and passageways 404, 406 of the housing 402 to provide flow paths therethrough. The upper portion 420 is rotatable 180° by means of bearings 415, 417, 419 with respect to the housing 402 to enable different alignments of the coiled tubing flowbore passageway 404 and wellbore annulus passageway 406 with inlet passageway 422 and outlet passageway 424. From the standard flow and locked configuration of FIG. 5, the locking assembly 410 can be moved axially as shown in FIG. 6 to allow rotation of the upper portion 420 with respect to the housing 402. Then the locking assembly 410 moves back into a locked position as shown in FIG. 7 once passageways 404, 406 are aligned with passageways 422, 424 as desired. An actuator includes a piston 421 attached to a tongue portion 411 on the outside and to conduits 414, 416 on the inside such that upon axial movement of piston 421, locking assembly 410 is actuated and conduits 414, 416 are moved into and out of engagement with inlet and outlet passageways 422, 424.

In more detail, FIG. 5 depicts the cross-flow valve 400 in the standard flow direction with the locking assembly 410 locking the housing 402 and upper portion 420 together. The surface pumps 132 are connected to the cross-flow valve 400 through inlet passageway 422. The surface pumps 132 pump fluid in the standard flow direction 308 through inlet passageway 422, locking assembly conduit 414, and coiled tubing flowbore passageway 404, which is connected to the coiled tubing 150. Likewise, flow path 310 extends through exit passageway 424, locking assembly conduit 416 and wellbore annulus passageway 406, which is connected to the wellbore annulus 165. Thus, when the flow returns to the surface 10, it flows along path 310 through passageway 406, through conduit 416, and returns back to the drilling fluid reservoir through passageway 424. FIG. 6 depicts the cross-flow valve 400 with the locking assembly 410 unlocked to allow the upper portion 420 to rotate. The locking assembly 410 has been moved axially to the left to draw a tongue portion 411 of the cylinder 412 away from a shoulder portion 408 of the housing 402, and conduits 414, 416 out of passageways 422, 424, thereby unlocking the upper portion 420 from the housing 402. With the locking assembly in the position shown in FIG. 6, the upper portion 420 can be rotated 180°, and the locking assembly 410 can then be moved back to the position where the tongue 411 is disposed within the shoulder 408 as shown in FIG. 7 and conduits 414, 416 are repositioned in passageways 422, 424. Conduits 422, 424 are flexible, such as hoses, allowing the 180° rotation. In the position shown in FIG. 7, the passageways 422, 424 within the upper portion 420 have been realigned whereby circulation is thereby reversed. In particular, flow from the surface pumps 132 is directed along path 312 through inlet passageway 422, through conduit 416 and through wellbore annulus passageway 406. After flowing through the circulation valve 302 in the BHA 300, the drilling fluid flows back to the surface through the flowbore 322 of the coiled tubing 150, which connects to inlet passageway 404. The flow then travels along path 314 through conduit 414 and exit passageway 424 back to the drilling fluid reservoir (not shown).

Figure 8:
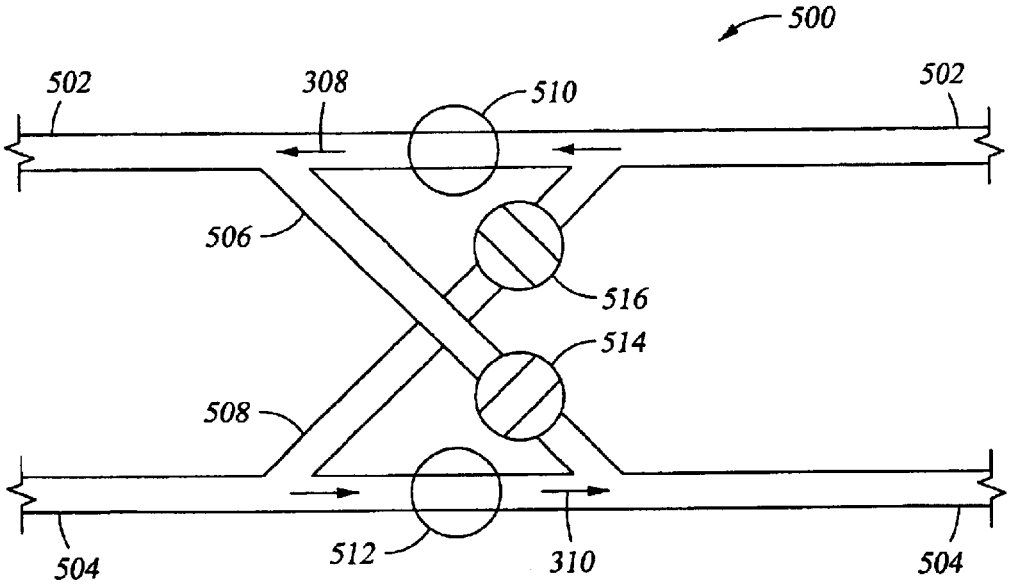
FIG. 8 depicts a schematic view of a valving arrangement aligned for the standard flow direction.
Figure 9:
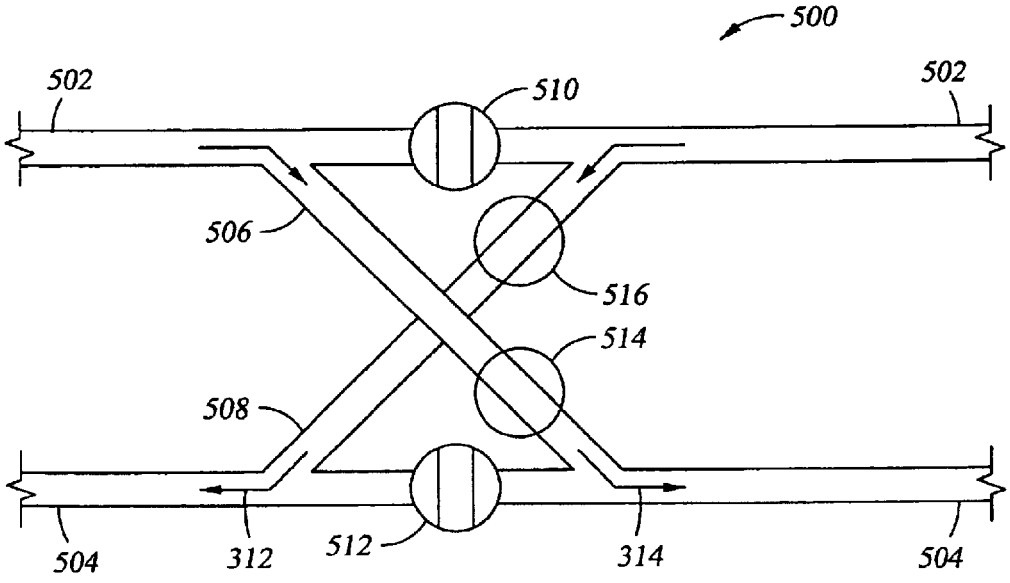
FIG. 9 depicts a schematic view of the valving arrangement of FIG. 8 aligned for the reverse flow direction.

Referring to FIGS. 8 and 9, another reverse flow assembly 500 for reversing the flow of fluid at the surface is depicted. The valving assembly 500 comprises two main pipes 502, 504, two cross-over pipes 506, 508, two main pipe valves 510, 512, and two cross-over pipe valves 514, 516. Main pipe 502 connects between the surface pump 132 and the coiled tubing 150, and main pipe 504 connects between the wellbore annulus 165 and the drilling fluid reservoir (not shown). When configured in the standard flow direction as shown in FIG. 8, the main pipe valves 510, 512 on the main pipes 502, 504, respectively, are open, and the cross-over pipe valves 514, 516 on the cross-over pipes 506, 508, respectively, are closed so flow is directed in the standard flow direction 308, 310, downwardly through the coiled tubing 150 and upwardly through the wellbore annulus 165. When configured in reverse flow as shown in FIG. 9, the main pipe valves 510, 512 are closed, and the cross-over pipe valves 514, 516 are open so flow is directed in the reverse flow direction 312, 314, downwardly through the annulus 165 and upwardly through the bore of the coiled tubing 150.

Figure 10:
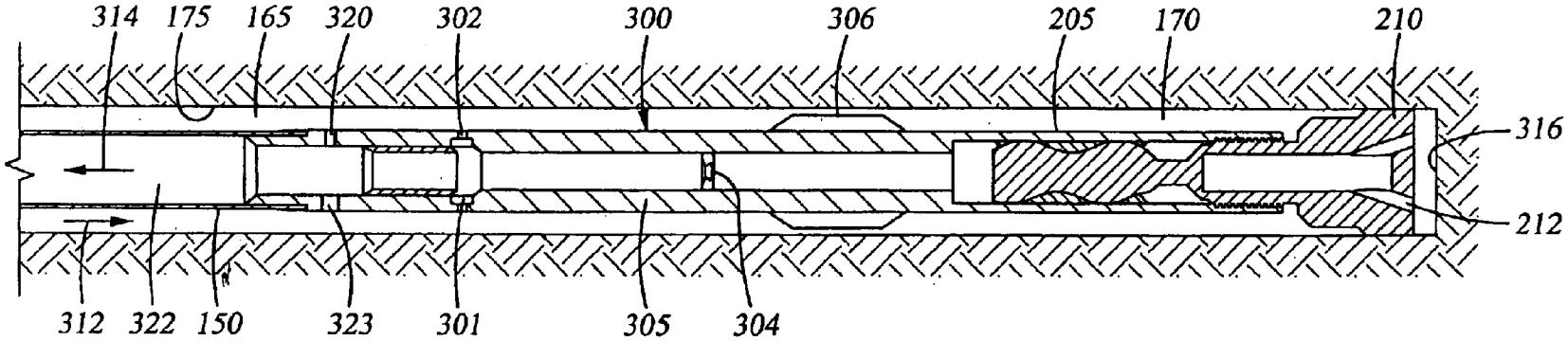
FIG. 10 depicts a cross-sectional side view of the BHA of FIG. 3 including a differential pressure gauge.

Referring now to FIG. 10, a differential pressure transducer 320 is provided upstream of the circulation valve 302 on the BHA 300 of FIGS. 3 and 4. The differential pressure transducer 320 provides an indication to the operator at the surface regarding whether the ports 301 of the circulation valve 302 are becoming clogged with cuttings 180. Although the operator would know when the drilling fluid cuttings 180 totally block the circulation valve 302, the differential pressure transducer 320 provides an early detection means for the operator to detect when cuttings accumulation is beginning to develop around circulation valve 302. A transmitter 323 in the bottom hole assembly transmits signals from pressure transducer 320 to the surface. One type of differential pressure transducer is Model No. 095A210 manufactured by Industrial Sensors & Instruments, Inc. of Round Rock, Tex. However, other types of differential pressure transducers would also be suitable for use in the BHA 300.

Figure 11:
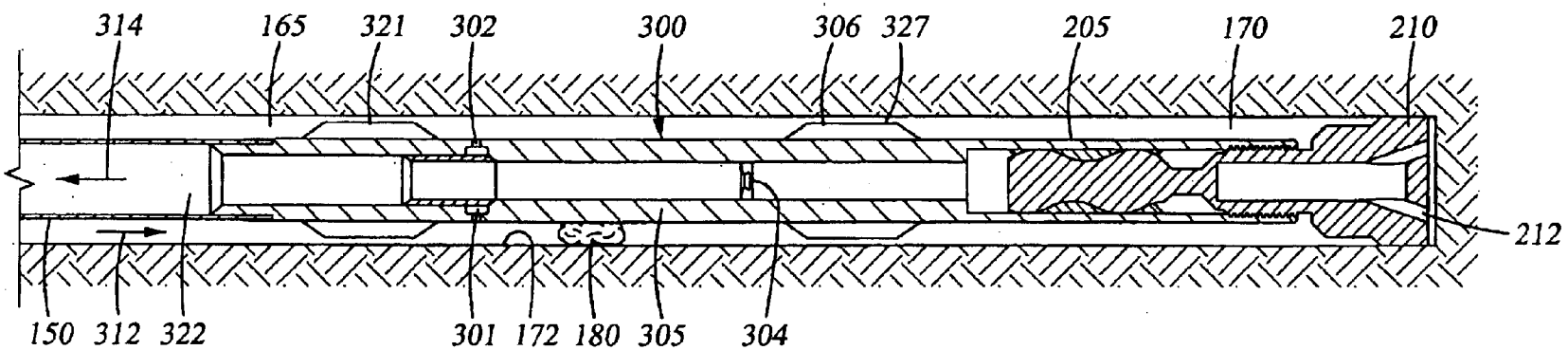
FIG. 11 depicts a cross-sectional side view of the BHA of FIG. 3 with a second stabilizer.

Referring now to FIG. 11, a second stabilizer 321 may be provided on the BHA 300 of FIGS. 3 and 4, preferably upstream of the circulation valve 302. The second stabilizer 321 centralizes the BHA 300 in the borehole 170 so that the circulation valve ports 301 are not adjacent the lower side 172 of the deviated borehole 170. The second stabilizer 321 also provides a reduced flow area 327 in the wellbore annulus 165 such that when the drilling fluid passes the second stabilizer 321, flow velocity increases, thereby stirring up the cuttings 180. Because the second stabilizer 321 is centralized in the borehole 170, the cuttings 180 are more likely to pass through each of the circulation valve ports 301 rather than only moving through one of the ports 301.

Figure 12:
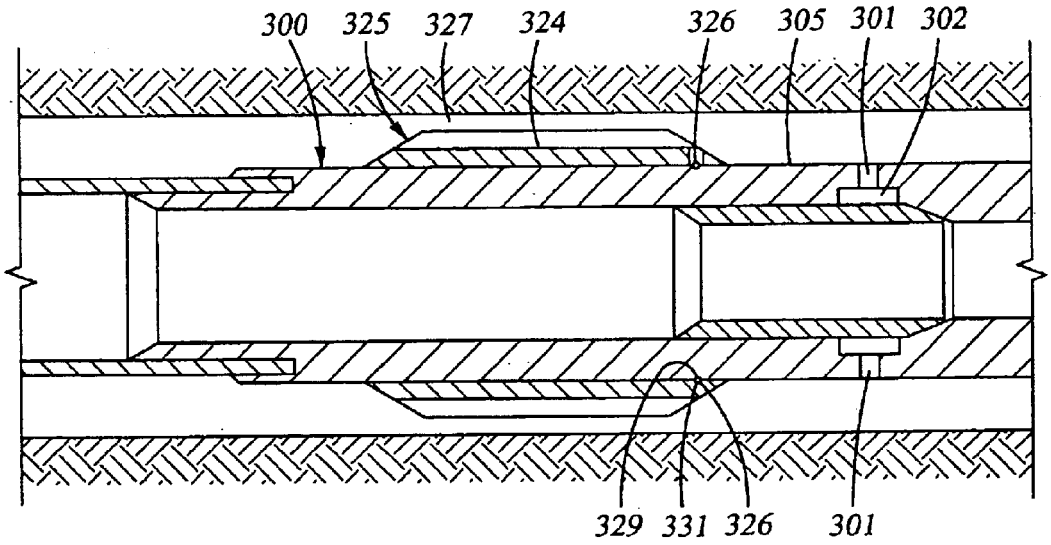
FIG. 12 depicts an enlarged cross-sectional side view of a slide-on stabilizer.

FIG. 12 depicts an enlarged view of a slide-on stabilizer 325 as the second stabilizer 321 of FIG. 11. The slide-on stabilizer 325 comprises a sleeve 324 that slides onto the outer housing 305 of the BHA 300 and then locks into place, preferably using a soft nail 326. In particular, a groove 331 may be provided on the inside of the stabilizer sleeve 324 and a corresponding groove 329 may be provided on the outer housing 305 of the BHA 300 such that a soft nail 326 can be driven between the two grooves to lock the slide-on stabilizer 325 into place on the outer housing 305 of the BHA 300. The slide-on stabilizer 325 of FIG. 12 is a fixed blade stabilizer.

Figure 13:
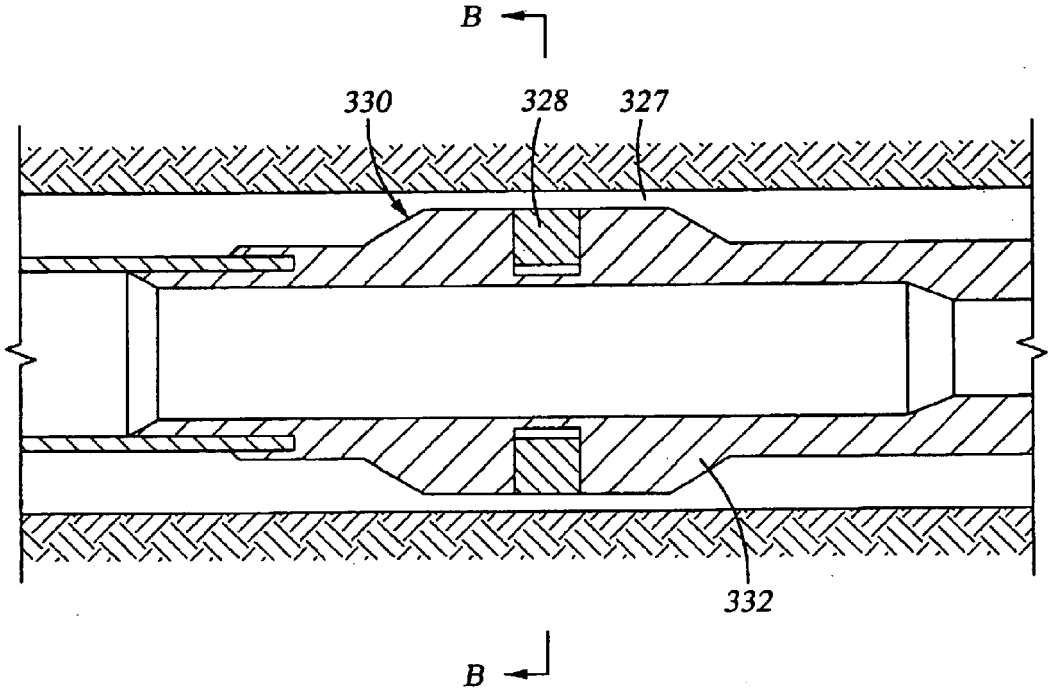
FIG. 13 depicts an enlarged cross-sectional side view of an adjustable stabilizer.

FIG. 13 depicts an enlarged side-view of an adjustable diameter blade stabilizer 330 that may be used as the second stabilizer 321 of FIG. 11. The adjustable diameter stabilizer 330 comprises a sleeve 332 with moveable blades 328. As shown in the cross-sectional end views of FIGS. 14 and 15, taken along section B—B of FIG. 13, the diameter of the adjustable blade stabilizer 330 can be changed by expanding blades 328 with respect to the sleeve 332, to provide a reduced flow area 327, thereby increasing the flow velocity of the drilling fluid as it moves past the adjustable diameter stabilizer 330. Adjustable blade stabilizers are shown and described in U.S. Pat. Nos. 5,318,137; 5,318,138; 5,332,048; and 6,488,104, all hereby incorporated herein by reference.

Figure 14:
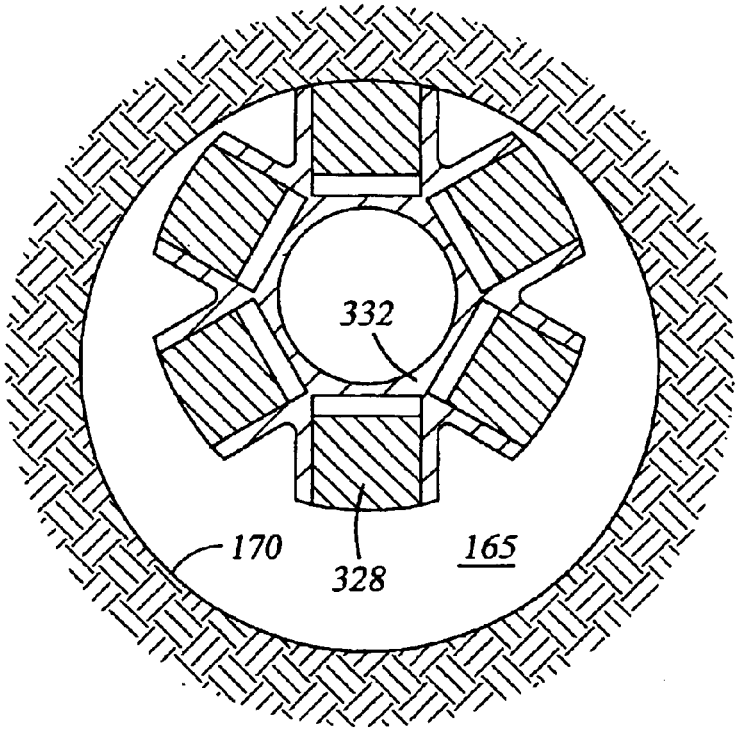
FIG. 14 depicts a cross-sectional end view taken along section B—B of FIG. 13, with the adjustable stabilizer in the contracted or minimum diameter position.
Figure 15:
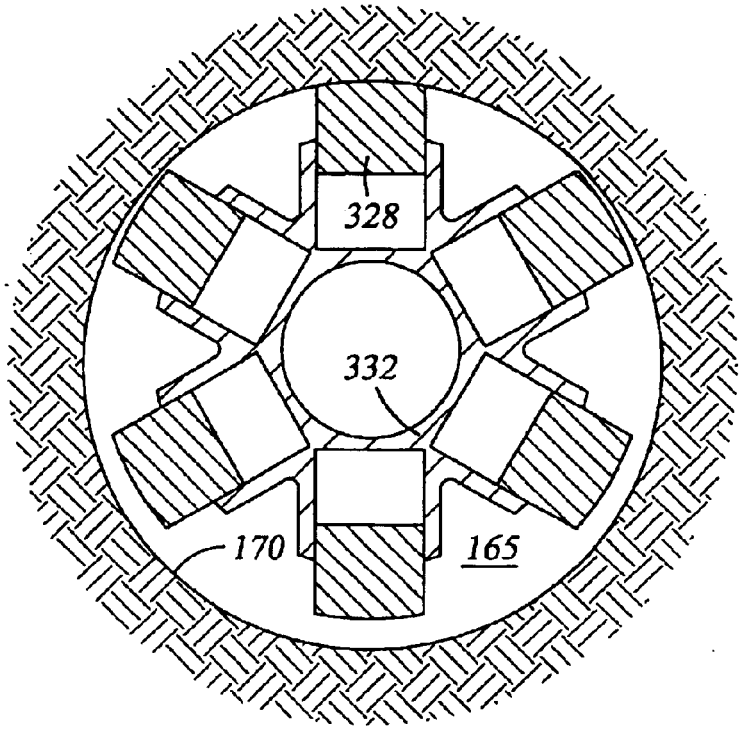
FIG. 15 depicts a cross-sectional end view taken along section B—B of FIG. 13, with the adjustable stabilizer in the maximum diameter position.
Figure 16:
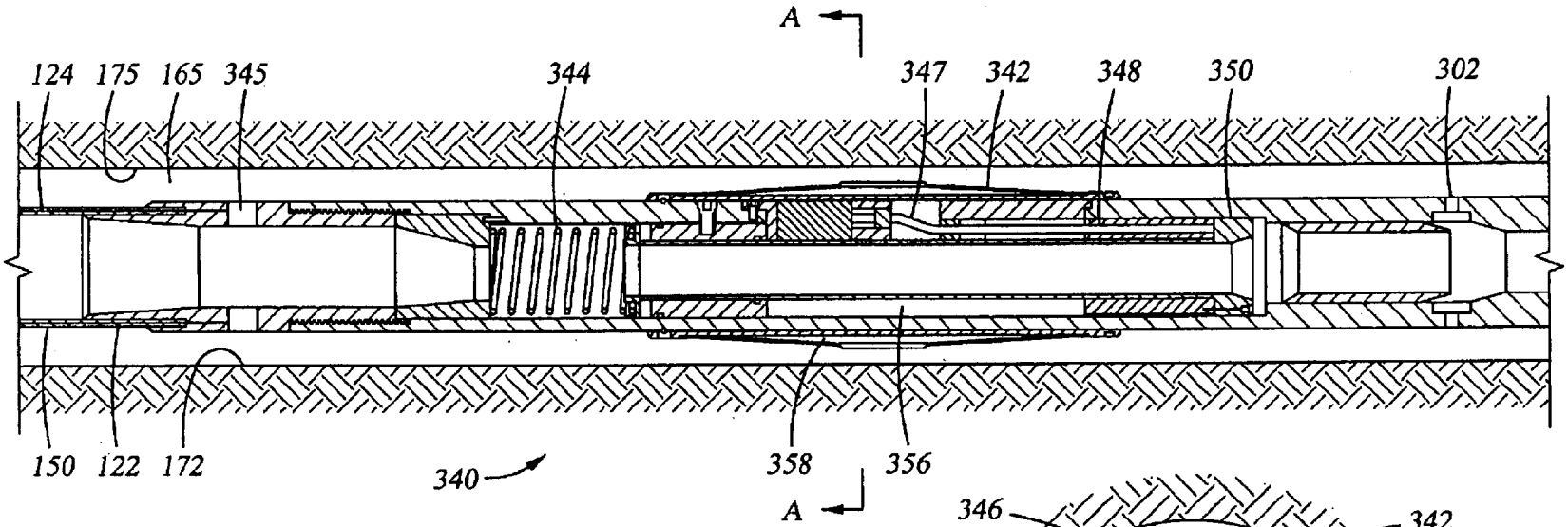
FIG. 16 depicts a cross-sectional side view of an expandable bladder assembly in a collapsed position.
Figure 16A:
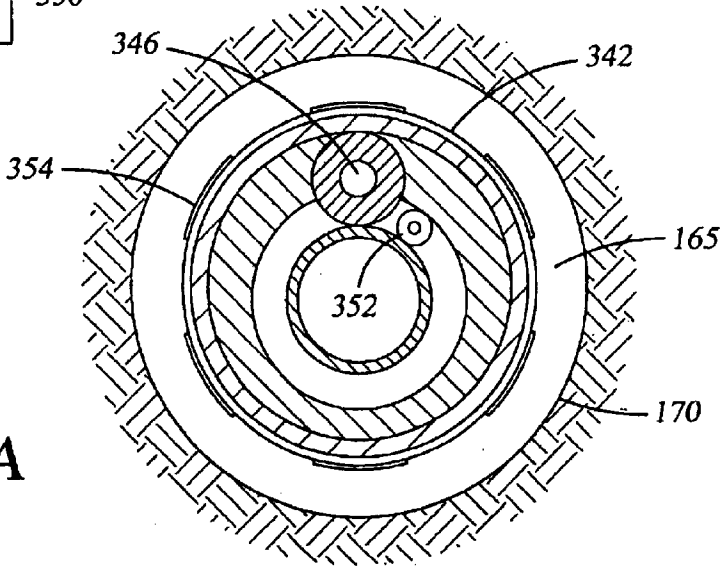
FIG. 16A is a cross-sectional end view taken along section A—A of FIG. 16.
Figure 17:
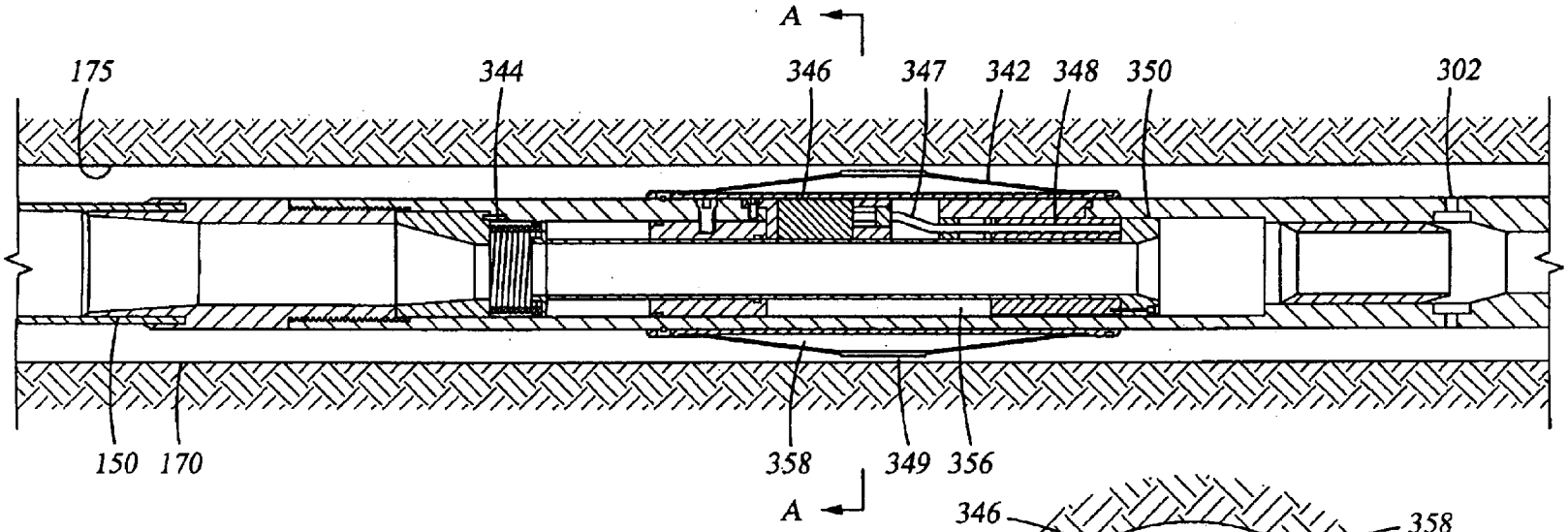
FIG. 17 depicts a cross-sectional side view of the expandable bladder assembly of FIG. 16 in an expanded position.
Figure 17A:
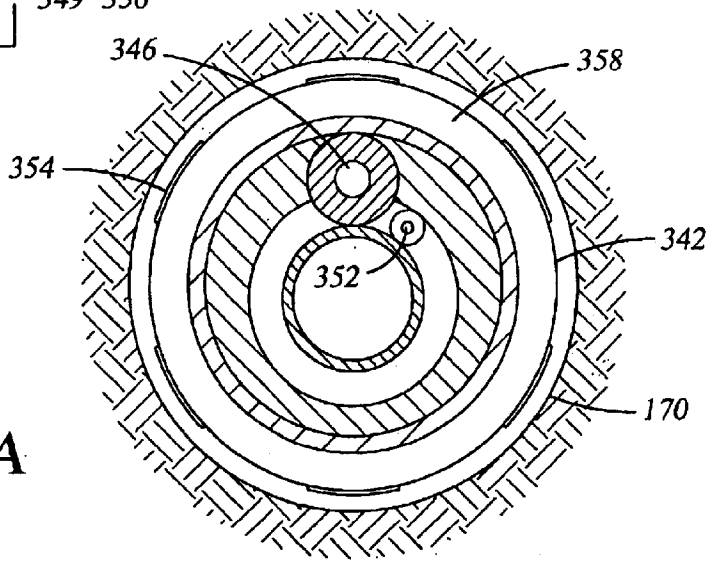
FIG. 17A is a cross-sectional end view taken along section A—A of FIG. 17.

Referring now to FIGS. 16, 16A, 17 and 17A, an alternative embodiment of the adjustable blade stabilizer 330 depicted in FIGS. 13–15 is shown. The expandable bladder 340 is shown in the collapsed position in FIG. 16 and in the fully expanded position in FIG. 17. The bladder 340 comprises an expandable body 342 and an actuator assembly, which includes a biasing spring 344, an electric motor 346, a drive train 347, a jack screw 348, a piston 350, and a linear potentiometer 352. Metal strips 354 are preferably provided along the outer surface of the body 342 to protect the surface from wearing as it engages the borehole wall 175. The biasing spring 344 pushes the piston 350 downwardly to collapse the bladder body 342 as shown in FIG. 16. An actuator assembly is used to expand the bladder body 342. The electric motor 346 moves drive train 347, which thereby moves the jack screw 348 to engage the piston 350 and move upwardly to compress the spring 344. Compressing the spring 344 causes fluid to move from a first fluid chamber 356 to a second fluid chamber 358 to expand the bladder body 342. The electric motor 346 thus moves the piston 350 via a jack screw 348 to allow accurate positioning of the piston 350, which correlates with a predetermined radial expansion of the bladder body 342. The radial clearance 359 between the bladder body 342 and the borehole wall 175 is selected to generate a particular fluid velocity. The position of the piston 350 is accurately monitored by the linear potentiometer 352, which is attached thereto. The potentiometer 352 is a rod that moves within a cylinder, and the distance of movement of the rod in the cylinder correlates with the movement of the piston 350 and thus the expansion of the bladder body 342. The potentiometer readings 352 are provided to the operator at the surface in real-time through signal wires that are run to the surface through the wall of the composite coiled tubing 150 and sent to the processor 120 via wires 122, 124. A transmitter 345 transmits the potentiometer measurements to the surface 10. Like the adjustable stabilizer 330, the purpose of the bladder 340 is to reduce the flow area in the wellbore annulus 165 so as to stir up the cuttings 180 and increase flow velocity as drilling fluid moves past the bladder body 342 in the expanded position shown in FIG. 17 and continues toward the circulation valve 302 during reverse flow. One type of actuator assembly is shown and described in U.S. patent application Ser. No.: 09/678,817 filed Oct. 4, 2000 and entitled "Actuator Assembly", hereby incorporated herein by reference. See also U.S. patent application Ser. No.: 09/467,588 filed Dec. 20, 1999 entitled "Three Dimensional Steerable System", hereby incorporated herein by reference.

Figure 18:
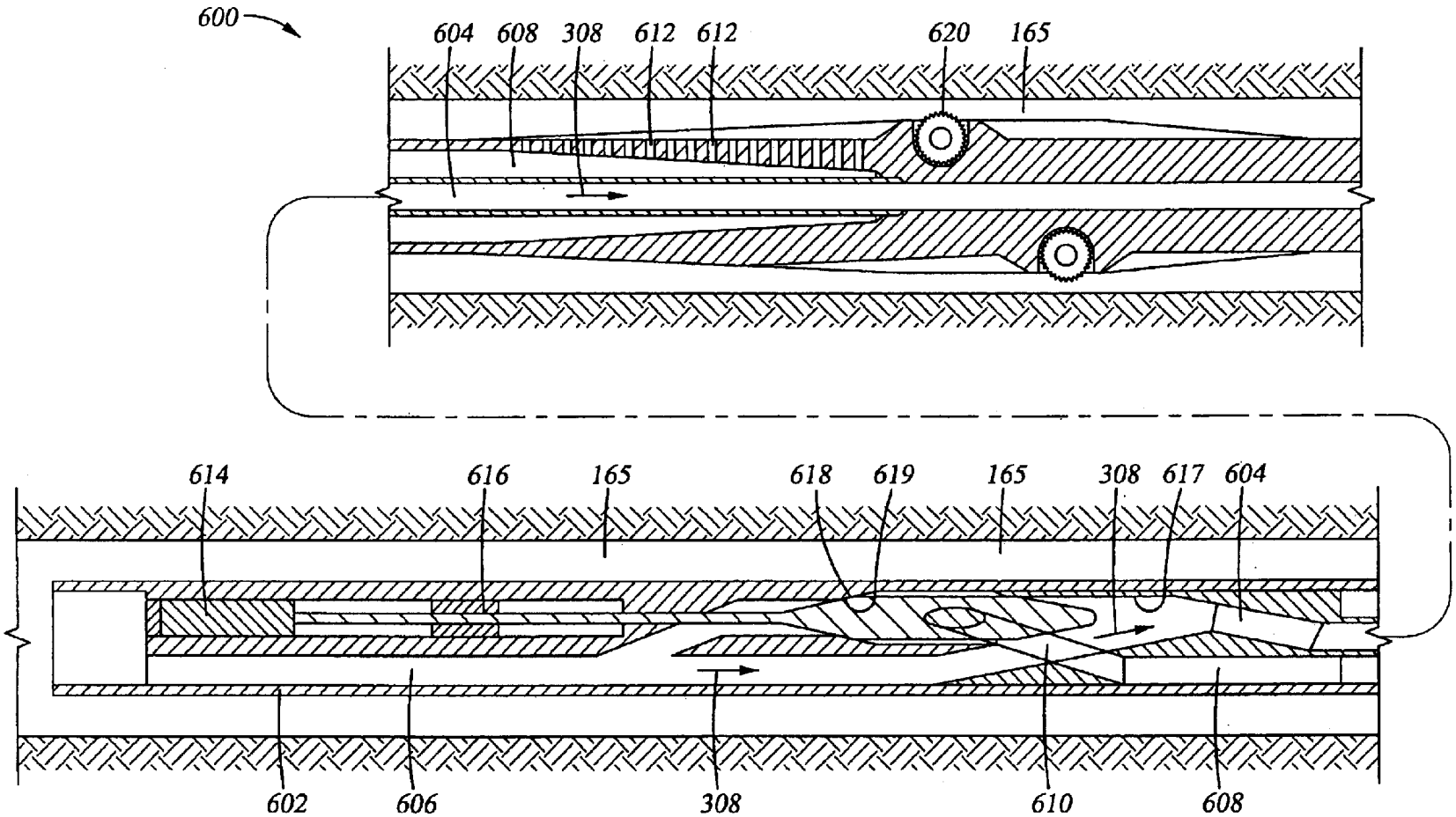
FIG. 18 depicts a cross-sectional side view of a valve assembly aligned for the standard flow direction.
Figure 19:
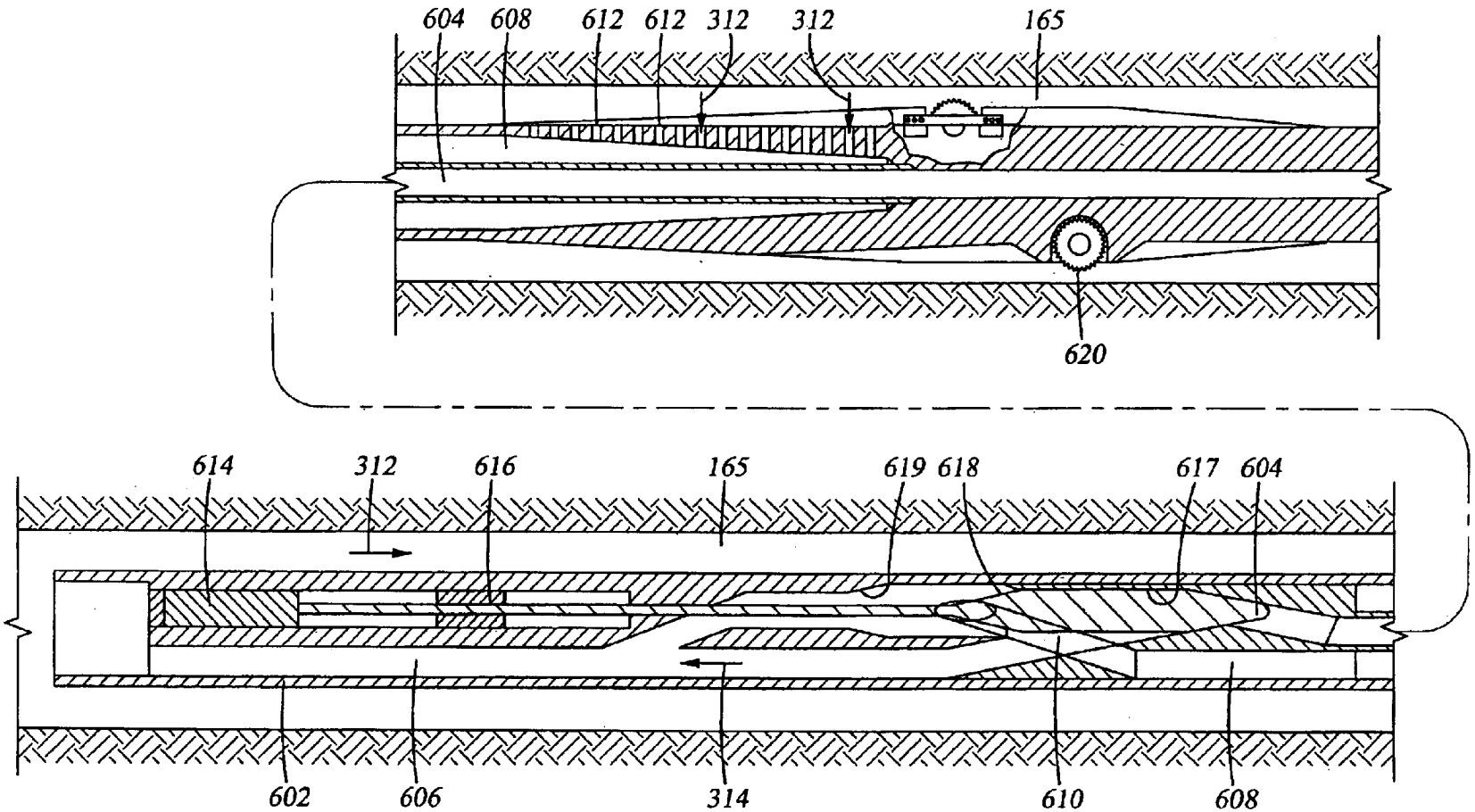
FIG. 19 depicts a cross-sectional side view of the valve assembly of FIG. 18 aligned for the reverse flow direction.

FIGS. 18 and 19 depict an alternative valve assembly 600 to replace the circulation valve 302 of FIGS. 3 and 4. FIG. 18 depicts the valve assembly 600 in a position that closes ports 612 to the wellbore annulus 165 but opens a BHA conduit 604 to allow flow therethrough to the BHA 300. FIG. 19 depicts the valve assembly 600 in a position where ports 612 to the annulus 165 are open, and the BHA conduit 604 is closed to prevent flow down to the BHA 300. The valve assembly 600 comprises a housing 602 with a central conduit 606 communicating with BHA conduit 604 and a port conduit 608 at a junction 610. At junction 610, BHA conduit 604 has a valve seat 617 and valve seat 619 is adjacent the entrance into port conduit 608. The valve assembly 600 further comprises an electric motor 614 that is used to move a drive train 616 connected to a valve element 618 that are all in the upper conduit 604. Valve element 618 is driven between valve seats 617, 619. The central conduit 606 feeds into both the BHA conduit 604 and the port conduit 608 in the housing 602, and the port conduit 608 surrounds the BHA conduit 604. The port conduit 608 is connected to ports 612 in the housing 602 that lead externally of the valve assembly 600 to the wellbore annulus 165.

Downstream of the ports 612, two reamer cutters 620, are provided on the housing 602 of the valve assembly 600 to reduce the cuttings 180 to a smaller size before the cuttings 180 are drawn into the ports 612. The reamer cutters 620 are provided to crush the cuttings 180 that move into the ports 612 so that large cuttings are crushed into smaller pieces. The cutters 620 are shown downstream of the ports 612, but the cutters 620 may also be positioned upstream of the ports 612. With the cutters 620 in the position shown in FIGS. 18 and 19, the assembly 600 is run up and down within the borehole 170 to crush the cuttings 180 before reverse circulation takes place. The cutters 620 are rotatably mounted on housing 602 and rotate by frictional engagement with the wellbore wall 175 such that they roll as the assembly 600 moves within the wellbore 170. No other power is required to rotate cutters 620.

Referring to FIG. 18, when the valve element 618 is positioned against valve seat 619 at the entrance of port conduit 608 as depicted, drilling fluid moves in the standard flow direction from the surface along path 308 through central conduit 606, then through BHA conduit 604, which is aligned to deliver drilling fluid to the BHA 300. FIG. 19 shows the same assembly 600 with the valve element 618 positioned against valve seat 617 such that during reverse flow, drilling fluid flows from the annulus 165 along path 312 to enter ports 612, flowing along path 314 through port conduit 608 and into central conduit 606.

Accordingly, when the valve element 618 is in the position shown in FIG. 18, the BHA conduit 604 is open so that flow can move along path 308 downwardly through the BHA 300. When the valve element 618 is in the position shown in FIG. 19, the BHA conduit 604 is closed, and the port conduit 608 is open. Thus, during reverse flow, the drilling fluid can move along path 312 through the wellbore annulus 165, into the ports 612 and into the port conduit 608, then back to the surface 10 along path 314 through the central conduit 606 leading into the flowbore 322 of the coiled tubing 150. Using the assembly 600 shown in FIGS. 18 and 19, a check valve 304 is not necessary in the BHA 300 because the valve element 618 prevents flow downwardly through the BHA conduit 604 to the drilling motor 205 during reverse flow. Thus, the valve element 618 prevents any fluid with drill cuttings from flowing down into the drill motor 205.

Figure 20:
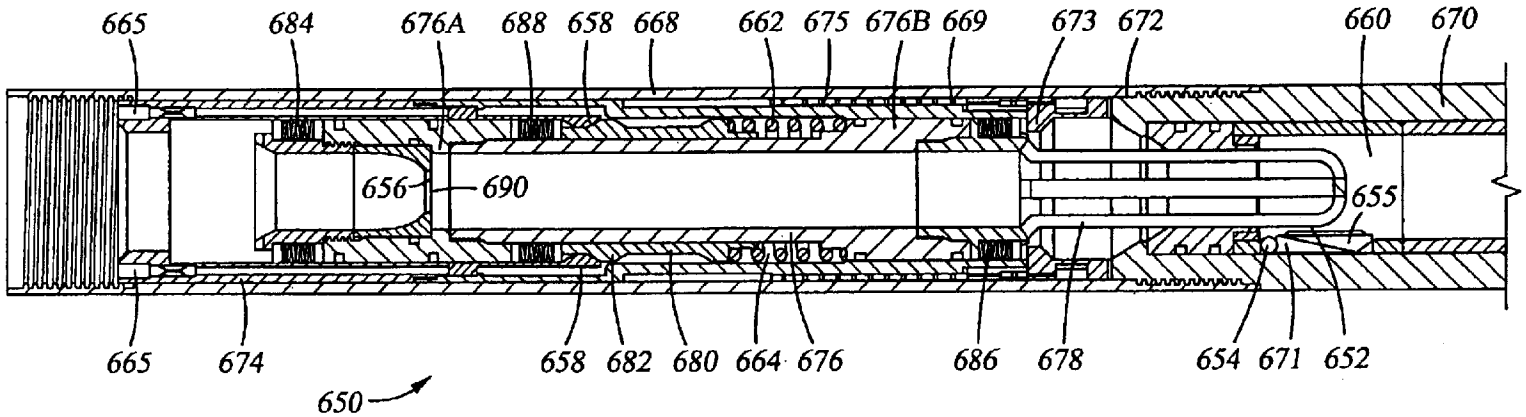
FIG. 20 depicts a cross-sectional side view of a velocity sensitive check valve in the normal open position.
Figure 21:
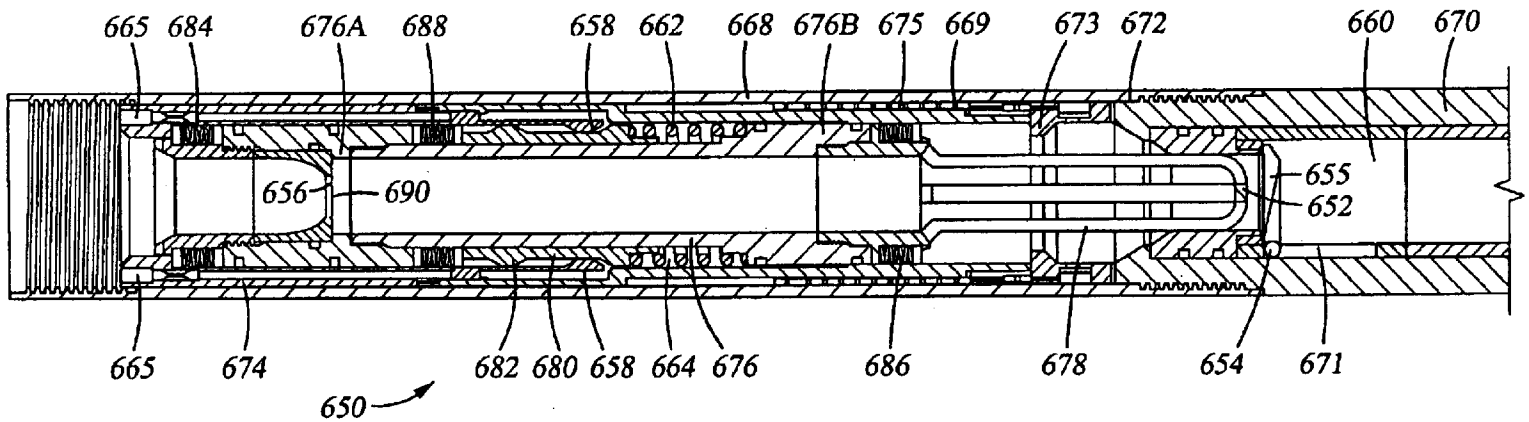
FIG. 21 depicts a cross-sectional side view of the velocity sensitive check valve of FIG. 20 in the closed position.

FIG. 20 and FIG. 21 depict a velocity sensitive check valve 650 that may be included in the BHA 300 for controlling a gas kick from the formation during reverse flow. FIG. 20 depicts the velocity sensitive check valve 650 in the normal open position and FIG. 21 depicts the valve 650 in the closed position. The velocity sensitive check valve 650 comprises a flow nozzle 656, a collet 658, a spring 662 disposed in an oil-filled chamber 664, a valve control assembly 652, and a flapper valve 654 that allows or prevents flow into a bore 660. Typically, a fluid head is provided in the wellbore 170 that counterbalances the pressure and flow of fluid from the formation. Regardless of the direction of flow, a certain amount of pressure is required at the surface to counteract or prevent a gas kick from the formation. During normal flow, the static head of the drilling fluid is provided against the formation pressure, and if a gas kick occurs, the check valve 304 in the BHA 300 closes and holds the fluid in check. However, during reverse flow, the check valve 304 is not positioned in such a way that it can close should a gas kick occur. Therefore, the velocity sensitive check valve 650 provides a closing mechanism should a gas kick occur during reverse flow. The velocity sensitive check valve 650 is positioned above the circulation valve 302, and it would not replace the check valve 304, which is provided for the purpose of preventing cuttings 180 from entering the drill motor 205.

The valve control assembly 652 is reciprocally disposed within valve housing 666 and has a first position extending past flapper valve 654 so as to hold the flapper 655 in the open position unless the velocity of fluid through the flow bore towards the surface in the reverse flow direction exceeds a certain limit, thereby causing the valve control assembly 652 to move upwardly to a second position no longer engaging flapper 655 and allowing flapper 655 to close as shown in FIG. 21. The velocity sensitive check valve 650 closes only during a gas kick, which exceeds the typical velocity of fluid in the reverse flow direction.

In more detail, the velocity sensitive check valve includes a housing 666 having first and second sections 668, 670 threaded together at 672. The flapper valve 654 is housed in second section 670, which includes a bore 660, and an internal recess 671 where the flapper 655 resides when in the open position as shown in FIG. 20. First section 668 includes a liner 674 in which is reciprocally mounted a sleeve 676 having a first portion 676A threaded to a second portion 676B. Flow nozzle 656 is disposed in first portion 676A of sleeve 676. Flow nozzle 656 has an orifice 690 of a predetermined size. An axially projecting cage 678 is attached to and extends from one end of second portion 676B, which engages a pair of stops 673 in the open position shown in FIG. 20. Collet 658 with collet fingers 658A have one end fastened to liner 674 and another end projecting into an annular area formed between the liner 674 and first sleeve portion 676A. A bushing 680 is disposed around first sleeve portion 676A and between collet fingers 658A and spring 662 in oil filled chamber 664 formed between liner 674 and first sleeve portion 676A. Oil ports 665 extend between the housing portion 668 and liner 674 to the chamber 662, and a compensating piston 675 and spring 669 ensures that there is adequate pressure on the oil. Bushing 680 includes an outer radially projecting annular shoulder 682 adapted to engage fingers 658A. Shock springs 684, 686, such as Belleville springs, are disposed on each end of sleeve 676 engaging liner 674 to absorb any shock caused by the reciprocation of sleeve 676 in liner 674. Another set of shock springs 688 may be provided between the first sleeve portion 676A and the bushing 680. The spring 662 in the oil chamber 664 holds the collet 658 and the U-shaped cage 678 in the position shown in FIG. 20. Then sufficient pressure loss across the flow nozzle 656 enables the sleeve 676 and bushing 680 to move upwardly against the spring 662 such that the collet fingers 658A move over the annular shoulder 682, and the valve control assembly 652 is withdrawn away from the flapper valve 654. Thus, the flapper valve 654 can close off the bore 660 as shown in FIG. 21. The cage 678 of control assembly 652 may be formed of three wires that enables flow therethrough and holds the flapper valve 654 open, but will also move axially with respect to the flapper valve 654 when the pressure drop across the flow nozzle 656 exceeds a set limit due to a gas kick.

In another aspect, the BHA may include a subsurface pump for enhancing cuttings removal in the reverse flow direction by boosting the pressure of the drilling fluid when it reaches the BHA, thereby keeping the drilling fluid flowing at a high flow rate. FIGS. 22–30 depict one embodiment of a pumping assembly 700 comprising a single positive displacement pump, such as a moineau pump 712, driven by an electric motor 716 that may be employed for cuttings removal in the reverse flow direction when drilling has ceased. Preferably the motor 716 has a variable speed drive to enable flow rate control through the pump 712. This allows the speed of the motor 716 to be controlled from the surface, which in turn allows the pumping rate of the pump 712 to be controlled from the surface. The BHA includes a pump passageway 706 extending between the flowbore 322 of coiled tubing 150 and subsurface pump 712; a by-pass passageway 708 extending between the flowbore 322 of coiled tubing 150 and the drilling motor 205 (by-passing pump 712); and a branch passageway 710 communicating pump passageway 706 and ports 714 in the wall of housing 715. In more detail, the coiled tubing drill string 150 is connected at the upper end of the pump assembly 700 to a velocity sensitive check valve 650, such as the check valve of FIGS. 20 and 21. The check valve 650 is connected to a series of two, two-way valves 702, 704 biased to direct flow through passageway 708.

Two-way valves 702, 704 are located on each side of the junction 713 between pump passageway 706 and branch passageway 710. Two-way valves 702, 704 are spring biased to the positions shown in FIG. 22 to close the passageway 706 leading to the pump 712. Two-way valves 702, 704 are designed to rotate, such that when the flow rate or pressure of the fluids in passageway 706 acts against the valve 702, 704, then the valve 702, 704 will move to another position, thereby closing another passageway. One type of two-way valve is the "Dual Flapper Valve" series manufactured by Bakke Oil Tools of Norway, for example, which is available in a range of sizes. Other types of two-way valves may be equally suitable for use downhole.

Figure 22:
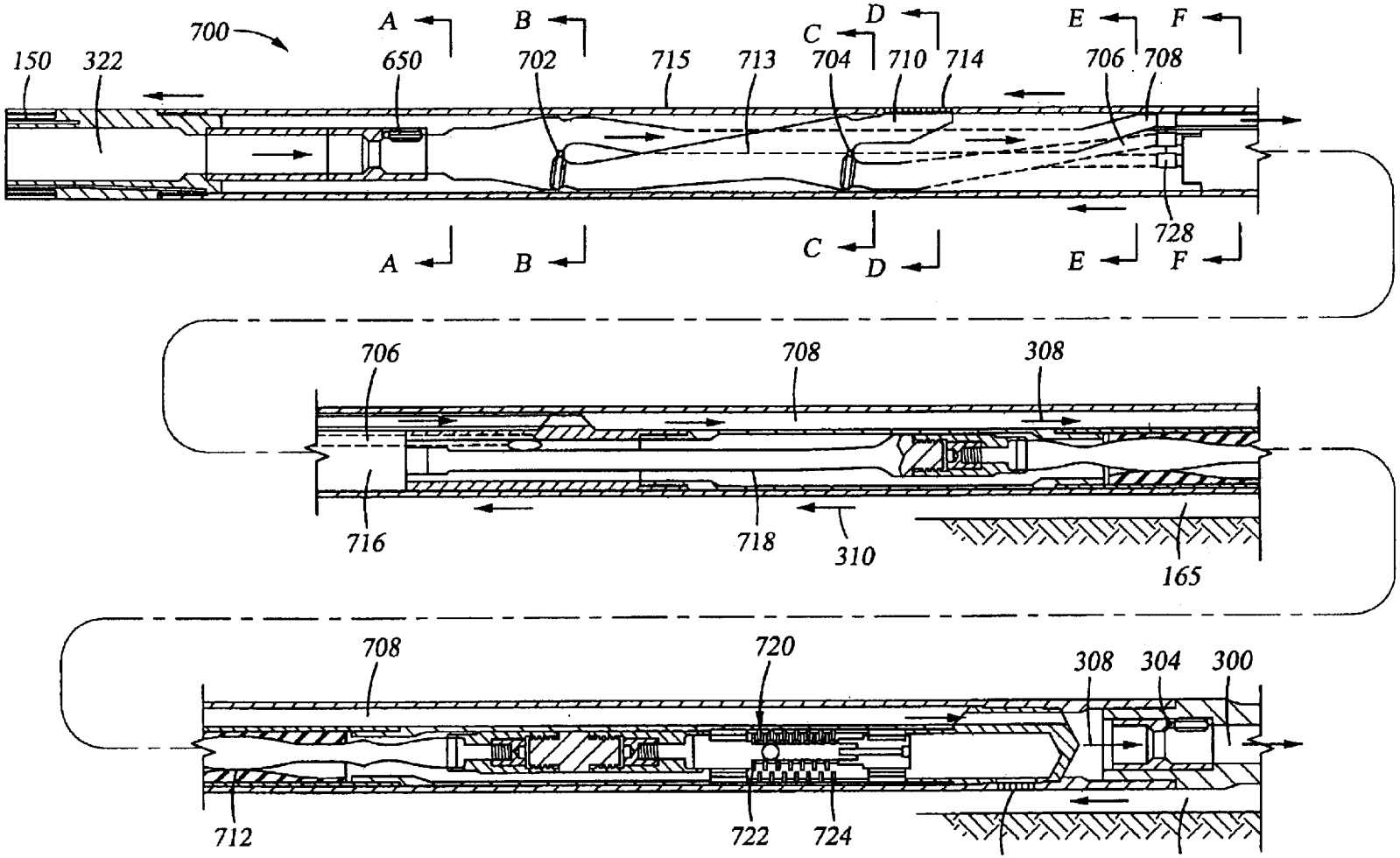
FIG. 22 depicts a cross-sectional side view of a single pump assembly operating in the standard flow direction with drilling fluid by-passing the pump.
Figure 23:
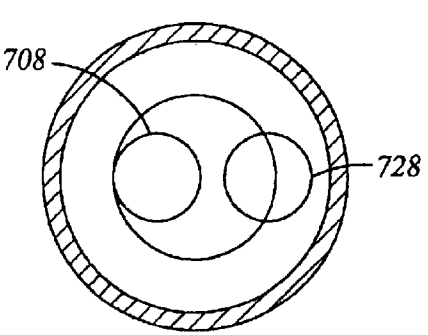
FIG. 23 depicts a cross-sectional end view taken along section A—A of FIG. 22.
Figure 24:
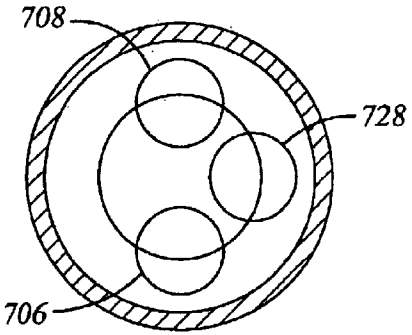
FIG. 24 depicts a cross-sectional end view taken along section B—B of FIG. 22.
Figure 25:
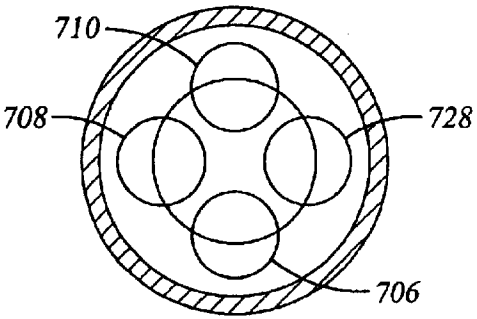
FIG. 25 depicts a cross-sectional end view taken along section C—C of FIG. 22.
Figure 26:
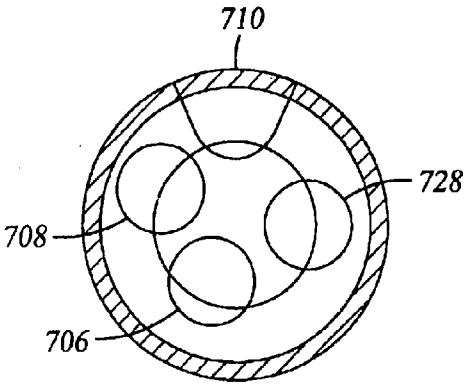
FIG. 26 depicts a cross-sectional end view taken along section D—D of FIG. 22.
Figure 27:
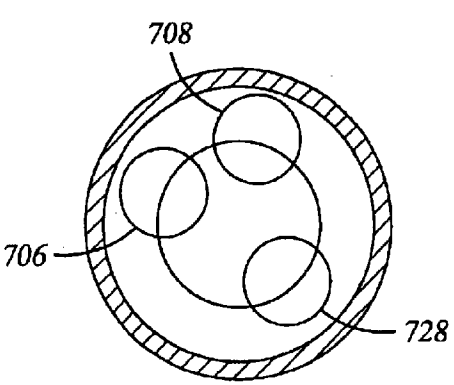
FIG. 27 depicts a cross-sectional end view taken along section E—E of FIG. 22.
Figure 28:
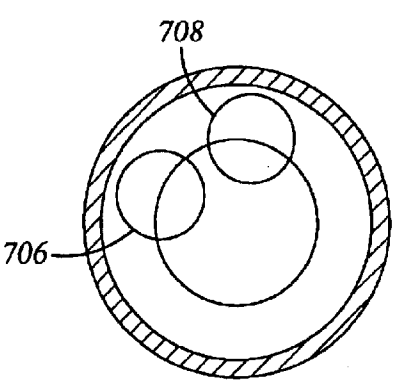
FIG. 28 depicts a cross-sectional end view taken along section F—F of FIG. 22.
Figure 29:
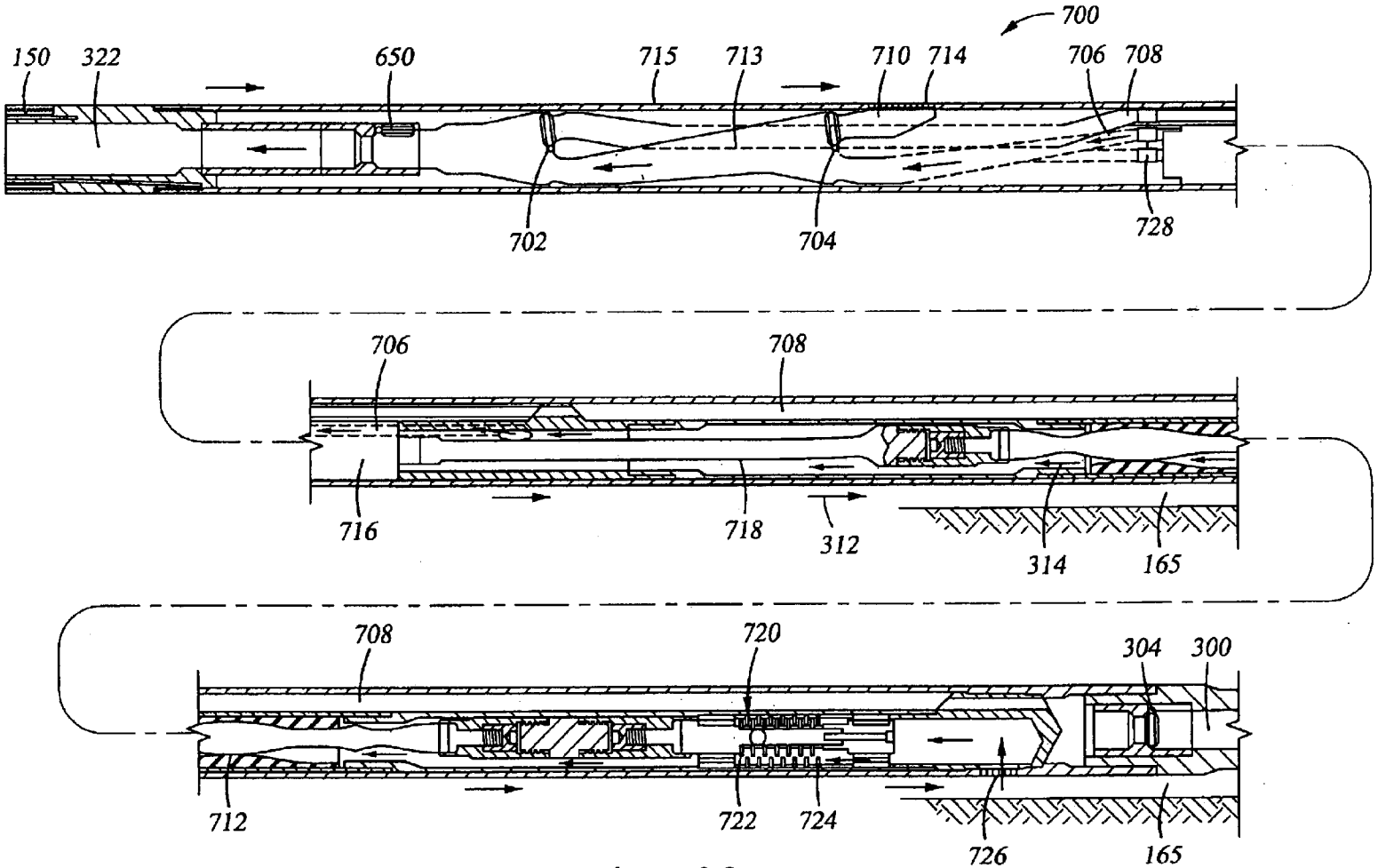
FIG. 29 depicts a cross-sectional side view of the single pump assembly of FIG. 22, operating in the reverse flow direction with the pump on and operating.
Figure 30:
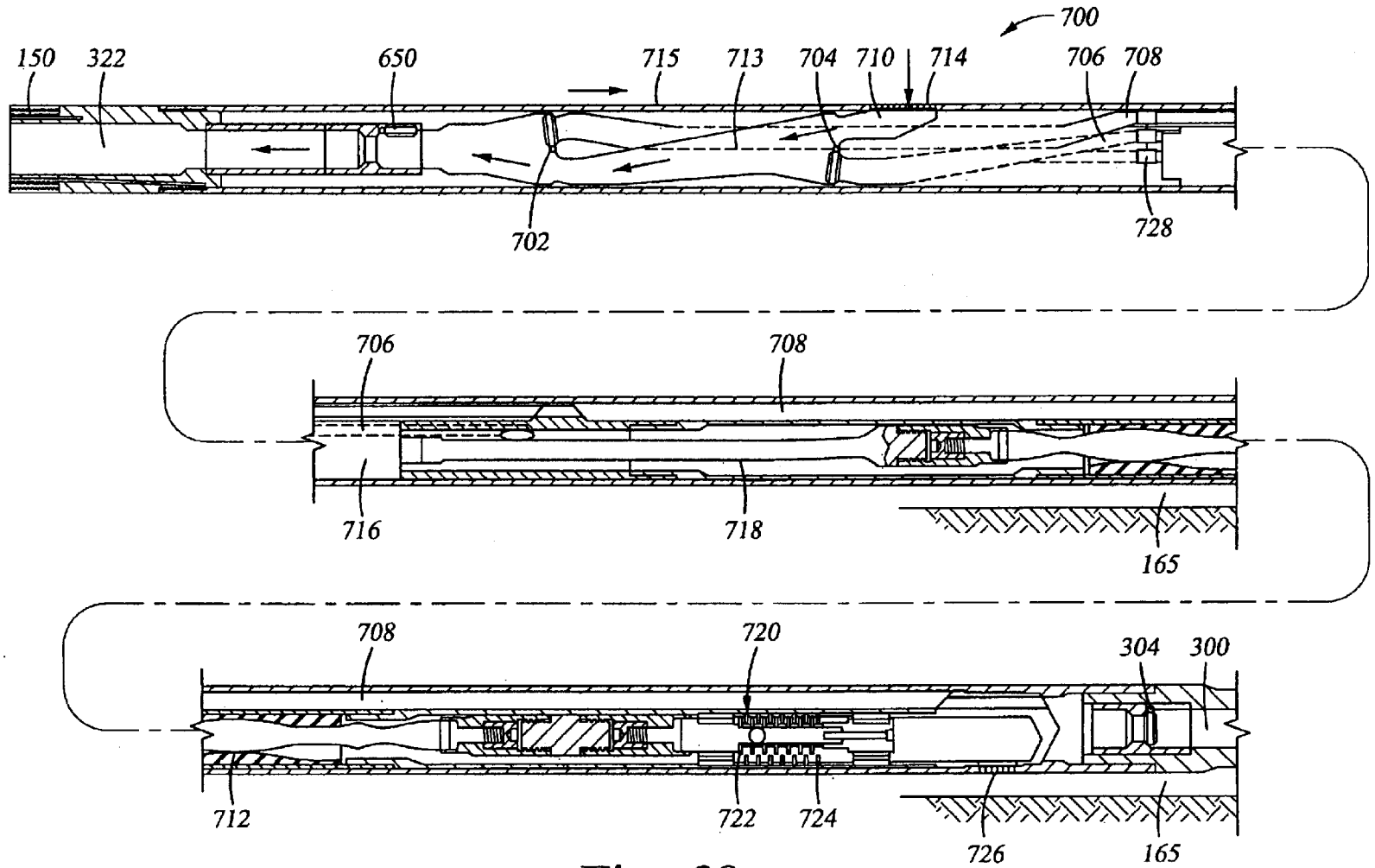
FIG. 30 depicts a cross-sectional side view of the single pump assembly of FIG. 22, operating in the reverse flow direction with the pump off.

In more detail, valve 702 operates between by-pass passageway 708 and the pump passageway 706 on the upstream side of junction 713. Valve 702 is normally biased to close pump passageway 706 and open by-pass passageway 708 as depicted in FIG. 22. However, when the pump 712 pumps fluids upstream through passageway 706 to remove the cuttings, valve 702 is rotated such that it closes by-pass passageway 708 and opens pump passageway 706 as shown in FIG. 29. Similarly, valve 704 operates between branch passageway 710 and the pump passageway 706 on the downstream side of junction 713. Valve 704 is normally biased to close pump passageway 706and open by-pass passageway 708, and all flow is directed through by-pass passageway 708 to the drilling motor 205, thereby by-passing subsurface pump 712 as shown in FIG. 22. When valve 704 opens by-pass passageway 708 and valve 702 closes by-pass passageway 706, flow is directed through ports 714 as shown in FIG. 30. Valve 702 is rotated to close by-pass passageway 708 and open pump passageway 706 by the fluid flow from ports 714 through junction 713.

FIGS. 23–28 depict cross-sectional end views taken along sections A—A through F—F of FIG. 22, respectively, of the passageways 706, 708, 710 for fluid flow as well as a conductor passageway 728 for powering the electric motor 716. Fluid ports 714 are positioned downstream of the two-way valves 702, 704.

Downstream of the pump 712, a cuttings crushing assembly 720 comprises eccentric rotating discs 722 with holes and teeth on the outside diameter of the discs 722 positioned between stationary discs 724 having holes and teeth on the inside diameter. The rotating discs 722 and the stationary discs 724 interact to crush and grind the cuttings 180 into smaller pieces before entering the pump 712. The movement of the rotating discs 722 with respect to the stationary discs 724 is such that no gaps are provided that would enable cuttings 180 to pass through without being engaged by a cutting element. The rotating discs 722 are connected to the same drive shaft 718 that drives the eccentric movement of the pump 712. As the discs 722, 724 get closer to the pump 712, they have increasingly smaller holes or passageways through them so that smaller cuttings 180 pass through to the pump 712. Downstream of the disc assembly 720 are lower fluid ports 726 in housing 715 leading to the wellbore annulus 165 The check valve 304 of the BHA 300 is provided downstream of the lower fluid ports 726 so that no cuttings can migrate into the drilling motor 205 during reverse circulation.

In operation, the pump 712 shown in FIGS. 22–30 is used during reverse flow for cuttings removal when drilling has ceased. The pump 712 provides a higher pressure for fluid that is pumped downhole and reverse flowed through the coiled tubing 150 back to the surface 10.

The two-way valves 702, 704 will be biased to open the pump passageway 706 when reverse flowing and will be biased to close the pump passageway 706 while opening the by-pass passageway 708 during drilling. The second valve 704 will close off the fluid ports 714 during reverse flow when using the pump 712 and will open the fluid ports 714 when fluid is not pumped but rather enters through the fluid ports 714 to flow up to the surface 10 through coiled tubing 150. Thus, there are three operational configurations available with assembly 700. Configuration one applies when operating in the standard flow direction during drilling. Configuration one is depicted in FIG. 22. Fluid is flowing in the standard flow direction along path 308 and the pump 712 is being bypassed so that flow is routed through the bypass passageway 708 around the pump 712 and directly into the BHA 300. After flowing through the BHA 300, the flow returns to the surface along path 310 in the annulus 165.

The second and third configurations are for reverse flow situations. Configuration two is depicted in FIG. 29. The pump 712 is being used for cuttings removal and rotated in the reverse direction. Fluid flows through wellbore annulus 165 along path 312 through the lower fluid ports 726 and upwardly through the pump 712 to the surface 10 along path 314. Configuration three is depicted in FIG. 30 and applies when reverse flow takes place without utilizing the pump 712 such that fluid moves into the upper fluid ports 714. Thus, when reverse flowing, the lower fluid ports 726 are used only when the pump 712 is also being used, and the upper fluid ports 714 are closed by valve 704 in that situation. However, the upper fluid ports 714 are open if the downhole pump 712 is not used, and the surface pumps 132 are being used for reverse flow.

Operating the pump 712 during reverse flow, as depicted in FIG. 29, is advantageous for many reasons. First, during reverse flow, the dynamic pressure of the drilling fluid introduced by the surface pumps drops as the fluid flows downwardly through the wellbore annulus 165, whereas the formation pressure increases with depth. By using the pump 712 during reverse flow, a pressure balance can be maintained between the wellbore annulus 165 and the formation pressure so as to prevent formation fluids from flowing into the drilling fluid in the wellbore annulus 165, or vice versa. Further, because the pump 712 increases the pressure of the fluid when it reaches the BHA 700 to flow upwardly through the coiled tubing 150, less pressure is required at the surface since the surface pumps 132 only have to push the drilling fluid 176 down the wellbore annulus 165. In addition, the overbalance pressure at the bottom of the wellbore annulus 165 can be maintained by controlling the speed of the surface pumps 132 and the speed of the downhole pump 712. In particular, three pressures may be monitored: the pressure of the drilling fluid 176 exiting the surface pumps 132, the pressure of the drilling fluid 176 at the bottom of the wellbore annulus 165, and the pressure of the drilling fluid 176 as it exits the downhole pump 712 to flow upwardly through the coiled tubing flow bore 322. By monitoring these three pressures, the pressure drop ratios can be determined for each flow rate at the desired set of operating pressures, and a relatively constant pressure drop ratio can be maintained using the surface pumps 132 and the downhole pump 712 for normal operations.

The benefits of using the downhole pump 712 for cuttings removal during reverse flow can further be explained by way of example. For exemplary purposes, the coiled tubing 150 has an outer diameter of 3⅜ inches and the wellbore 170 being drilled has a diameter of 4¾ inches. A flow rate of 60–90 gallons per minute (GPM) is typically required to operate the mud motor 205 efficiently to rotate the bit 210 to achieve an adequate rate of penetration. However, when operating in the standard flow direction, a flow rate of 120–160 GPM is required to keep the cuttings 180 suspended in the drilling fluid 176 that flows through the annulus 165 to the surface 10. At these higher flow rates, and the surface pumps 132 outputting a pressure of 5000 psi (maximum operating pressure for the composite coiled tubing 150), only a 15,000 feet long wellbore 170 can be drilled due to the pressure drop between the surface pumps 132 and the drill bit 210. In contrast, when operating in the reverse flow direction using the downhole pump 712 for cuttings removal, only 40–50 GPM is required to flow upwardly through the coiled tubing flowbore 322 to keep the cuttings 180 suspended, while 60–90 GPM is still required to operate the mud motor 205. Thus, the annular flow rate of the drilling fluid 176 entering the lower ports 726 is 100–140 GPM, which stirs up the cuttings 180 at the entrance to the ports, and a much longer wellbore 170 can be drilled. In particular, the surface pumps 132 move the 100–140 GPM of drilling fluid into the wellbore annulus 165 rather than the coiled tubing 150, and only the pressure of the downhole pump 712 is applied to the coiled tubing 150 to move the 40–50 GPM upwardly. Therefore, a wellbore 170 of approximately 40,000 feet can be drilled.

Figure 31:
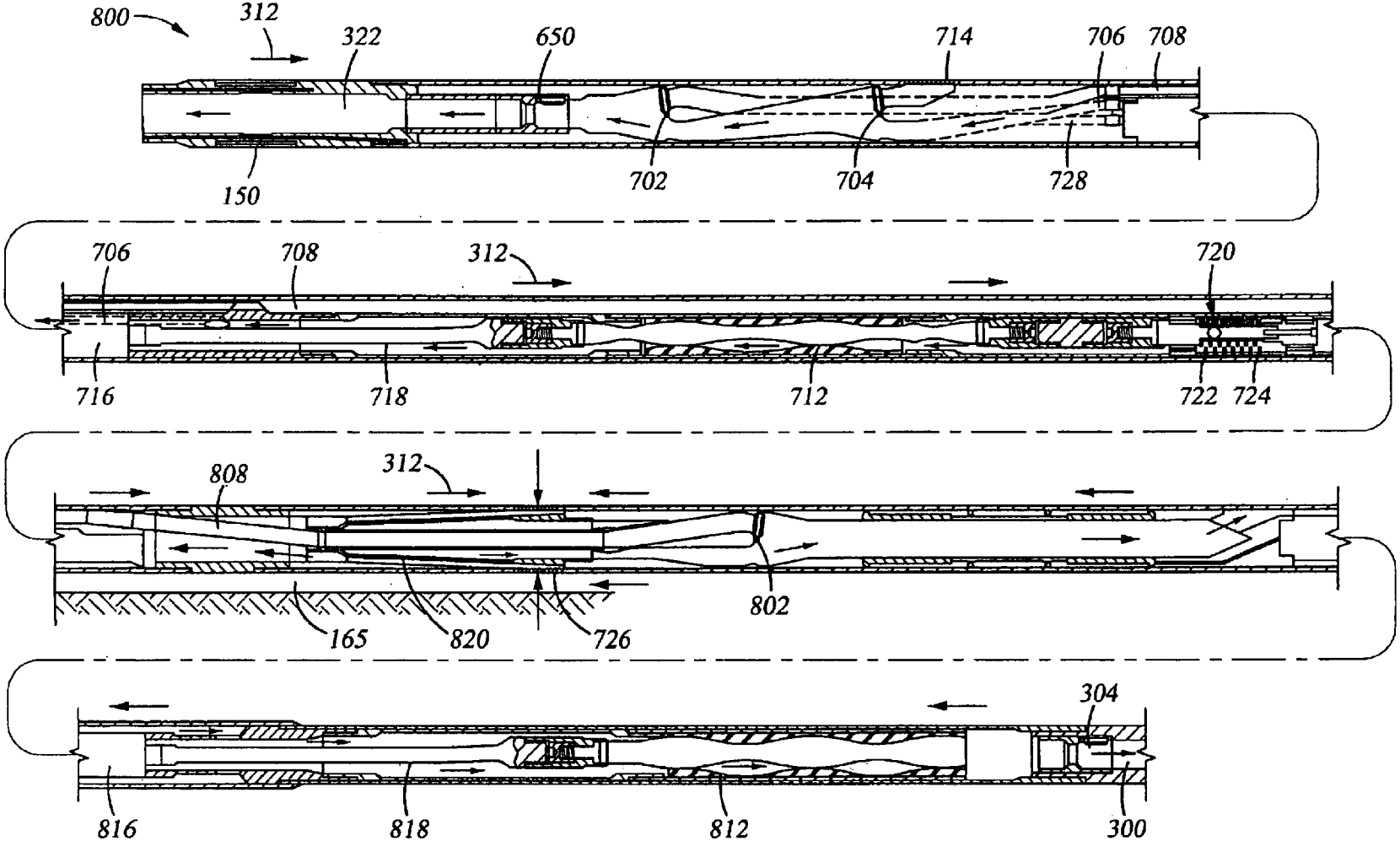
Figure 32:
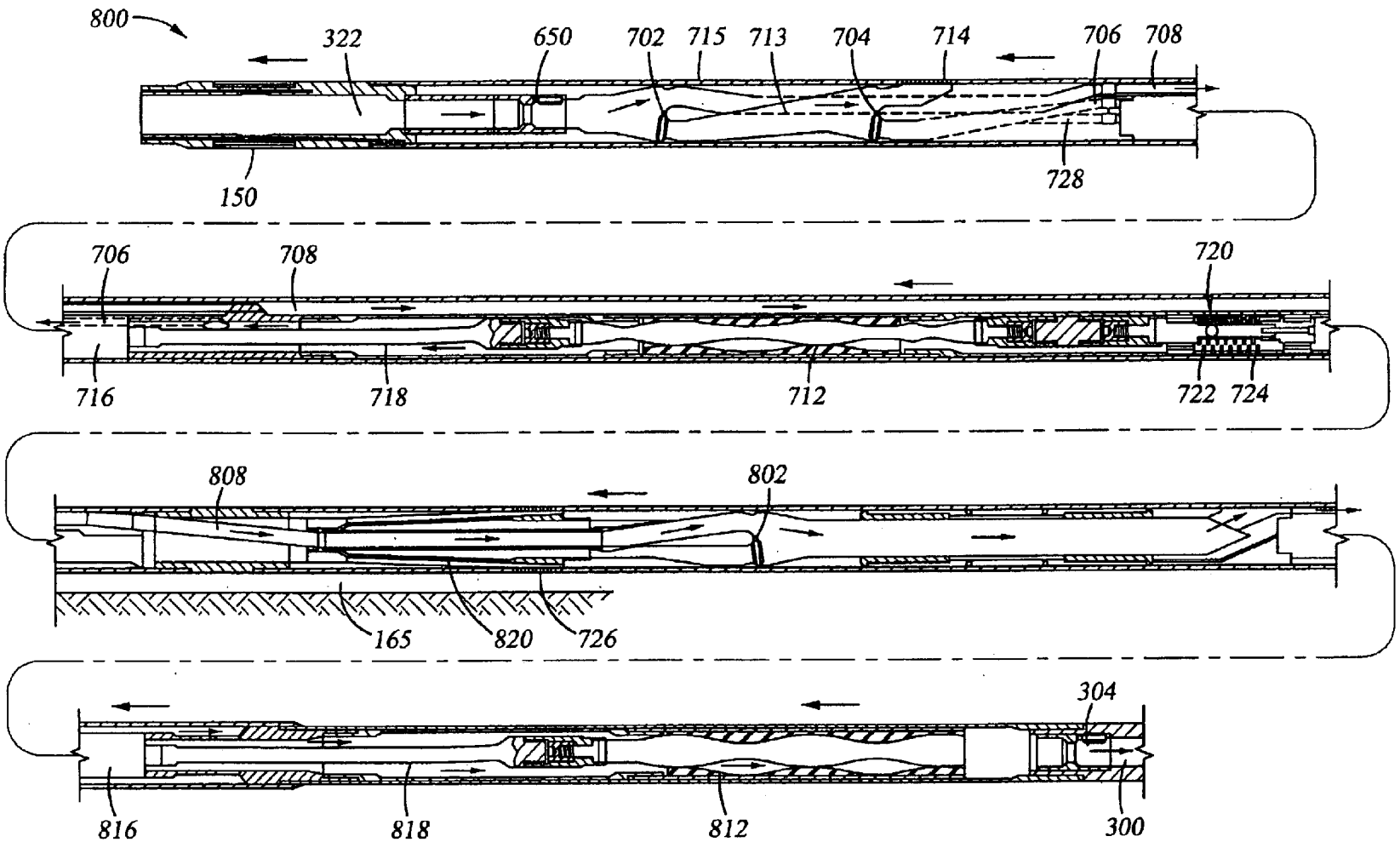
Figure 33:
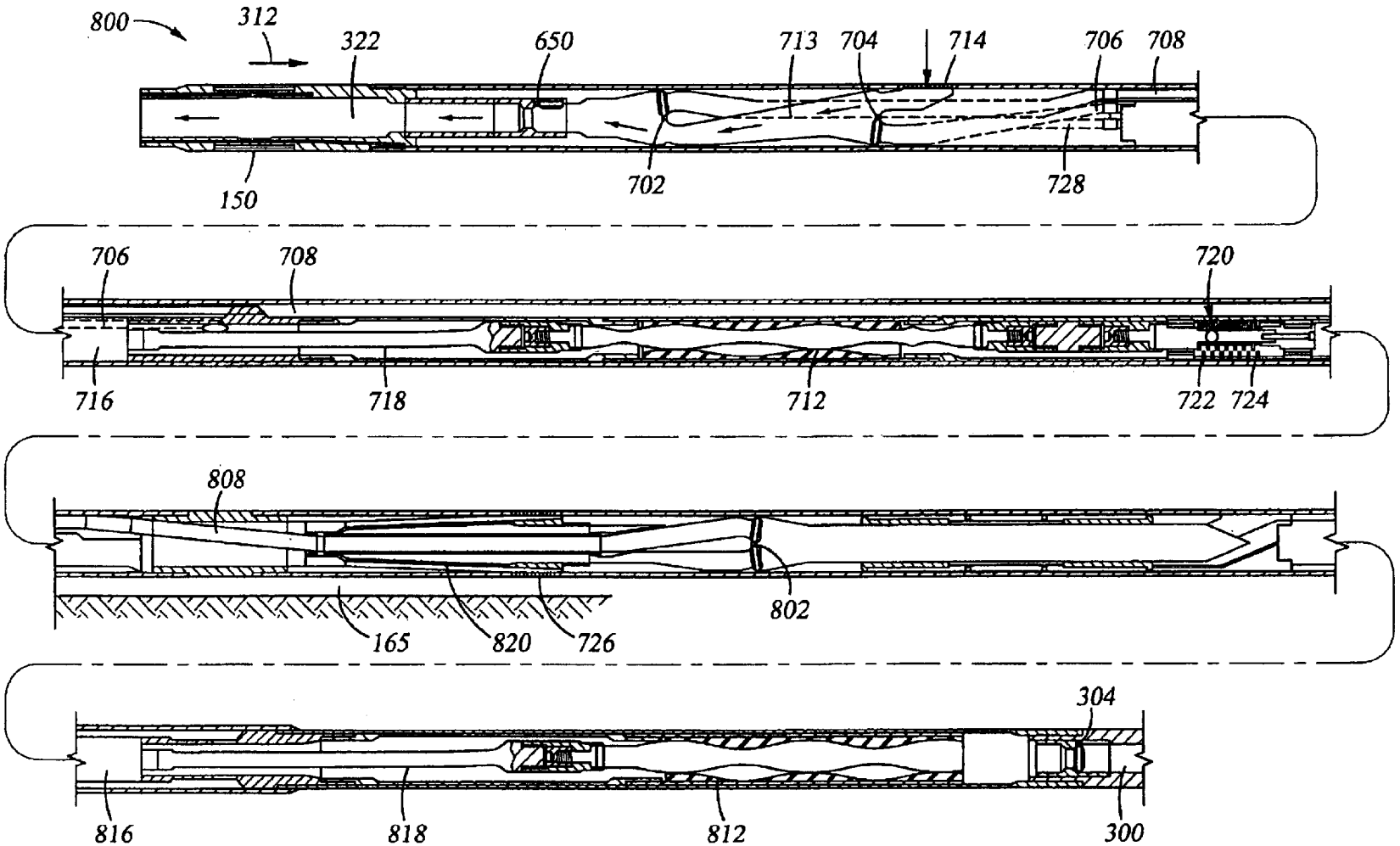
FIG. 33 depicts a cross-sectional side view of the two pump assembly of FIG. 31, operating in the reverse flow direction with both pumps off.

FIGS. 31–33 depict an assembly 800 with two downhole pumps 712, 812. The lower pump 812 is used for drilling to boost the pressure of the drilling fluid that drives the BHA 300 and thereby aid in the drilling. As previously described, one limitation of using composite coiled tubing 150 during drilling is that the burst pressure rating of tubing 150 is approximately 5,000 psi. Thus, only 5,000 psi pressure can be applied by the surface pumps 132 to the drilling fluid 176 entering the coiled tubing 150 at the surface 10, thereby limiting the depth of drilling. The use of the lower booster pump 812 downhole enables the BHA to drill a much greater distance. Thus, during drilling, the pressure drops as the drilling fluid flows downwardly through the coiled tubing 150 to the BHA 300. The pump 812 enables the pressure of the drilling fluid to be boosted downhole so that the distance traversed during drilling can be doubled. The upper pump 712 is used only in the reverse flow direction for moving cuttings 180 to the surface 10. Unlike the assembly of FIGS. 22–30, which allows either standard flow for drilling or reverse flow to remove cuttings, the assembly of FIGS. 31–33 allows both drilling and cuttings removal simultaneously. As shown in FIG. 31, when drilling and removing cuttings simultaneously using both pumps 712, 812, flow is reversed to go downwardly along path 312 through the wellbore annulus 165 and in through the lower fluid ports 726 such that clean drilling fluid and fluid containing cuttings are drawn into the same ports 726. The fluid containing cuttings is moved upwardly through the coiled tubing 150 to the surface 10 and the clean fluid is moved downwardly through the lower pump 812 and into the BHA 300. Assembly 800 also may include a cuttings crushing assembly 720. Cuttings crushing assembly 720 may be driven by the electric motor 716 driving the upper pump 712.

In more detail, all of the fluid moves through the fluid ports 726 and into a cone shaped cuttings filter 820. Filter 820 includes a mesh material having openings of a predetermined size for the filtering out of certain sized cuttings suspended in the drilling fluid. The cuttings filter 820 keeps the cuttings 180 from flowing down to the BHA 300 and allows some flow upwardly into the coiled tubing 150. A majority of the filtered drilling fluid is diverted down to the BHA 300. For example, assuming 140 gallons per minute (GPMs) flow through the fluid port 726 and then through the cutting filter 820, approximately 90 GPM of clean drilling fluid will flow to the BHA 300 and approximately 50 GPM will flow upwardly through the pump 712 that carries cuttings to the surface.

The assembly of FIGS. 31–33 also enables flow without the use of the upper pump 712 should it go out of service. In particular, as shown in FIG. 32, the two-way valves 702, 704 and another two-way valve 802 below the cuttings filter 820 allows flow to be directed around the upper pump 712. Just upstream of the cuttings filter 820, a BHA flow passage 808 connects to the through passageway 708 to bypass the upper pump 712 if it is not working correctly so that drilling can continue using the lower pump 812. Thus, if the upper pump 712 is not working, then flow is directed downwardly through by-pass passageway 708 and bypass passageway 808, into the lower pump 812 to boost the drilling fluid pressure before flowing into the BHA 300.

FIG. 33 depicts removing cuttings above the pumps 712, 812 with reverse flow and both pumps 712, 812 off. When pump 712 is not used for reverse circulating, flow enters upper fluid ports 714 and travels upwardly through the coiled tubing 150 to the surface 10.

Figure 34:
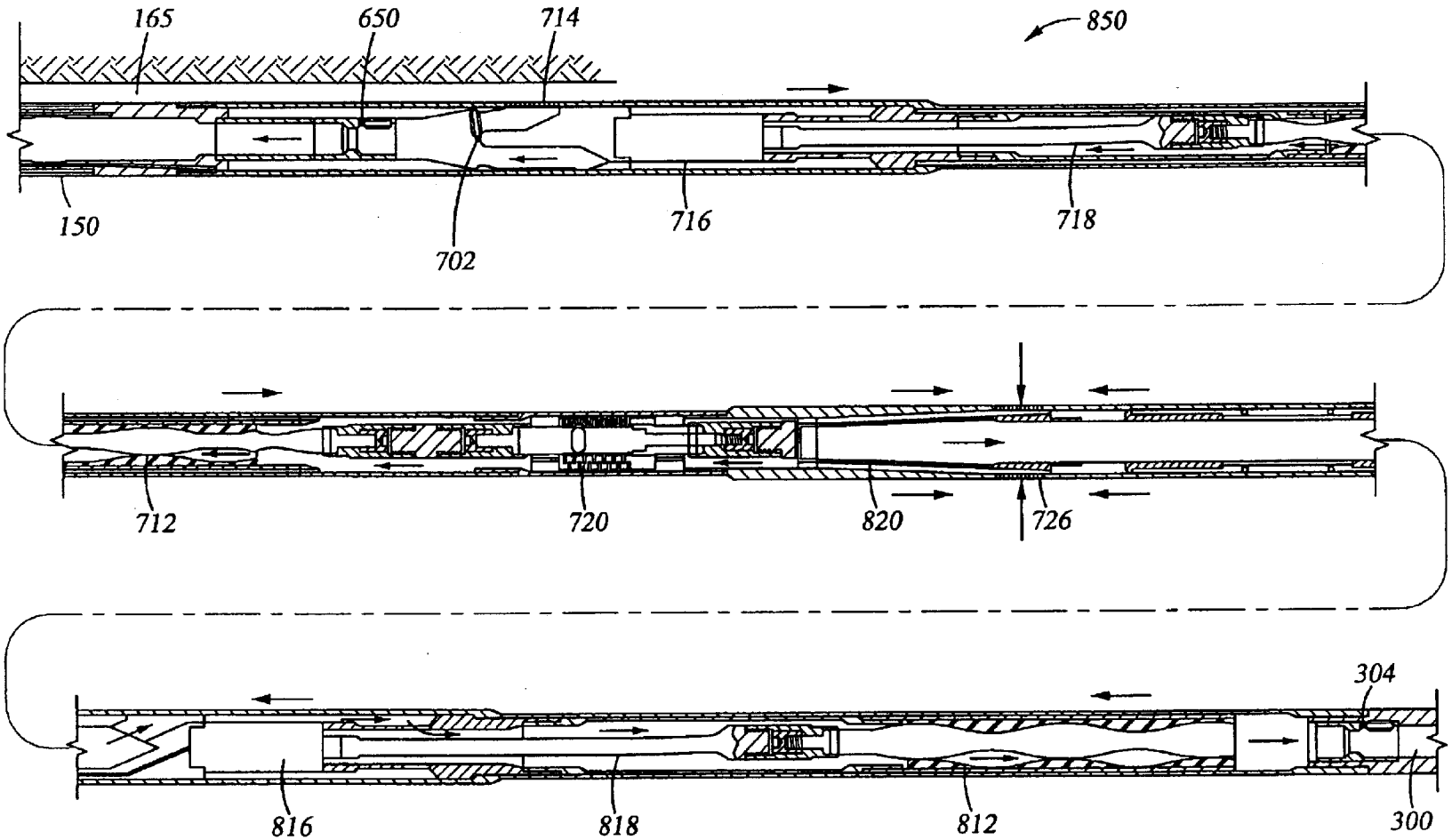
FIG. 34 depicts a cross-sectional side view of another embodiment of a two pump assembly with both pumps operating.
Figure 35:
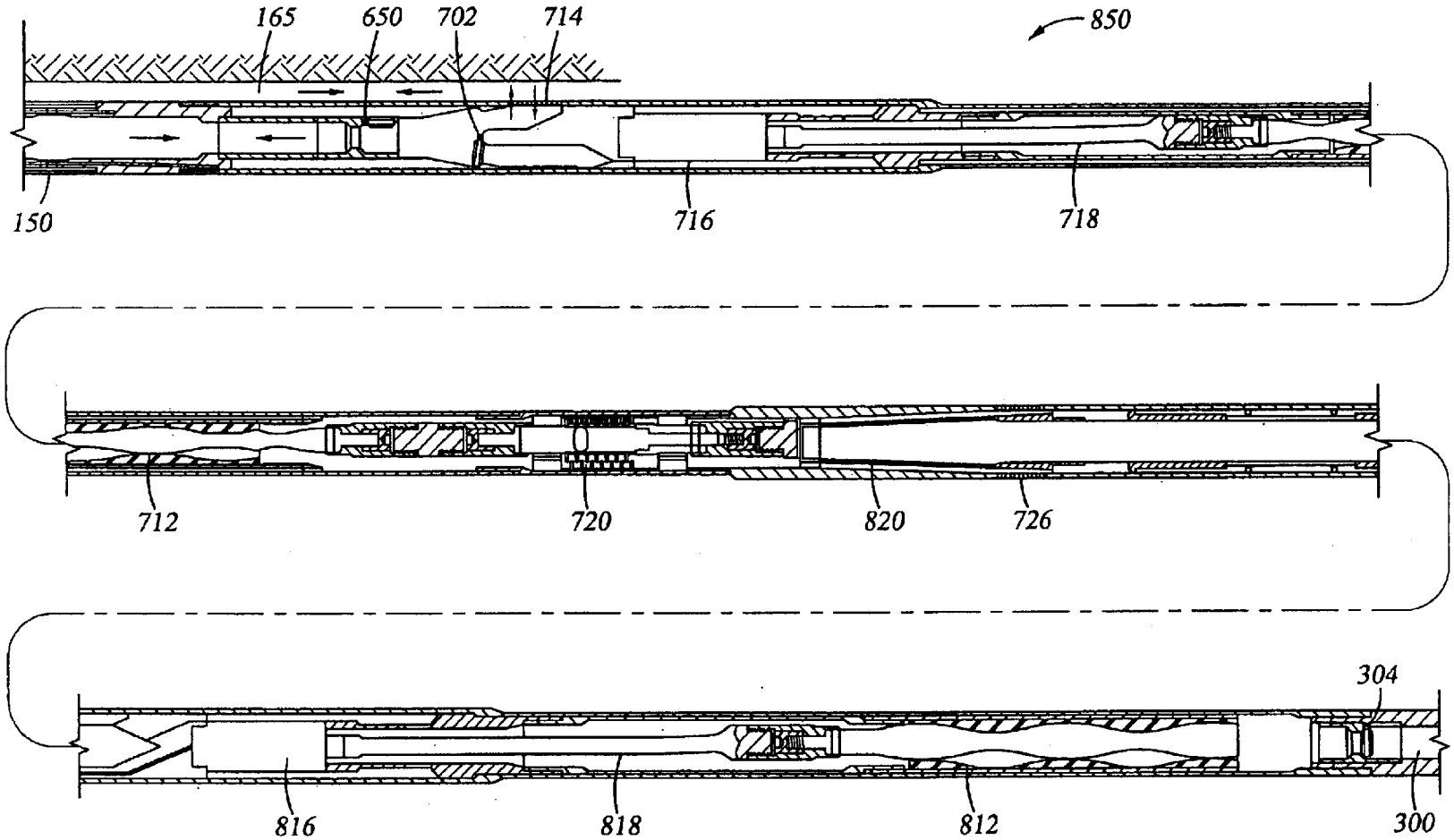
FIG. 35 depicts a cross-sectional side view of the two pump assembly of FIG. 34 having a cuttings crushing assembly and operating in the reverse flow direction with both pumps off.

FIGS. 34–35 provides a simplified embodiment 850 of the assembly 800 of FIGS. 31–33 with less valving for bypassing pumps 712, 812. In particular, only a single two-way valve 702 is provided. Thus, if the upper pump 712 is not operational, then it would not be possible to drill and reverse circulate at the same time. FIG. 34 depicts the assembly 850 while drilling and reverse circulating, with both pumps 712, 812 on. FIG. 35 depicts removing cuttings in either the standard flow direction or the reverse flow direction, with both pumps 712, 812 off and using only the surface pumps 132.

Figure 36:
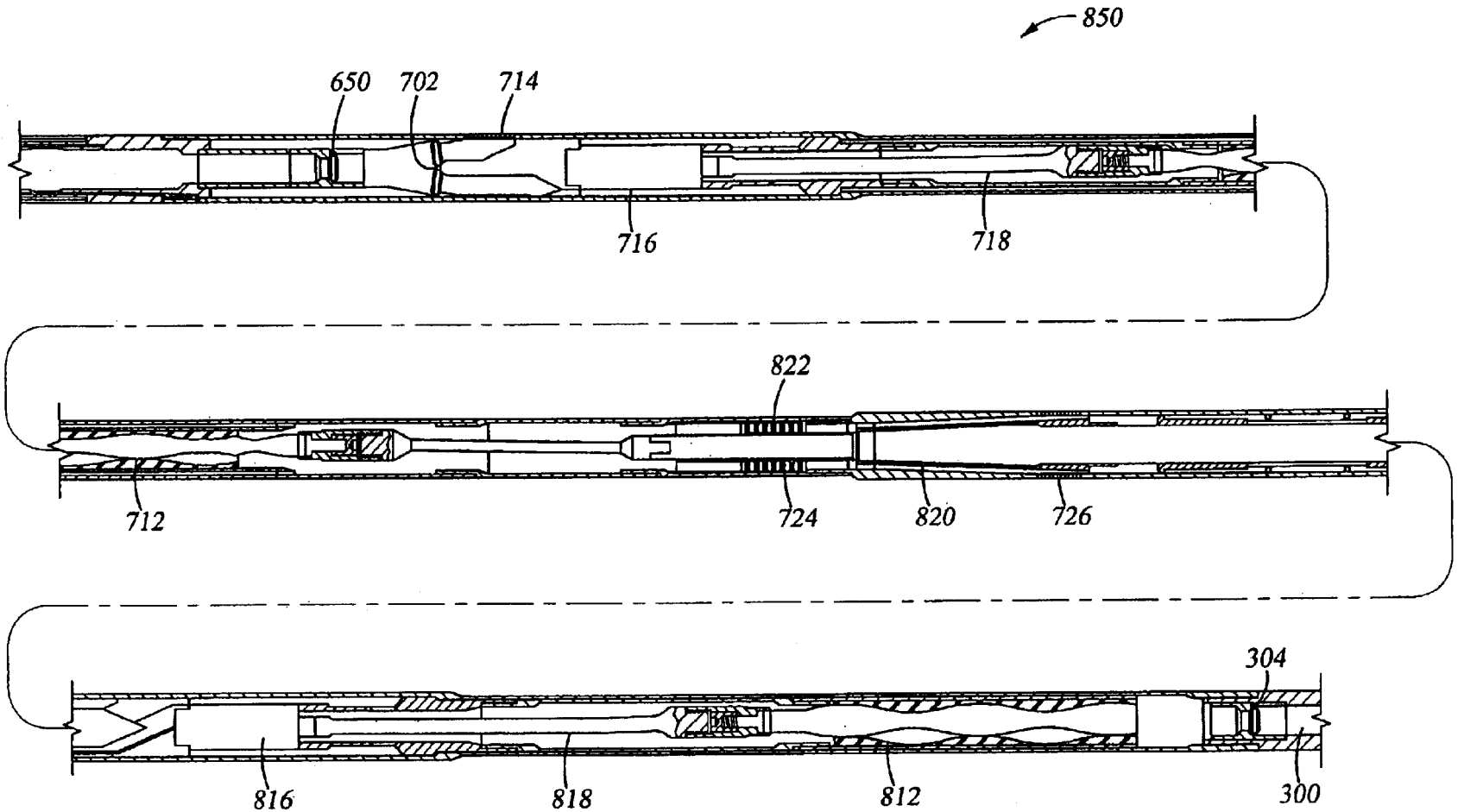
FIG. 36 depicts a cross-sectional side view of the two pump assembly of FIG. 34 with another embodiment of a cuttings crushing assembly.
Figure 45A:
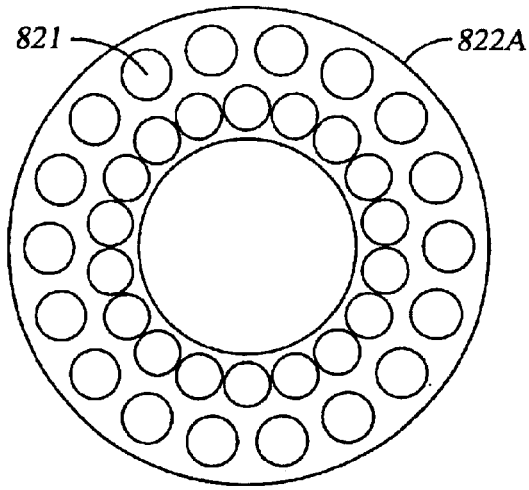
FIG. 45 depicts cross-sectional end views of three exemplary concentric rotating discs of the cuttings crushing assembly of FIG. 36.
Figure 45B:
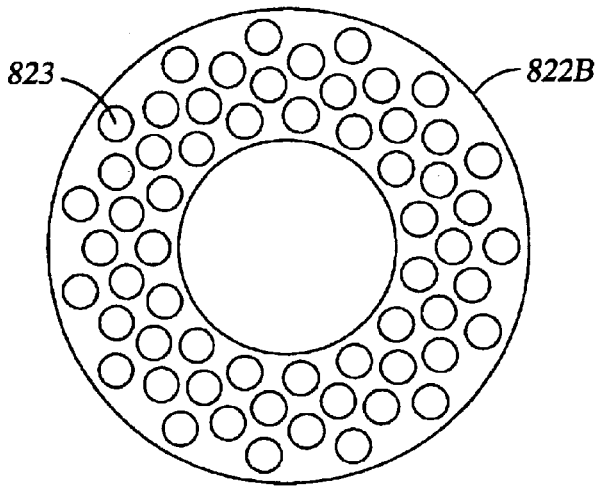
Figure 45C:
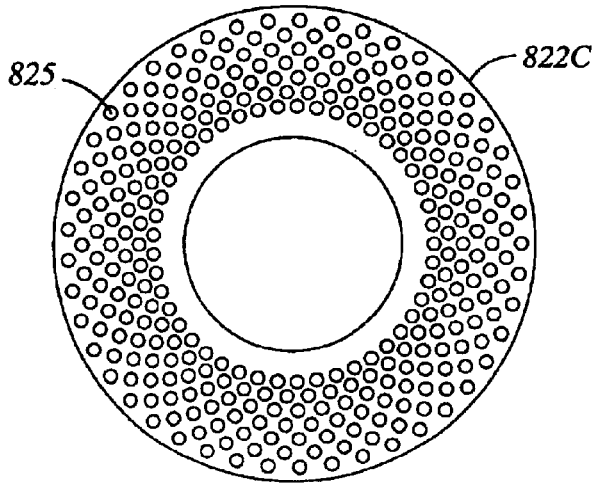

Referring now to FIG. 36, the assembly of FIGS. 34–35 is shown with an alternative embodiment of concentric rotating discs 822 that replace the eccentric rotating discs 722 for reducing the size of cuttings before they enter the upper pump 712 for reverse circulation. In more detail, FIG. 45 depicts cross-sectional end views of three exemplary concentric rotating discs 822A, 822B, 822C, each having different sized ports 821, 823, and 825, respectively. Each disc 822A, 822B, 822C is positioned between two stationary discs 724 and rotates on center with respect to the stationary discs 724. In operation, the cuttings would first flow through disc 822A, then disc 822B, then disc 822C. Therefore, the largest cuttings would flow through ports 821 as disc 822A is rotated, thereby shearing the largest cuttings into smaller cuttings. Then the sheared cuttings would flow through the ports 823 in rotating disc 822B, thereby further shearing the cuttings into even smaller cuttings. Finally, the smaller cuttings would pass through the ports 825 in the last rotating disc 822C, getting sheared once more before flowing into the pump 712.

Figure 37:
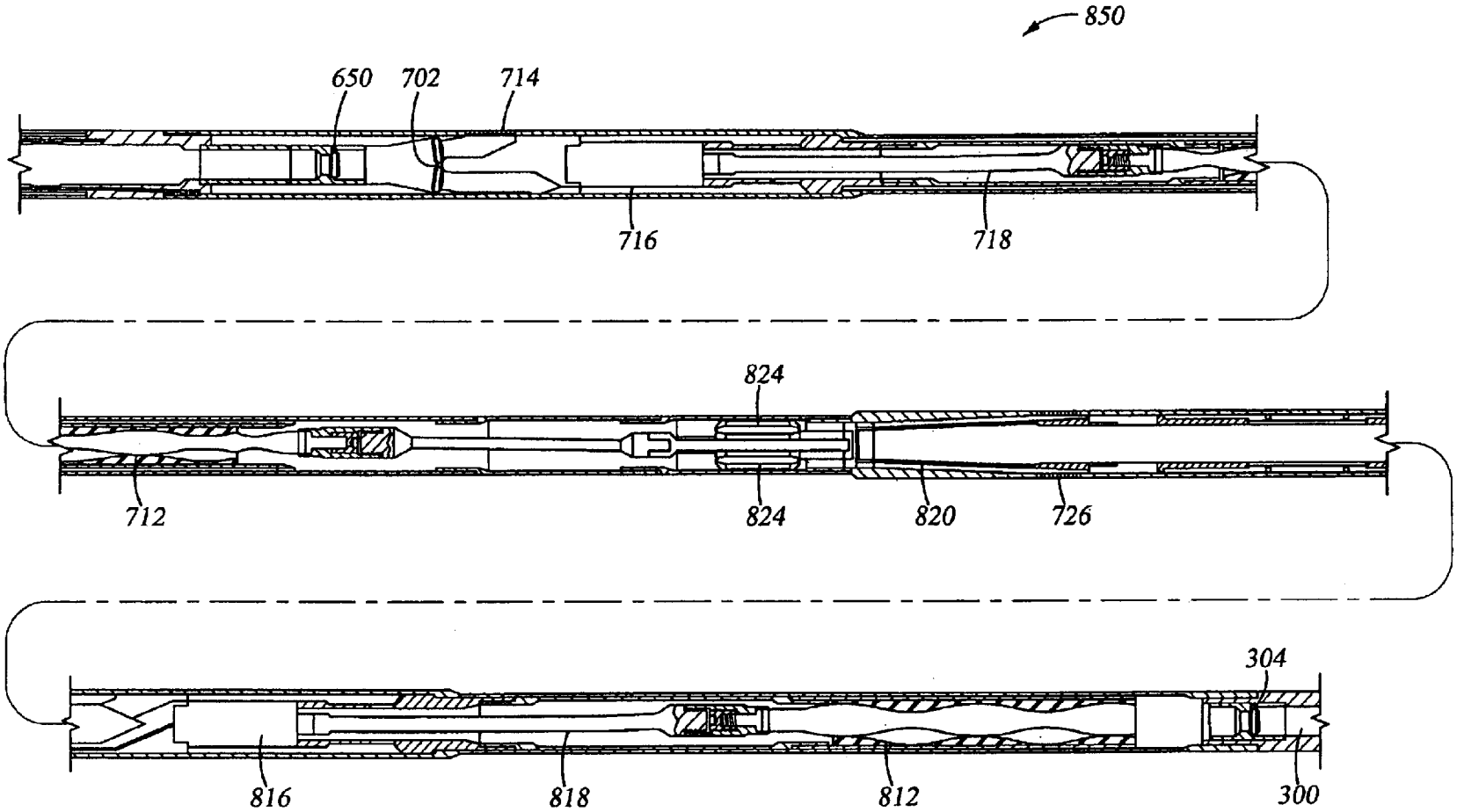
FIG. 37 depicts a cross-sectional side view of the two pump assembly of FIG. 34 with yet another embodiment of a cuttings crushing assembly.
Figure 46:
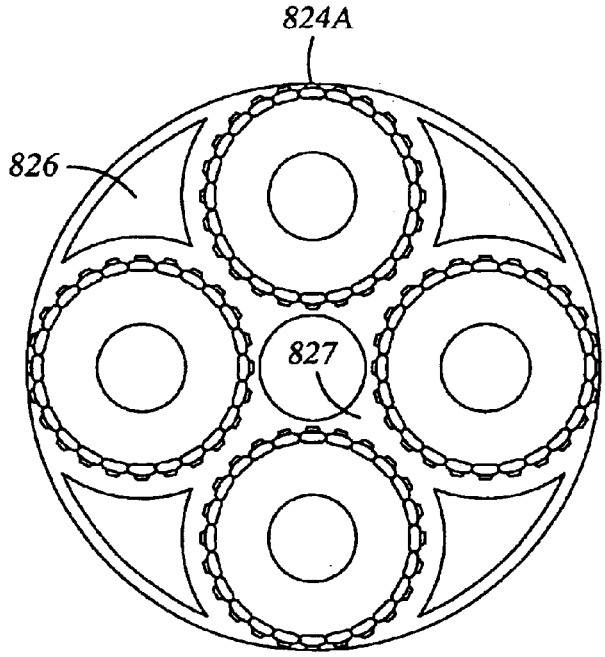
FIG. 46 depicts a cross-sectional end view of a set of large cutters of the cuttings crushing assembly of FIG. 37.
Figure 47:
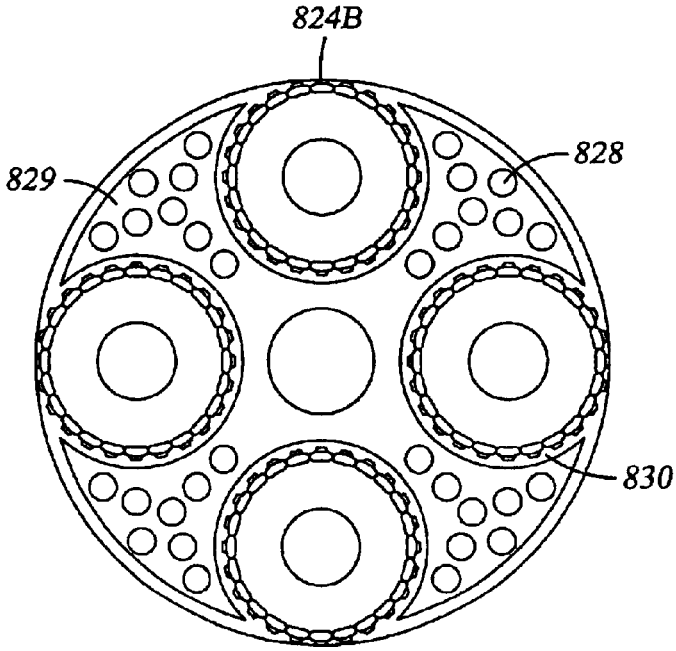
FIG. 47 depicts a cross-sectional end view of a set of small cutters of the cuttings crushing assembly of FIG. 37.

FIG. 37 depicts yet another embodiment of devices to reduce the cutting size comprising a set of cutters 824 that are positioned on a disc and that rotate relative to one another in a four point pattern. In more detail, FIGS. 46 and 47 depict cross-sectional end views of a set of large cutters 824A and a set of relatively smaller cutters 824B, respectively. The large cutters 824A are positioned on a disc 826 having spaces 827 around the cutters 824A. When fluid passes through the spaces 827 as the cutters 824A rotate relative to one another in a four-point pattern, large cuttings in the fluid are crushed as they pass therethrough. Downstream of the large cutters 824A, the relatively smaller cutters 824B are positioned on a disc 829 having small holes 828 therethrough. Spaces 830 are provided between cutters 824B and the disc 829. When fluid passes through the holes 828 and the spaces 830 as the cutters 824B rotate relative to one another in a four-point pattern, the smaller cuttings in the fluid are further crushed.

Figure 38:
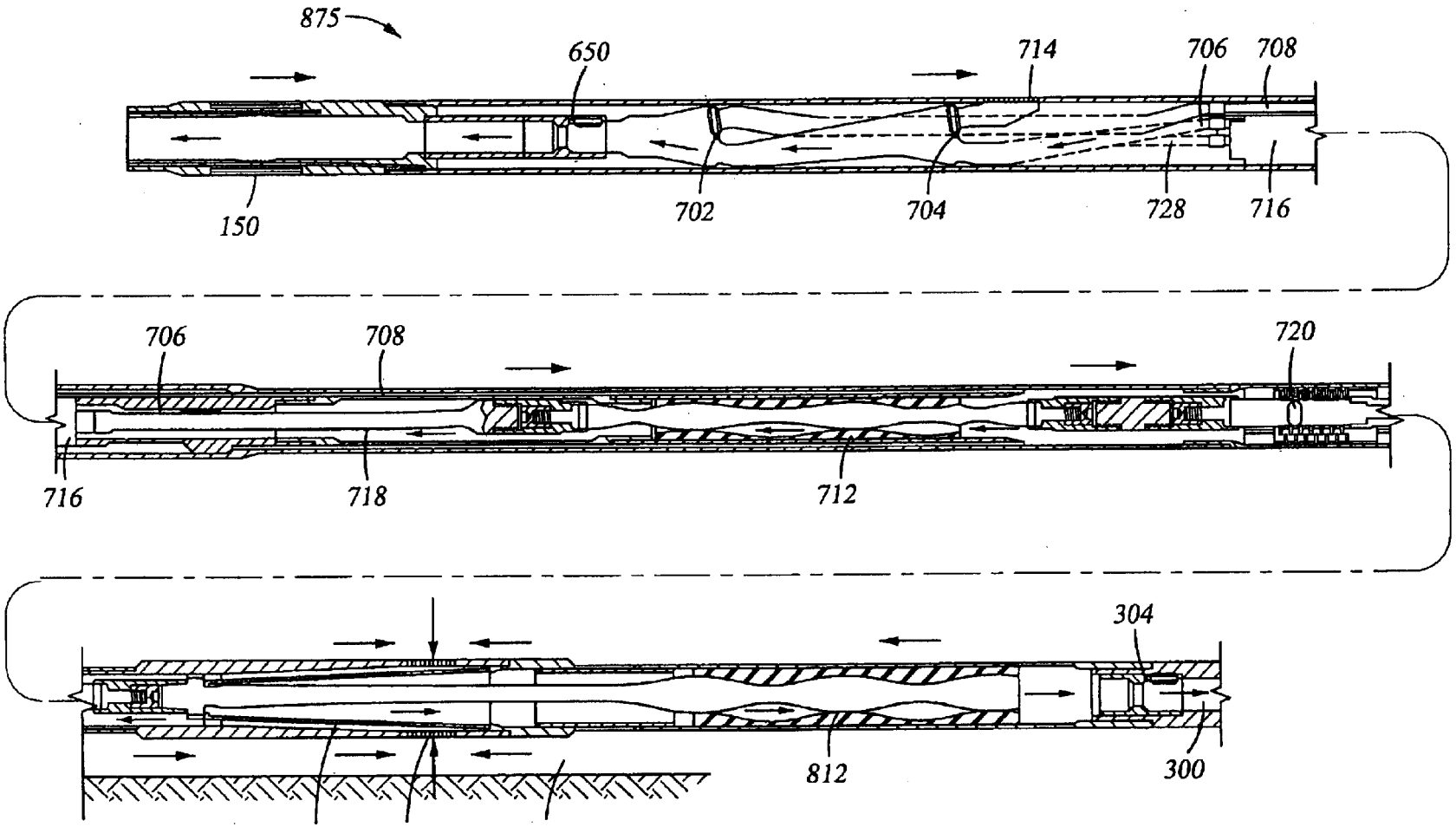
Figure 39:
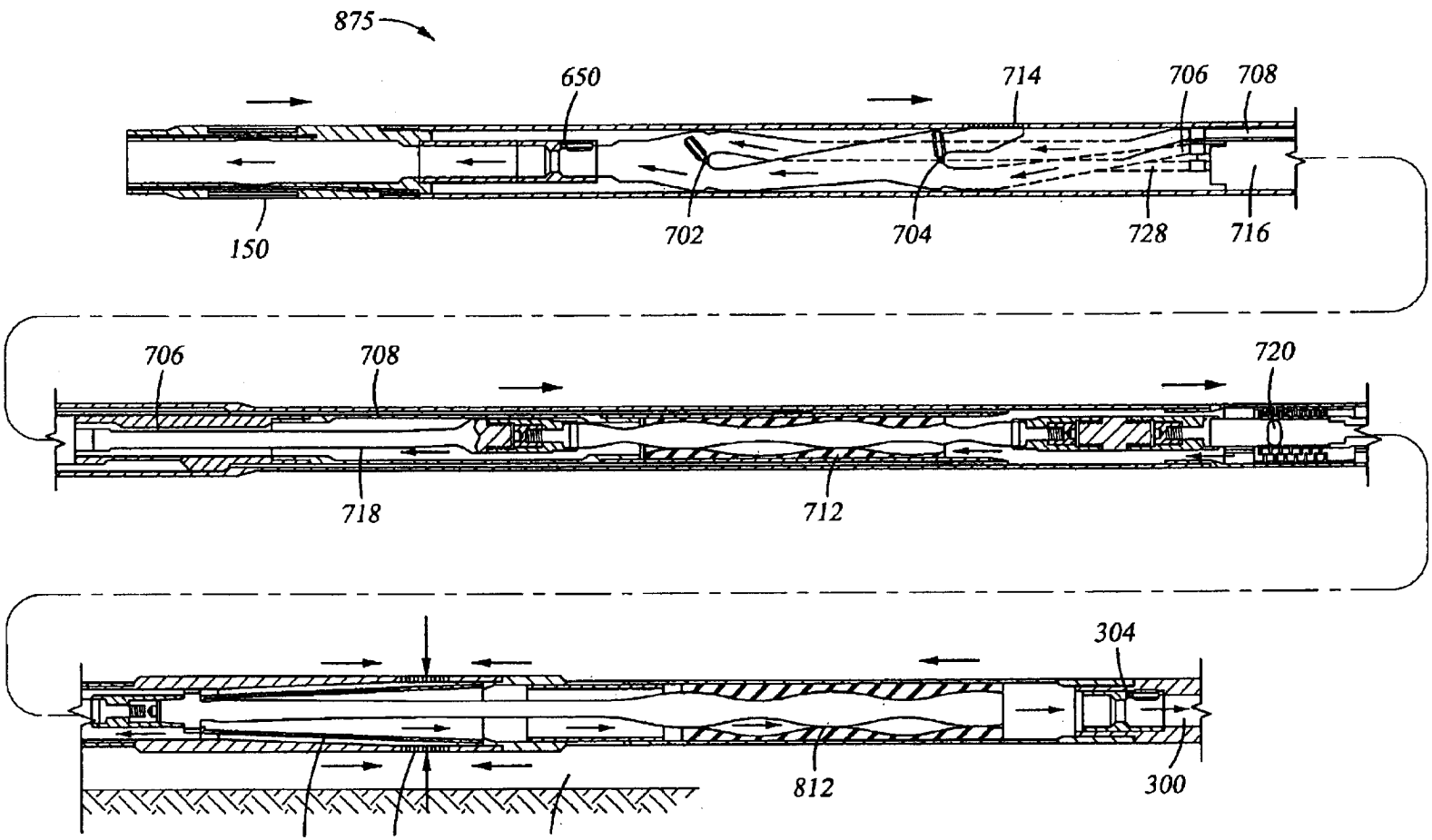
FIG. 39 depicts a cross-sectional side view of the two pump assembly of FIG. 38 with the lower pump on and the upper pump being bypassed.

Referring to FIGS. 38–39, a two pump assembly 875 is depicted except the two pumps 712, 812 are being driven by the same electric motor 716 rather than having two entirely independent pump and motor assemblies. FIG. 38 depicts drilling and reverse circulating for cuttings removal with both pumps 712, 812 on. All fluid enters through ports 726 and gets filtered by cuttings filter 820. The clean fluid then flows downwardly into pump 812, which boosts the pressure of the fluid before it enters the BHA 300 through open check valve 304. The fluid with cuttings is directed upwardly into pump 712, which rotates in the reverse direction to pump fluid upwardly to the surface 10 through the coiled tubing flowbore 322.

FIG. 39 depicts drilling with the lower pump 812 on to boost the drilling fluid pressure, and using the surface pumps 132 only to provide pressure for reverse circulation should the upper pump 712 have operational problems. Thus, drilling fluid with cuttings from the bit 210 will enter the assembly 875 through lower ports 726 with the cuttings filter 820 filtering out cuttings of a predetermined size. The clean fluid flows downwardly into the lower pump 812, which boosts the pressure of the fluid before it enters the BHA 300 through open check valve 304. The fluid with cuttings is directed upwardly, and because upper pump 712 has mechanical damage and will not hold pressure, flow will pass through the pump 712 into pump passageway 706 and also through the by-pass passageway 708 around the pump 712. Since some flow moves through pump passageway 706, but the pressure is not adequate to fully open two-way valve 702, the valve 702 may be only partially open as depicted in FIG. 39 allowing some flow through by-pass passageway 708.

Figure 40:
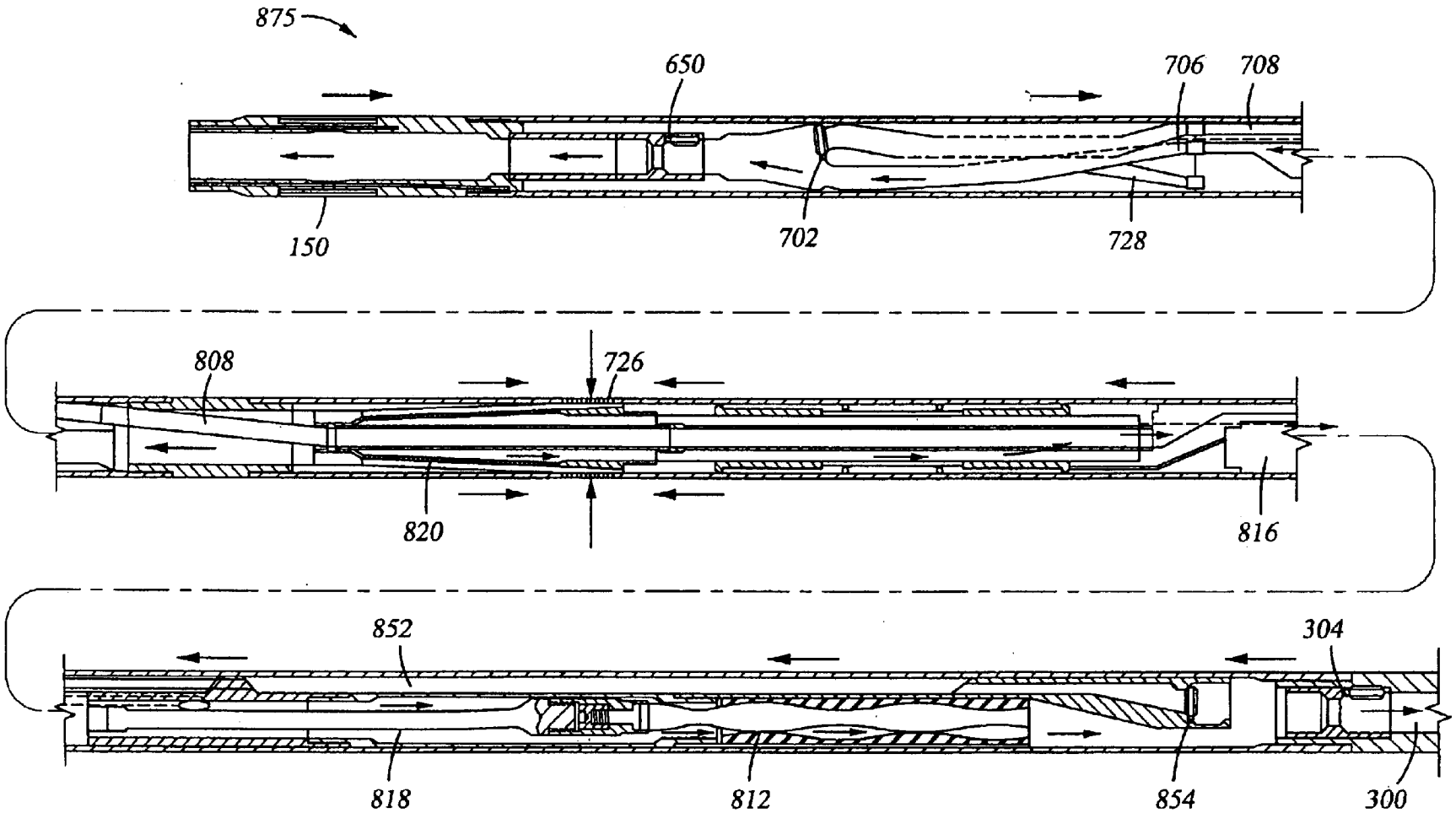
FIG. 40 depicts a cross-sectional side view of another embodiment of a one-pump assembly, with the pump on and operating.
Figure 41:
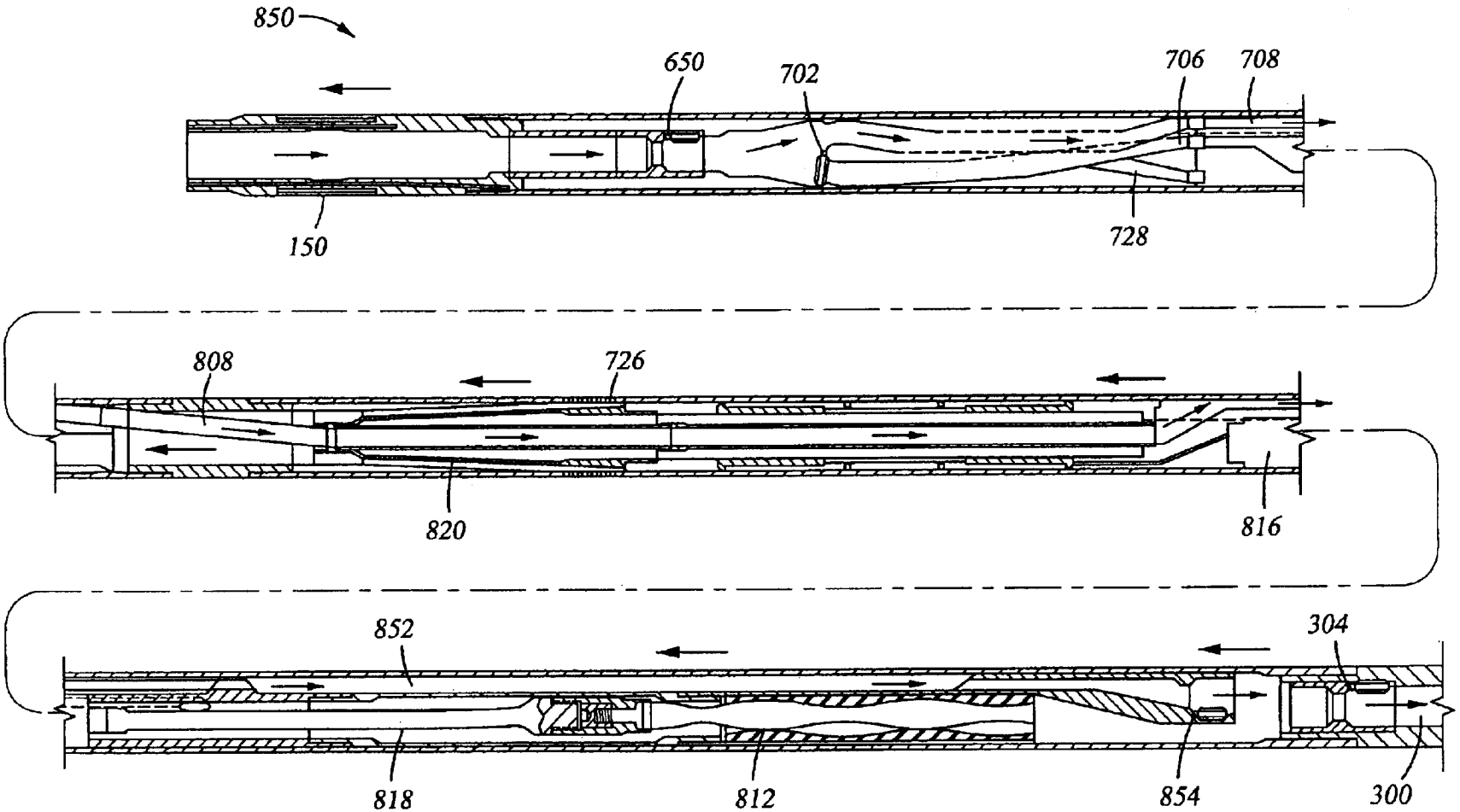
FIG. 41 depicts a cross-sectional side view of the one-pump assembly of FIG. 40, with the pump being bypassed.

FIGS. 40–41 depict the simplified assembly 850 of FIGS. 34–35 with a single downhole pump 812 for aiding drilling. A by-pass 852 is provided around the pump 812 and a check valve 854 is disposed at the lower end of the bypass passageway 852. In this configuration, the surface pump 132 is used to remove cuttings, both in the standard and reverse flow directions. FIG. 40 depicts drilling and cuttings removal with reverse flow and with the downhole pump 812 on. FIG. 41 depicts drilling and cuttings removal in the standard flow direction with the downhole pump 812 off and being bypassed through passageway 852.

Figure 42A:
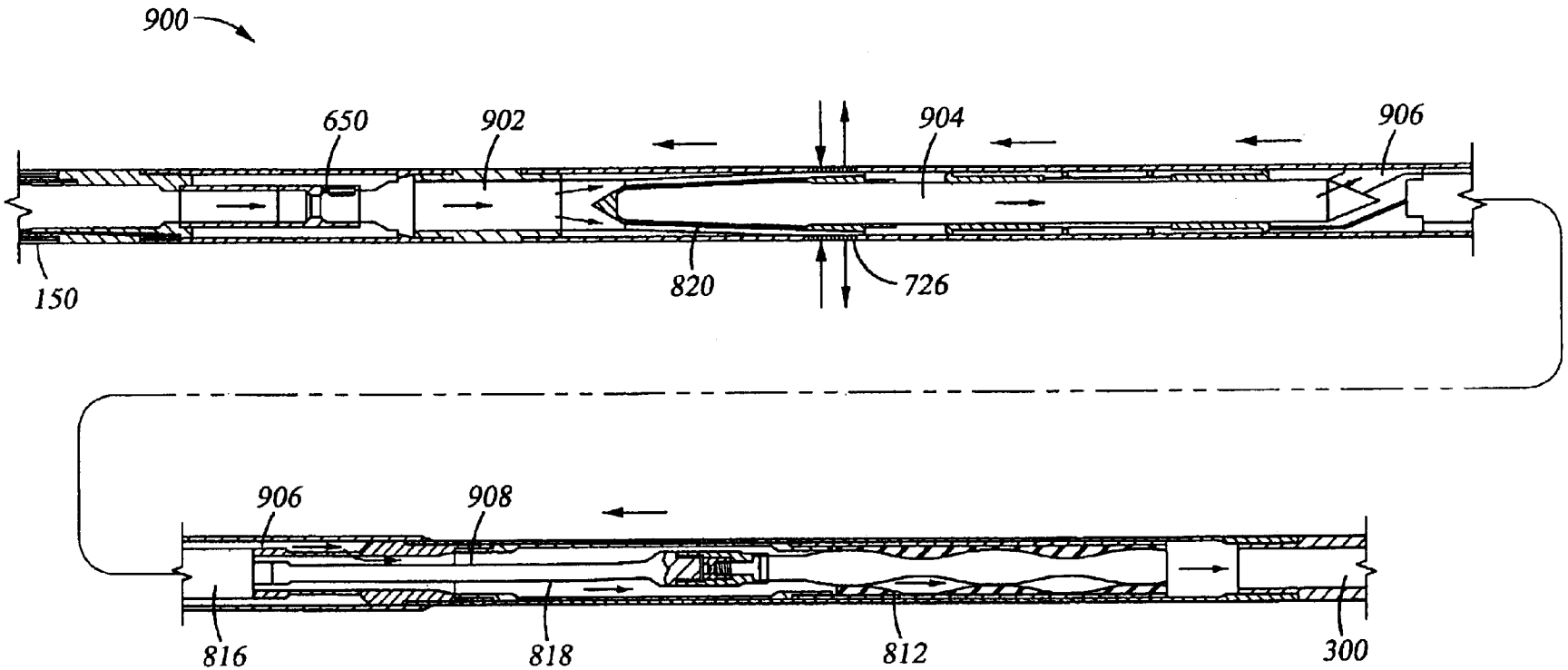
FIG. 42A depicts a cross-sectional side view of yet another embodiment of a one-pump assembly, with flow from the surface in the standard flow direction, and the pump operating to aid drilling.
Figure 42B:
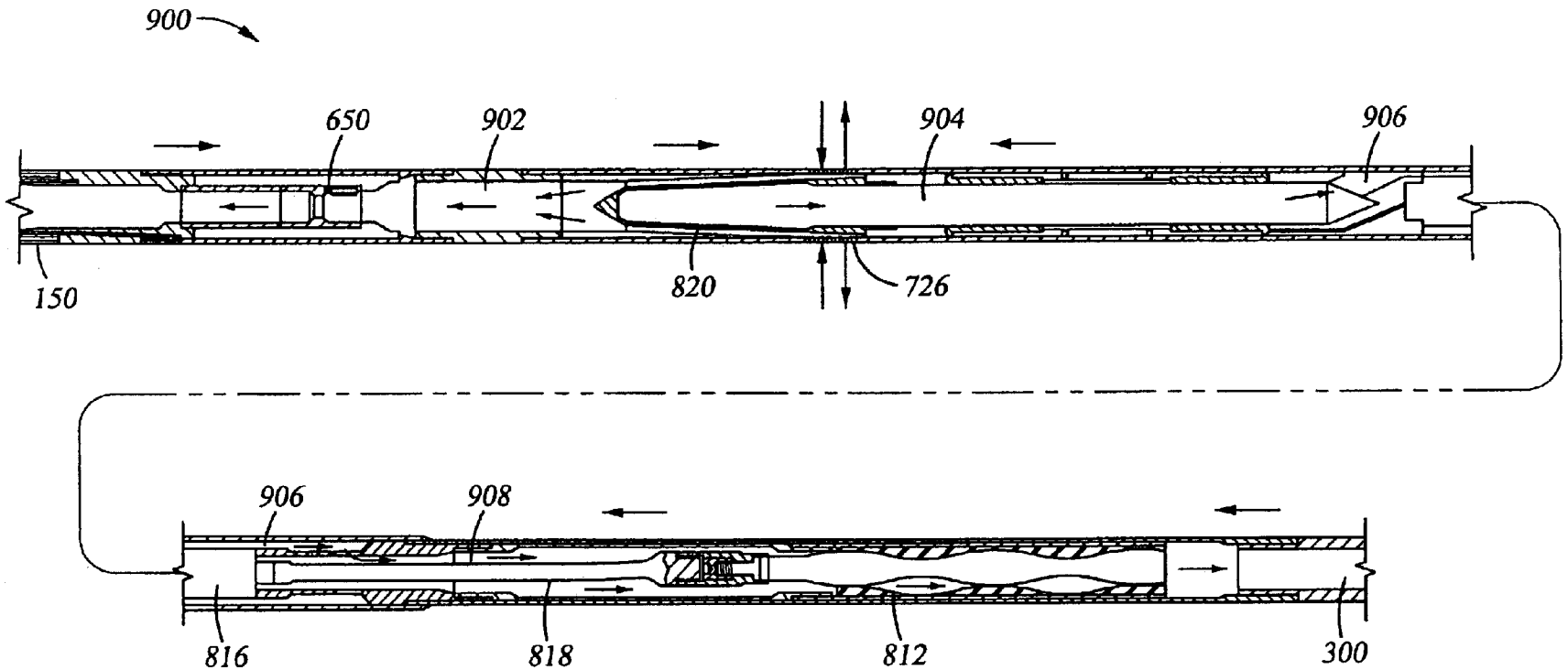
FIG. 42B depicts a cross-sectional side view of the one-pump assembly of FIG. 42A, with flow from the surface in the reverse flow direction, and the pump operating to aid drilling.

FIGS. 42A–B depict a more simplified assembly 900 with a single downhole pump 812. In this configuration, the surface pumps 132 are used to remove cuttings both in the standard and reverse flow directions when drilling is underway, and there is no check valve 304 above the BHA 300. FIGS. 42A and 42B depict simultaneous drilling and cuttings removal, with flow from the surface in either the standard or reverse flow directions, respectively, and with the downhole pump 812 operating to boost the flow rate and pressure of the drilling fluid.

In more detail, when the drilling fluid is pumped from the surface in the standard flow direction as depicted in FIG. 42A, most of the fluid flows into chamber 902, through the cuttings filter 820 and into bore 904, while some fluid flows out through ports 726 and upwardly to the surface 10 through the wellbore annulus 165. The clean fluid that continues through assembly 900 then flows through bypass 906 around the motor 816 and into annular chamber 908 before entering pump 812, which boosts the drilling fluid pressure before the fluid flows into the BHA 300. After the fluid exits the BHA 300, it flows upwardly through the annulus all the way to the surface, and some of the fluid will flow into the assembly 900 through ports 726 to be recirculated through the pump 812 and the BHA 300.

When drilling fluid is pumped from the surface in the reverse flow direction as depicted in FIG. 42B, fluid flows from the annulus into the assembly 900 through the ports 726. Some of the fluid will flow through the cuttings filter 820 and downwardly into the bore 904 to take the same flow path as previously described for the standard flow direction. However, some of the fluid will flow through the chamber 902 and upwardly to the surface through the coiled tubing 150, carrying with it the cuttings that were filtered by the cuttings filter 820.

Figure 43A:
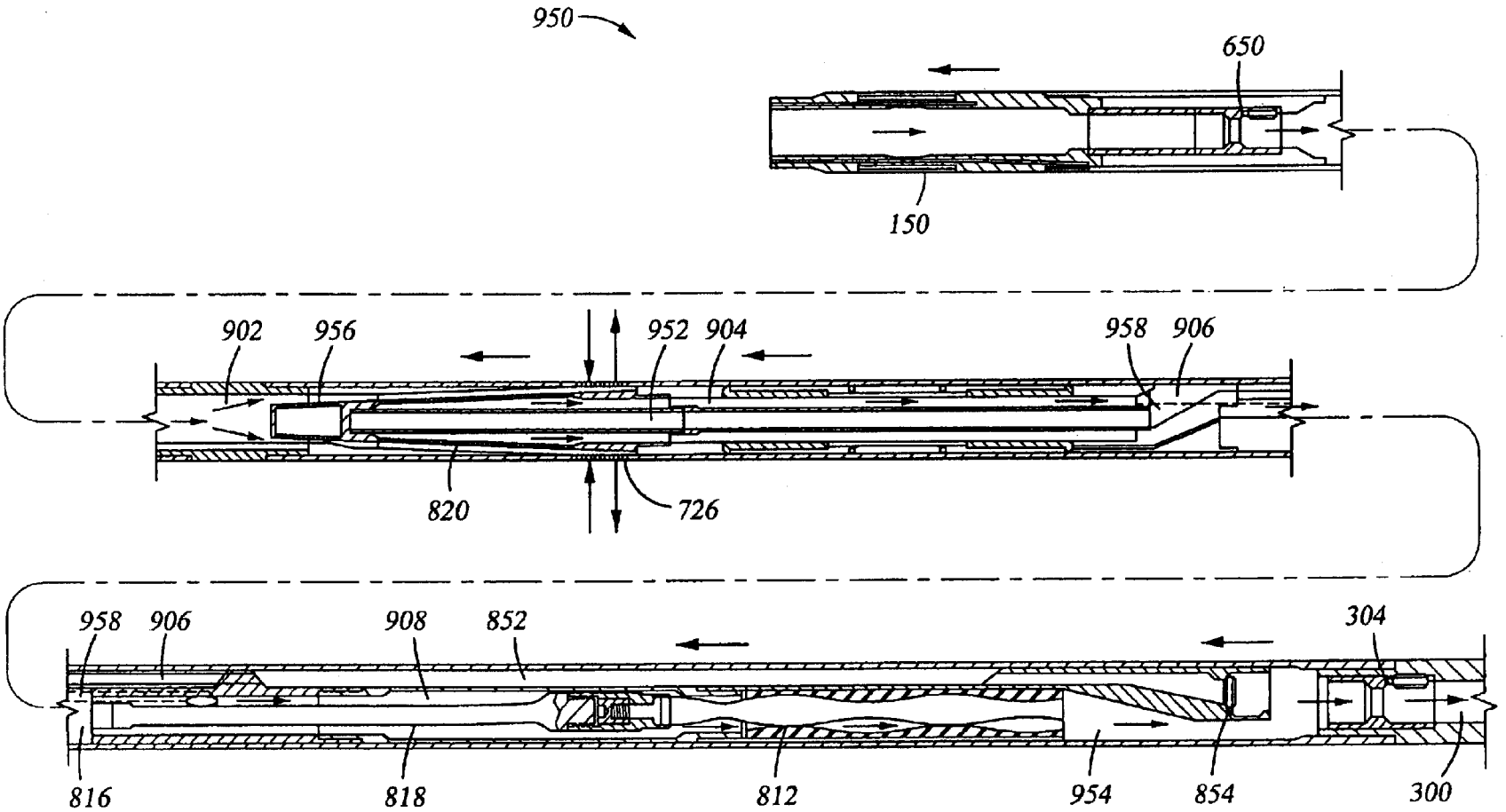
FIG. 43A depicts a cross-sectional side view of still another embodiment of a one-pump assembly, with flow from the surface in the standard flow direction, and the pump operating to aid in drilling.
Figure 43B:
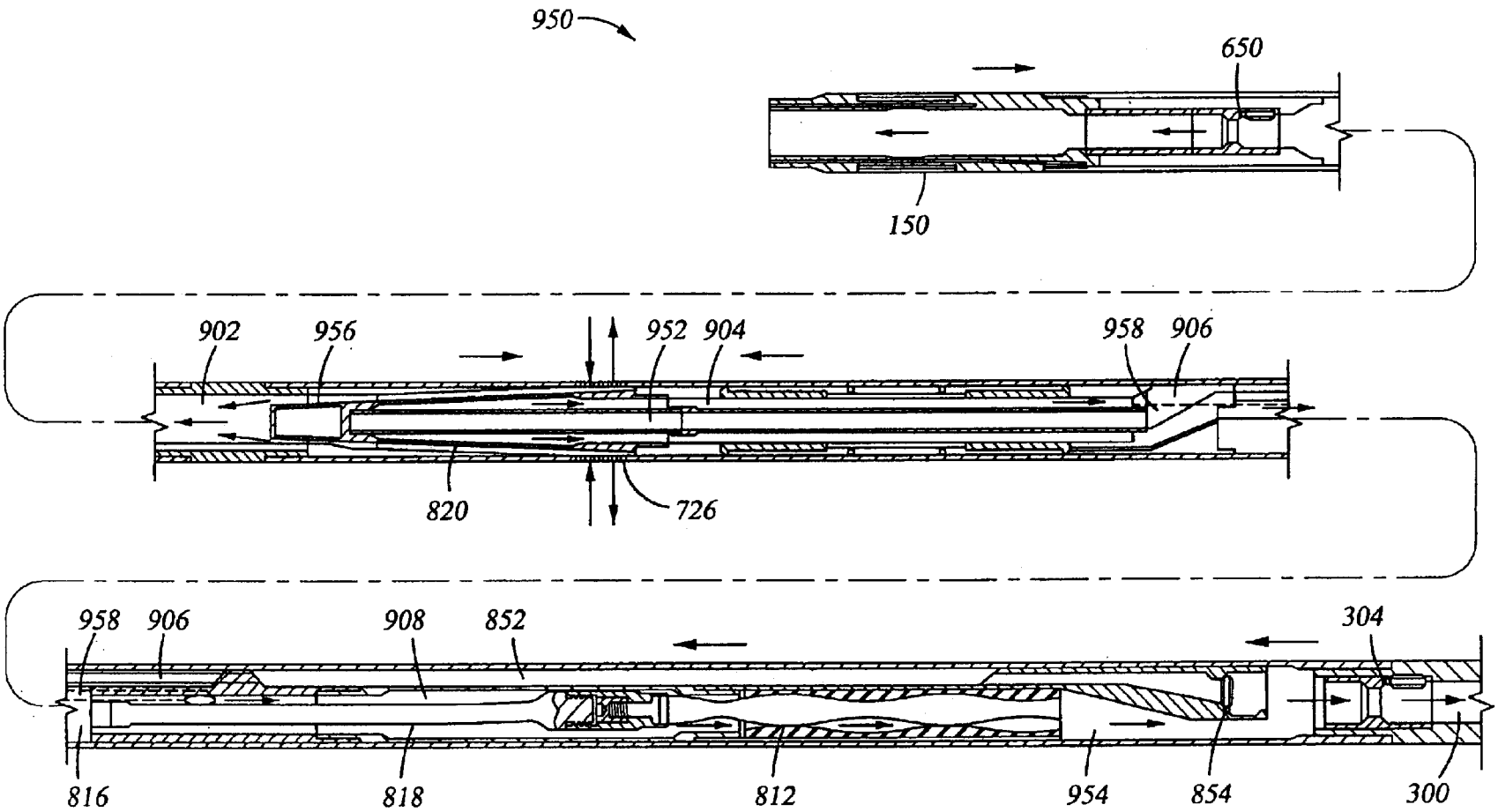
FIG. 43B depicts a cross-sectional side view of the one-pump assembly of FIG. 43A, with flow from the surface in the reverse flow direction, and the pump operating to aid in drilling.
Figure 44A:
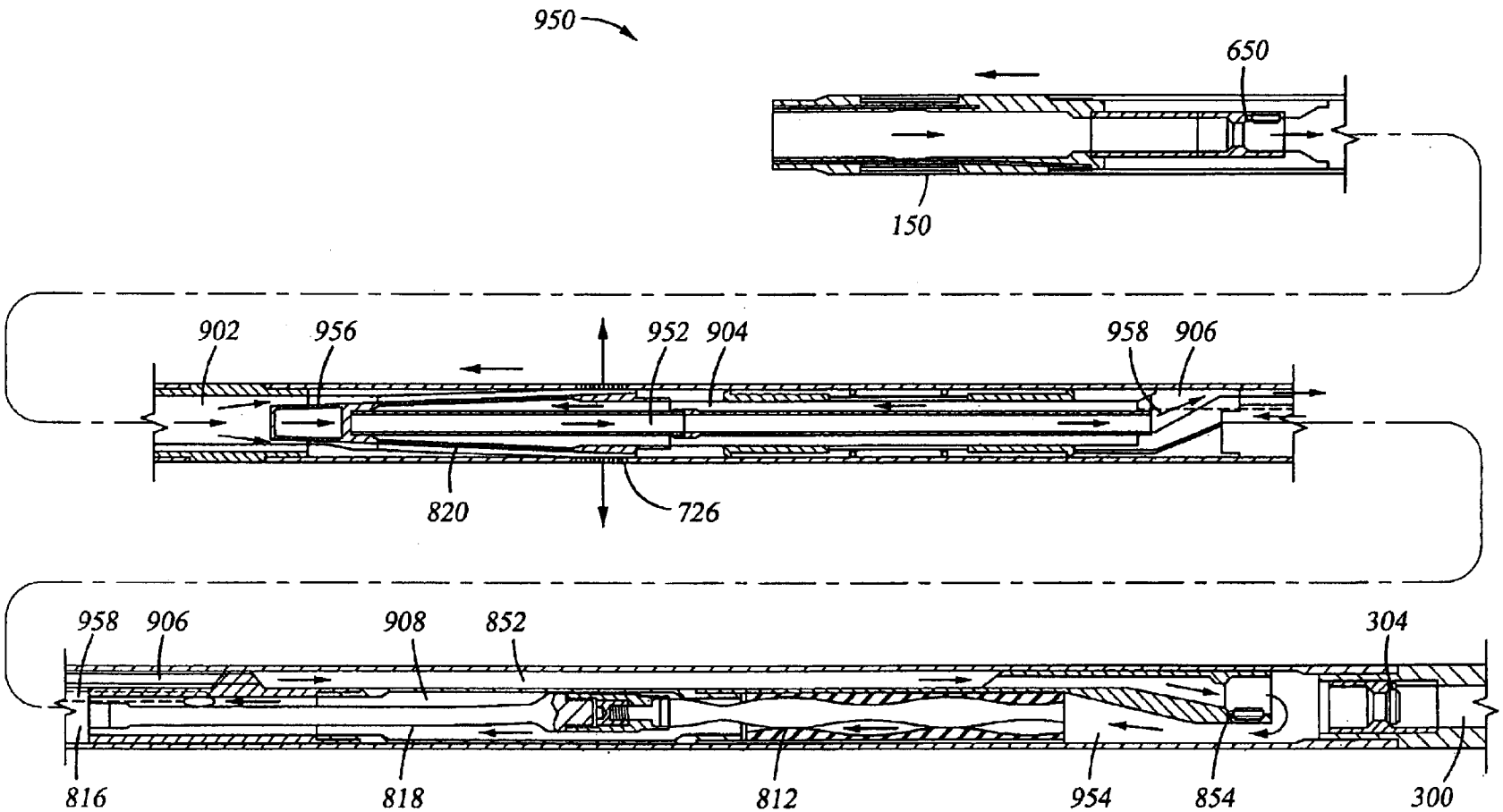
FIG. 44A depicts a cross-sectional side view of the one-pump assembly of FIG. 43A–B, with flow from the surface in the standard flow direction, and the pump operating to flush cuttings from the pump.
Figure 44B:
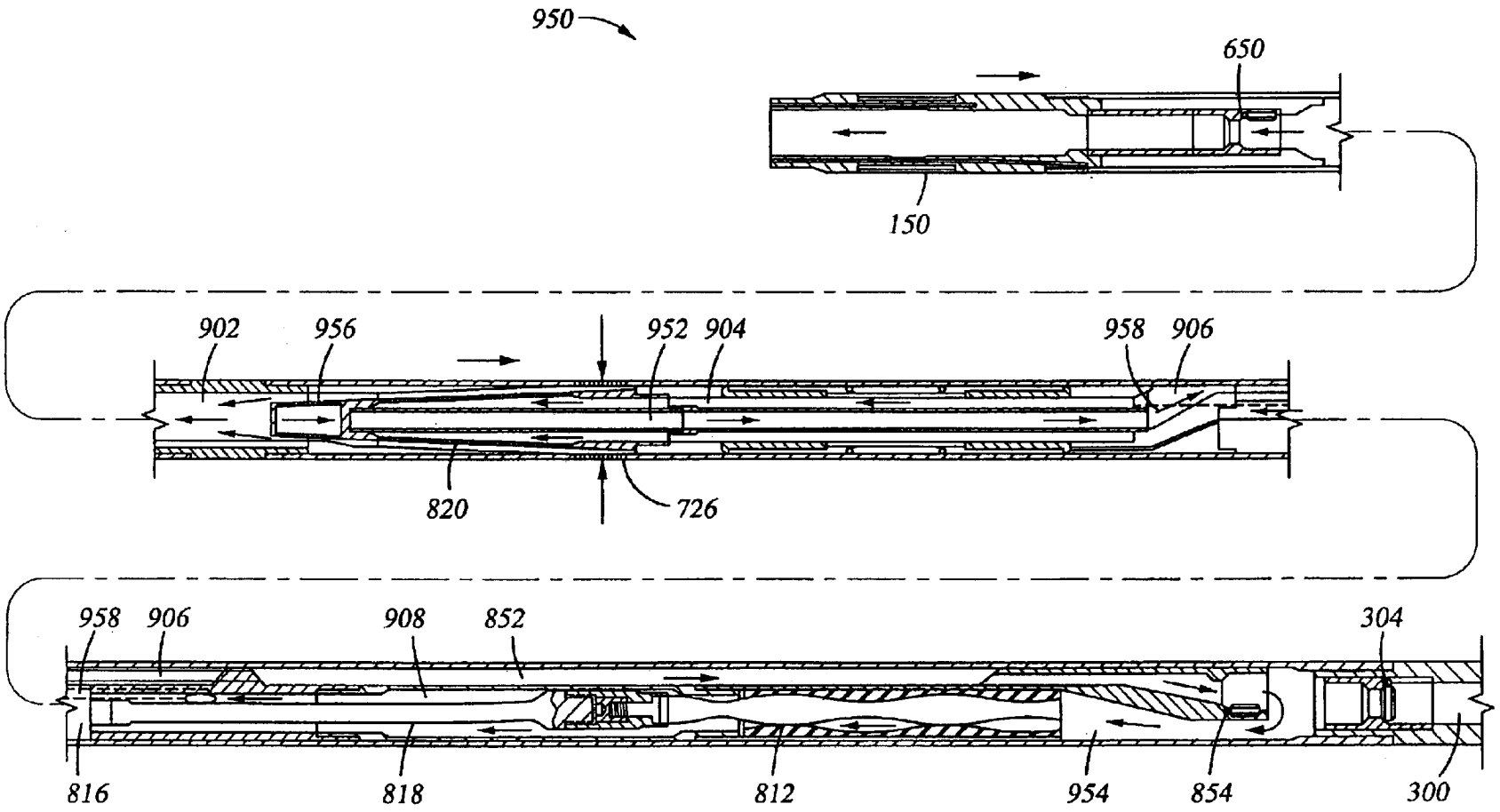
FIG. 44B depicts a cross-sectional side view of the one-pump assembly of FIG. 43A–B, with flow from the surface in the reverse flow direction, and the pump operating to flush cuttings from the pump.

FIGS. 43A–B and FIGS. 44A–B depict another simplified assembly 950 having a single downhole pump 812 that aids with both drilling and cuttings removal, and can also be operated to sweep cuttings that may have accumulated within the pump 812. In this configuration, there is a by-pass passageway 852 with a check valve 854, and the assembly 950 further includes the check valve 304 leading to the BHA 300. An electric motor 816 connects to the pump 812 through a drive shaft 818 that enables rotation of the pump 812 in either the forward or the reverse direction. FIGS. 43A–B depict drilling with flow from the surface in either the standard or reverse flow direction, respectively, and with the downhole pump 812 operating to boost the flow rate and pressure of the drilling fluid. FIGS. 44A–B depict circulating in either the standard or reverse flow direction, respectively. In FIGS. 44A–B, the downhole pump 812 is on in the reverse direction to clear cuttings that may have accumulated within the pump 812, and in FIG. 44B, the downhole pump 812 also aids in cuttings removal.

In more detail, when the pump 812 is used to aid with drilling as shown in FIG. 43A–B, the flow from the surface may be in the standard flow direction as depicted in FIG. 43A, or in the reverse flow direction as depicted in FIG. 43B. In the standard flow direction, fluid flows downwardly through the coiled tubing 150 to enter chamber 902, then flows around upper cuttings filter 956 because there is a higher pressure on the underside of the filter 956 within bore 952 since the pump 812 is operating. Thus, the flow will not pass through the upper cuttings filter 956 into the bore 952, but will rather flow around the upper cuttings filter 956 and flow through the lower cuttings filter 820 to enter bore 904. Flow continues through passageway 958 and then into annular chamber 908 to enter pump 812, which boosts the pressure of the drilling fluid as it flows into chamber 954, and through the open check valve 304 into the BHA 300.

When the flow from the surface is in the reverse flow direction as depicted in FIG. 43B, flow enters from the annulus through ports 726, and either passes through filter 820 to continue along the same flow path as described above for the standard flow direction, or flows upwardly into chamber 902 and the coiled tubing 150 back to the surface, carrying cuttings that were too large to flow through the mesh of the lower cuttings filter 820.

Referring now to FIGS. 44A–B, in this configuration, drilling has ceased and the pump 812 is rotated in the reverse direction to clear cuttings from the pump 812 that have accumulated therein, and in the reverse flow direction depicted in FIG. 44B, the pump 812 also aids with cuttings removal. As previously described, the upper cuttings filter 956 and lower cuttings filter 820 each comprise mesh that allows a predetermined size of cuttings therethrough. Accordingly, during operation of the downhole pump 812 for drilling as depicted in FIGS. 43A–B, cuttings of a certain size will pass through the filters 956, 820 into the pump 812, and may accumulate therein after a period of time. Thus, the assembly 950 is also capable of operating the pump 812 in the reverse direction so as to sweep the cuttings that have accumulated therein. As depicted in FIGS. 44A–B, the drilling fluid can flow from the surface in either the standard direction, or in the reverse flow direction. When the flow from the surface is in the standard direction as depicted in FIG. 44A, the fluid flows downwardly through the coiled tubing 150, through an upper cuttings filter 956 and into tubular passageway 952. The fluid then flows into bypass 906 around the motor 816, bypass 852 around the pump 812, and through the open check valve 854 into chamber 954. The check valve 304 leading to the BHA 300 is closed. The pump 812 then pumps the fluid upwardly into annular chamber 908, through passageway 958 and upwardly into bore 904. The fluid passes upwardly through the lower cuttings filter 820 and into chamber 902, then back downwardly through the upper cuttings filter 956. Typically, the mesh for upper cuttings filter 956 comprises smaller holes than the mesh provided on cuttings filter 820.

When the flow from the surface is in the reverse flow direction as depicted in FIG. 44B, cuttings removal can occur while sweeping the pump 812 clear of accumulated cuttings. Flow enters from the annulus through ports 726, and some of the flow passes through upper cuttings filter 956 into the tubular passageway 952 to continue along the same flow path as described above for the standard flow direction, while some of the flow moves into chamber 902 and moves upwardly through coiled tubing 150, carrying cuttings to the surface.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the present inventive concept, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An assembly for drilling a deviated borehole from the surface using drilling fluids, comprising:

a bottom hole assembly connected to a string of coiled tubing extending to the surface, said coiled tubing having a flowbore for the passage of drilling fluids;

said bottom hole assembly including a bit driven by a downhole motor powered by the drilling fluids, said bottom hole assembly and string forming an annulus with the borehole;

a surface pump at the surface to pump the drilling fluids downhole;

a first cross valve associated with said surface pump providing a first path directing drilling fluids down said flowbore and a second path directing drilling fluids down said annulus;

a second cross valve adjacent the bottom hole assembly having an open position allowing flow through an opening between said flowbore and said annulus above said downhole motor and a closed position preventing flow through said opening;

a first flow passageway directing drilling fluids through said first path, through said bottom hole assembly, and then up said annulus; and a second flow passageway directing drilling fluids through said second path, through said opening, and then up said flowbore.

2. The assembly of claim 1 wherein said second cross valve is in said closed position while flowing drilling fluids through said first flow passageway.

3. The assembly of claim 1 wherein said bottom hole assembly includes a check valve upstream of said downhole motor having a first position allowing flow through said downhole motor and a second position preventing flow through said downhole motor.

4. The assembly of claim 3 wherein said check valve is open and flow is through said check valve in said first position, through said downhole motor and bit, and up said annulus to the surface.

5. The assembly of claim 3 wherein said second cross valve is in said open position and said check valve is closed, and flow is through said second flow passageway, through said opening, and up said flowbore to the surface.

6. The assembly of claim 5 wherein said downhole motor is stopped while flowing drilling fluids through said second flow passageway.

7. The assembly of claim 1 wherein said first cross valve is a cross-over valve.

8. The assembly of claim 7 wherein said cross-over valve includes a fluids inlet connected to said surface pump and a fluids outlet connected to a fluids reservoir;

a first inlet/exit connected to said coiled tubing flowbore and a second inlet/exit connected to said annulus;

said fluids inlet and fluids outlet having a first alignment communicating said fluids inlet with said first inlet/exit and said fluids outlet with said second fluids inlet/outlet; and said fluids inlet and fluids outlet having a second alignment communicating said fluids inlet with said second inlet/exit and said fluids outlet with said first fluids inlet/outlet.

9. The assembly of claim 8 wherein said cross-over valve includes first and second housings rotatably connected together with said fluids inlet and fluids outlet connected to said first housing and said first and second inlet/exits connected to said second housing.

10. The assembly of claim 9 wherein said first and second housings rotate between said first and second alignments.

11. The assembly of claim 10 wherein said cross-over valve further includes a lock preventing rotation between said first and second alignments.

12. The assembly of claim 11 wherein said lock includes a piston reciprocating a pair of conduits to provide communication between said fluids inlet and fluids outlet and said first and second inlet/exits in said first and second alignments.

13. The assembly of claim 12 wherein said piston further includes a lock member on one of said first and second housings for locking engagement with the other of said first and second housings.

14. The assembly of claim 8 wherein said cross-over valve further includes a lock locking said first and second alignments.

15. The assembly of claim 14 further including an actuator for actuating said lock and for realigning said first and second alignments.

16. The assembly of claim 1 wherein said first cross valve includes a plurality of valves each having a first position directing drilling fluids from said surface pump to said coiled tubing flow bore and a second position directing drilling fluids from said surface pump to said annulus.

17. The assembly of claim 16 wherein said plurality of valves includes a first main valve in a first main conduit connecting said surface pump with said coiled tubing flow bore, said first main valve creating an upstream side and a downstream side of said first main conduit;

a second main valve in a second main conduit connecting a drilling fluids return with said annulus, said second main valve creating an upstream side and a downstream side of said second main conduit;

a first cross-over valve in a first cross-over conduit connecting said upstream side of said first main conduit with said downstream side of said second main conduit;

a second cross-over valve in a second cross-over conduit connecting said downstream side of said first main conduit with said upstream side of said second main conduit;

said first and second main valves being opened and said first and second cross-over valves being closed to direct drilling fluids down through said first path; and said first and second main valves being closed and said first and second cross-over valves being opened to direct drilling fluids through said second path.

18. The assembly of claim 1 wherein said bottom hole assembly includes a differential pressure gauge upstream of said second cross valve measuring the pressure differential between said flow bore and said annulus.

19. The assembly of claim 18 wherein said bottom hole assembly includes a transmitter to transmit the pressure differential measurements to the surface.

20. The assembly of claim 1 wherein said bottom hole assembly includes a first stabilizer downstream of said second cross valve.

21. The assembly of claim 20 wherein said bottom hole assembly includes a second stabilizer upstream of said second cross valve.

22. The assembly of claim 21 wherein said second stabilizer centralizes said bottom hole assembly maintaining said second cross valve a predetermined distance away from the borehole.

23. The assembly of claim 20 wherein said second stabilizer creates reduced flow areas in said annulus increasing fluid velocity at said areas.

24. The assembly of claim 21 wherein said second stabilizer is a slide-on stabilizer.

25. The assembly of claim 24 wherein said slide-on stabilizer is fastened onto said bottom hole assembly.

26. The assembly of claim 21 wherein said second stabilizer is an adjustable blade stabilizer.

27. The assembly of claim 26 wherein said adjustable blade stabilizer includes a plurality of concentric blades disposed azimuthally around said bottom hole assembly.

28. The assembly of claim 21 wherein said second stabilizer is an expandable bladder stabilizer.

29. The assembly of claim 28 wherein said expandable bladder stabilizer includes an actuator.

30. The assembly of claim 29 wherein said actuator includes a piston driven by an electric motor to an actuated position pressurizing said expandable bladder stabilizer and a return spring acting on said piston to return said piston to an unactuated position.

31. The assembly of claim 29 wherein said actuator may expand said expandable bladder stabilizer to a plurality of predetermined radial positions in said annulus to selectively adjust fluid velocity through areas adjacent said expandable bladder stabilizer.

32. The assembly of claim 31 wherein said expandable bladder stabilizer includes a bladder having metal wear strips.

33. The assembly of claim 31 further including a potentiometer measuring the radial expansion of said expandable bladder stabilizer.

34. The assembly of claim 33 further including a transmitter sending the potentiometer measurements to the surface.

35. The assembly of claim 1 wherein said second cross valve closes flow through said downhole motor in said open position.

36. The assembly of claim 35 wherein said bottom hole assembly includes a central conduit communicating said flow bore with either a BHA conduit communicating with said downhole motor or a branch conduit communicating with ports through a wall of said bottom hole assembly, said second cross valve opening said ports and closing said BHA conduit in said open position and closing said ports and opening said BHA conduit in said closed position.

37. The assembly of claim 36 wherein said second cross valve includes an actuator.

38. The assembly of claim 37 wherein said actuator includes a piston driven by an electric motor between said open position and said closed position.

39. The assembly of claim 36 wherein in said closed position, said surface pumps pump drilling fluid down said second flow path, through said ports, and up said flowbore to remove cuttings.

40. The assembly of claim 1 wherein said bottom hole assembly includes reamer cutters crushing the cuttings generated by said bit.

41. The assembly of claim 40 wherein said reamer cutters are rotatably mounted on said bottom hole assembly and are rotated by frictional engagement with a wall of the borehole.

42. The assembly of claim 1 wherein said bottom hole assembly includes a velocity sensitive check valve.

43. The assembly of claim 42 wherein said velocity sensitive check valve includes a housing with a fluid passageway therethrough;

a flapper valve disposed in said fluid passageway;

a sleeve reciprocally disposed in said fluid passageway;

a flow nozzle disposed in said sleeve; and said sleeve having a first position within said housing holding said flapper valve in an open position and a second position within said housing allowing said flapper valve to close off said fluid passageway.

44. The assembly of claim 43 further including a biasing member biasing said sleeve toward said flapper valve.

45. The assembly of claim 44 wherein said biasing member is a spring housed in an oil-filled chamber around said sleeve.

46. The assembly of claim 43 wherein said flow nozzle is sized whereby a predetermined pressure drop across said flow nozzle overcomes said spring and causes said sleeve to move to said second position.

47. The assembly of claim 43 further including a collet.

48. The assembly of claim 43 wherein said sleeve includes a cage adapted to engage said flapper valve and allow flow through said cage.

49. The assembly of claim 1 wherein said bottom hole assembly further includes a first subsurface pump pumping drilling fluids from said second flow passageway to the surface.

50. The assembly of claim 49 wherein said bottom hole assembly includes an electric motor powering said subsurface pump.

51. The assembly of claim 50 further including power conduits extending from the surface to said electric motor providing electrical power to said electric motor.

52. The assembly of claim 51 wherein said power conduits are embedded in a wall of said coiled tubing.

53. The assembly of claim 49 wherein said bottom hole assembly includes a second subsurface pump pumping drilling fluids through said first fluid passageway into said downhole motor.

54. The assembly of claim 53 wherein said first subsurface pump and said second subsurface pump are driven by a common electric motor.

55. The assembly of claim 53 wherein said first subsurface pump is off and said second subsurface pump is on.

56. The assembly of claim 49 wherein said first subsurface pump is monitored and controlled from the surface.

57. The assembly of claim 50 wherein said electric motor includes a variable speed drive.

58. The assembly of claim 53 wherein said first and second subsurface pumps are monitored and controlled from the surface.

59. The assembly of claim 53 wherein said second subsurface pump is driven by a second electric motor that includes a variable speed drive.

60. The assembly of claim 54 wherein said electric motor includes a variable speed drive.

61. The assembly of claim 50 wherein said bottom hole assembly includes a by-pass passageway extending between said flow bore and said downhole motor, bypassing said subsurface pump;

a pump passageway extending between said flow bore and passing through said first subsurface pump and downhole motor;

a branch passageway extending from a junction with said pump passageway to ports communicating with said annulus; and a plurality of valves directing flow through said passageways.

62. The assembly of claim 61 further including a conduit passageway for power conduits extending from said subsurface pump to the surface.

63. The assembly of claim 61 wherein each of said plurality of valves operates by opening one of said passageways while closing another one of said passageways.

64. The assembly of claim 61 wherein a first valve is disposed in said by-pass and pump passageways upstream of said junction whereby said first valve opens one of said by-pass and pump passageways while closing the other of said by-pass and pump passageways.

65. The assembly of claim 64 wherein said subsurface pump pumps drilling fluids upwardly through said pump passageway and said flow bore.

66. The assembly of claim 64 wherein said first valve closes said pump passageway and opens said by-pass passageway to direct drilling fluids around said subsurface pump and into said downhole motor.

67. The assembly of claim 64 wherein a second valve is disposed in said pump and branch passageways downstream of said junction whereby said second valve opens one of said pump and branch passageways while closing the other of said pump and branch passageways.

68. The assembly of claim 67 wherein said first valve opens said by-pass passageway and closes said pump passageway and said second valve closes said branch passageway and opens said by-pass passageway to direct drilling fluids into said downhole motor.

69. The assembly of claim 67 wherein said first valve closes said by-pass passageway and opens said pump passageway and said second valve closes said pump passageway and opens said branch passageway to direct drilling fluids from said annulus through said ports to said flow bore to the surface.

70. The assembly of claim 69 wherein said surface pumps pump drilling fluid down said second flow passageway, through said ports and up said flowbore.

71. The assembly of claim 67 wherein said bottom hole assembly includes apertures in a wall thereof downstream of said subsurface pump.

72. The assembly of claim 71 wherein said first valve closes said by-pass passageway and opens said pump passageway and said second valve closes said branch passageway and opens said pump passageway to direct fluids to the surface.

73. The assembly of claim 72 wherein said subsurface pump pumps drilling fluids from said annulus passing through said apertures and upwardly through said flow bore to the surface.

74. The assembly of claim 67 further including a cuttings crushing assembly downstream of said subsurface pump further crushing cuttings prior to passing through said subsurface pump to the surface, said pump passageway passing through said cuttings crushing assembly.

75. The assembly of claim 74 wherein said cuttings crushing assembly includes rotating discs rotating with respect to stationary discs.

76. The assembly of claim 75 wherein said rotating discs have teeth on their outside diameter and stationary discs have teeth on their inside diameter so as to interact and crush the cuttings.

77. The assembly of claim 76 wherein said discs further include increasingly larger holes as they are placed away from said subsurface pump.

78. The assembly of claim 76 wherein there are no gaps between said rotating and stationary discs allowing cuttings to pass therebetween.

79. The assembly of claim 75 wherein said rotating discs are powered by said electric motor.

80. The assembly of claim 79 wherein said electric motor powers both said subsurface pump and said cuttings crushing assembly.

81. The assembly of claim 74 further including apertures in a wall of said bottom hole assembly communicating with said annulus downstream of said cutting crushing assembly.

82. The assembly of claim 81 further including a check valve between said apertures and said downhole motor.

83. The assembly of claim 82 further including a velocity sensitive valve upstream of said check valve.

84. The assembly of claim 1 wherein said bottom hole assembly includes a standard flow subsurface pump capable of pumping drilling fluids into said downhole motor and a reverse flow subsurface pump capable of pumping drilling fluids to the surface.

85. The assembly of claim 84 wherein said standard flow subsurface pump and said reverse flow subsurface pump may operate at the same time.

86. The assembly of claim 84 wherein said standard flow subsurface pump and reverse flow subsurface pump are each driven by an electric motor.

87. The assembly of claim 86 further including a cuttings crushing assembly downstream of said reverse flow subsurface pump further crushing cuttings prior to passing through said reverse flow subsurface pump to the surface.

88. The assembly of claim 87 further comprising apertures in a wall of said bottom hole assembly that communicate with said annulus downstream of said cutting crushing assembly.

89. The assembly of claim 88 further including a check valve between said apertures and said downhole motor.

90. The assembly of claim 86 further including power conduits extending from the surface to said electric motors providing electrical power to said electric motors.

91. The assembly of claim 90 wherein said power conduits are embedded in a wall of said coiled tubing.

92. The assembly of claim 84 wherein said standard flow subsurface pump and reverse flow subsurface pump are driven by a common electric motor.

93. The assembly of claim 86 wherein said electric motors include variable speed drives.

94. The assembly of claim 84 wherein said bottom hole assembly includes apertures through a wall thereof located adjacent said reverse flow subsurface pump and said standard flow subsurface pump.

95. The assembly of claim 94 wherein drilling fluids from the surface flow downwardly through said annulus and into said apertures and wherein drilling fluids with cuttings flow upwardly from said bit, through said flow bore.

96. The assembly of claim 95 further including a cuttings filter in communication with said apertures separating said cuttings from a portion of said drilling fluids forming clean drilling fluids and drilling fluids with cuttings, directing the drilling fluids with cuttings upwardly through said flow bore to the surface and said clean drilling fluids through said standard flow subsurface pump and downhole motor.

97. The assembly of claim 96 wherein said bottom hole assembly includes a by-pass passageway extending through said flow bore, bypassing said reverse flow subsurface pump and said cuttings filter, and passing through said standard flow subsurface pump to said downhole motor;

a reverse flow subsurface pump passageway extending between said cuttings filter and passing through said reverse flow subsurface pump to said flow bore;

a branch passageway forming a junction with said reverse flow subsurface pump passageway and extending between said reverse flow subsurface-pump passageway and ports through a wall of said bottom hole assembly communicating with said annulus;

a standard flow subsurface pump passageway extending from said apertures, through said cuttings filter, and communicating with said by-pass passageway for flow through said standard flow subsurface pump to said downhole motor; and a plurality of valves directing flow through said passageways.

98. The assembly of claim 97 wherein each of said plurality of valves operates by opening one of said passageways while closing another one of said passageways.

99. The assembly of claim 98 wherein a first valve is disposed in said by-pass and reverse flow subsurface pump passageways upstream of said junction whereby said first valve opens one of said by-pass and reverse flow subsurface pump passageways while closing the other of said by-pass and reverse flow subsurface pump passageways.

100. The assembly of claim 99 wherein a second valve is disposed in said reverse flow subsurface pump and branch passageways downstream of said junction whereby said second valve opens one of said reverse flow subsurface pump and branch passageways while closing the other of said reverse flow subsurface pump and branch passageways.

101. The assembly of claim 100 wherein a third valve is disposed in said standard flow subsurface pump and by-pass passageways downstream of said cuttings filter whereby said third valve opens one of said standard flow subsurface pump and by-pass passageways while closing the other of said standard flow subsurface pump and by-pass passageways.

102. The assembly of claim 101 wherein said first cross valve directs fluids down said second passageway, said first valve closes said by-pass passageway and opens said reverse subsurface pump passageway, said second valve closes said branch passageway and opens said reverse subsurface pump passageway, said third valve closes said by-pass passageway and opens said standard flow subsurface pump passageway, such valve arrangement directing drilling fluids down said second passageway, through said apertures, and flowing drilling fluids with cuttings up said reverse subsurface pump passageway, through said reverse subsurface pump, and up said flow bore to the surface and directing fluids with cuttings from said bit, up said annulus, through said apertures, through said cuttings filter and flowing clean drilling fluid down through said standard flow subsurface pump passageway, through said standard flow subsurface pump, and into said downhole motor.

103. The assembly of claim 101 wherein said first cross valve directs fluids down said first passageway, said first valve opens said by-pass passageway and closes said reverse subsurface pump passageway, said second valve opens said branch passageway and closes said reverse subsurface pump passageway, said third valve closes said by-pass passageway and opens said standard flow subsurface pump passageway, such valve arrangement directing drilling fluids down said first passageway, through said by-pass passageway and through said standard flow subsurface pump, and into said downhole motor.

104. The assembly of claim 103 wherein said reverse flow subsurface pump is off.

105. The assembly of claim 101 wherein said first cross valve directs fluids down said second passageway, said first valve closes said by-pass passageway and opens said reverse subsurface pump passageway, said second valve opens said branch passageway and closes said reverse subsurface pump passageway, said third valve opens said by-pass passageway and closes said standard flow subsurface pump passageway, such valve arrangement directing drilling fluids down said second passageway, through said ports, and flowing drilling fluids with cuttings up said branch passageway and up said flow bore to the surface.

106. The assembly of claim 103 wherein said reverse flow subsurface pump and standard flow subsurface pump are off.

107. The assembly of claim 96 wherein said bottom hole assembly includes a reverse flow subsurface pump passageway extending between said cuttings filter and passing through said reverse flow subsurface pump to said flow bore;

a branch passageway forming a junction with said reverse flow subsurface pump passageway and extending between said reverse flow subsurface pump passageway and ports through a wall of said bottom hole assembly communicating with said annulus;

a standard flow subsurface pump passageway extending from said apertures, through said cuttings filter, and through said standard flow subsurface pump to said downhole motor; and a valve disposed in said reverse flow subsurface pump passageway and branch passageway whereby said valve opens one of said reverse flow subsurface pump and branch passageways while closing the other of said reverse flow subsurface pump and branch passageways.

108. The assembly of claim 107 wherein said first cross valve directs drilling fluids down said second flow passageway, said valve opens said reverse flow subsurface pump passageway and closes said branch passageway such valve arrangement directing drilling fluids down said second passageway, through said apertures, and flowing drilling fluids with cuttings up said reverse subsurface pump passageway, through said reverse subsurface pump, and up said flow bore to the surface and directing fluids with cuttings from said bit, up said annulus, through said apertures, through said cuttings filter and flowing clean drilling fluid down through said standard flow subsurface pump passageway, through said standard flow subsurface pump, and into said downhole motor.

109. The assembly of claim 108 wherein said reverse flow subsurface pump and standard flow subsurface pump are both in operation.

110. The assembly of claim 107 wherein said first cross valve directs drilling fluids down said first flow passageway, said valve closes said reverse flow subsurface pump passageway and opens said branch passageway such valve arrangement directing drilling fluids down said first flow passageway, through said branch passageway, through said ports, and flowing drilling fluids with cuttings up said annulus to the surface.

111. The assembly of claim 107 wherein said first cross valve directs drilling fluids down said second flow passageway, said valve closes said reverse flow subsurface pump passageway and opens said branch passageway such valve arrangement directing drilling fluids down said second flow passageway, through said ports, through said branch passageway, and flowing drilling fluids with cuttings up said flow bore to the surface.

112. The assembly of claim 107 further including a cuttings crushing assembly downstream of said reverse flow subsurface pump further crushing cuttings prior to passing through said reverse flow subsurface pump to the surface.

113. The assembly of claim 112 wherein said cuttings crushing assembly includes concentric rotating cutters.

114. The assembly of claim 112 wherein said cuttings crushing assembly includes eccentric rotating cutters that rotate and gyrate.

115. The assembly of claim 112 wherein said cuttings crushing assembly includes cutters positioned on a disc and rotate relative to one another in a four point pattern.

116. The assembly of claim 100 wherein said first cross valve directs fluids down said second passageway, said first valve closes said by-pass passageway and opens said reverse subsurface pump passageway, said second valve closes said branch passageway and opens said reverse subsurface pump passageway, such valve arrangement directing drilling fluids down said second passageway, through said apertures, and flowing drilling fluids with cuttings up said reverse subsurface pump passageway, through said reverse subsurface pump, and up said flow bore to the surface and directing fluids with cuttings from said bit, up said annulus, through said apertures, through said cuttings filter and flowing clean drilling fluid down through said standard flow subsurface pump passageway, through said standard flow subsurface pump, and into said downhole motor.

117. The assembly of claim 116 wherein said reverse subsurface pump and said standard flow subsurface pump being driven by a common electric motor.

118. The assembly of claim 116 wherein said reverse subsurface pump is off and said standard flow subsurface pump is on, said surface pumps providing fluid flow for reverse circulation.

119. The assembly of claim 116 wherein said bottom hole assembly includes a check valve up stream of said downhole motor.

120. The assembly of claim 1 wherein said bottom hole assembly includes apertures through a wall thereof upstream of a subsurface pump.

121. The assembly of claim 120 wherein drilling fluids from the surface flow downwardly through said second flow passageway and into said apertures and wherein drilling fluids with cuttings flow upwardly from said bit, through said annulus and into said apertures.

122. The assembly of claim 120 further including a cuttings filter in communication with said apertures separating said drilling fluids into clean drilling fluids and drilling fluids with cuttings and directing the drilling fluids with cuttings upwardly through said flow bore to the surface and said clean drilling fluids through said subsurface pump and downhole motor.

123. The assembly of claim 122 wherein said bottom hole assembly includes a by-pass passageway extending through said flow bore, bypassing said cuttings filter, and passing through said subsurface pump to said downhole motor;

an upstream pump passageway extending from said cuttings filter to said flow bore;

a downstream pump passageway extending from said apertures, through said cuttings filter, and through said subsurface pump to said downhole motor; and a valve disposed in said upstream pump and by-pass passageways whereby said valve opens one of said upstream pump and by-pass passageways while closing the other of said upstream pump and by-pass passageways.

124. The assembly of claim 123 wherein said first cross valve directs fluids down said second passageway, said valve closes said by-pass passageway and opens said upstream pump passageway, such valve arrangement directing drilling fluids down said second passageway, through said apertures, and flowing drilling fluids with cuttings up said upstream pump passageway, and up said flow bore to the surface and directing fluids with cuttings from said bit, up said annulus, through said apertures, through said cuttings filter and flowing clean drilling fluid down through said downstream pump passageway, through said subsurface pump, and into said downhole motor.

125. The assembly of claim 120 wherein said surface pump may pump either down said first flow passageway or down said second flow passageway to remove cuttings.

126. The assembly of claim 122 further including a check valve disposed between said subsurface pump and said downhole motor.

127. The assembly of claim 126 wherein said valve closes said by-pass passageway and opens said pump passageway and said surface pump removing cuttings by reverse flow through said second flow passageway.

128. The assembly of claim 123 wherein said first cross valve directs fluids down said first passageway, said valve opens said by-pass passageway and closes said upstream pump passageway, such valve arrangement directing drilling fluids down said first passageway, through said by-pass passageway, and by-passing said subsurface pump and flowing drilling fluids to said downhole motor.

129. The assembly of claim 126 wherein said valve opens said by-pass passageway and closes said upstream pump passageway to remove cuttings and drill with said subsurface pump off.

130. The assembly of claim 1 wherein said bottom hole assembly includes apertures through a wall thereof upstream of a subsurface pump and adjacent a cuttings filter in communication with said apertures separating said drilling fluids flowing into said apertures into clean drilling fluids and drilling fluids with cuttings and directing the drilling fluids with cuttings upwardly through said flow bore to the surface and said clean drilling fluids through said cuttings filter and subsurface pump to said downhole motor.

131. The assembly of claim 130 wherein said first flow passageway extends through said cuttings filter, said subsurface pump, said downhole motor and said bit.

132. The assembly of claim 131 wherein said surface pumps pump drilling fluids down said first flow passageway and up said annulus with a portion flowing through said apertures and into said first flow passageway.

133. The assembly of claim 130 wherein said surfaces pumps pump drilling fluids down said second flow passageway and through said apertures with a portion of the drilling fluids flowing up said flow bore and a portion flowing down through said cuttings filter, said subsurface pump, said downhole motor and said bit.

134. The assembly of claim 130 wherein said bottom hole assembly includes an upstream pump passageway extending from said cuttings filter to said flow bore; and a downstream pump passageway extending from said apertures, through said cuttings filter, and through said subsurface pump to said downhole motor.

135. The assembly of claim 134 wherein said first cross valve directs fluids down said first flow passageway and down said upstream pump passageway and through said subsurface pump to said downhole motor and bit and flowing drilling fluids with cuttings up said annulus with a portion flowing into said apertures and a portion flowing to the surface.

136. The assembly of claim 134 wherein said first cross valve directs fluids down said second flow passageway and into said apertures with said cuttings filter separating said drilling fluids flowing into said apertures into clean drilling fluids and drilling fluids with cuttings and directing the drilling fluids with cuttings upwardly through said flow bore to the surface and said clean drilling fluids through said cuttings filter and subsurface pump to said downhole motor.

137. The assembly of claim 1 wherein said bottom hole assembly includes apertures through a wall thereof upstream of a subsurface pump and adjacent a first cuttings filter in communication with said apertures separating said drilling fluids flowing into said apertures into clean drilling fluids and drilling fluids with cuttings and directing the drilling fluids with cuttings upwardly through said flow bore to the surface and said clean drilling fluids through said subsurface pump and downhole motor, said bottom hole assembly further including a second cuttings filter upstream of said first cuttings filter.

138. The assembly of claim 137 wherein said bottom hole assembly includes an upstream pump passageway extending from said second cuttings filter to said flow bore; and a downstream pump passageway extending from said apertures, through said first cuttings filter, and through said subsurface pump to said downhole motor, a by-pass passageway extending from said flowbore and through said second cuttings filter and by-passing said subsurface pump; and a first check valve disposed in said by-pass passageway upstream of said downhole motor and a second check valve in said downstream pump passageway upstream of said downhole motor.

139. The assembly of claim 138 wherein said first cross valve directs fluids down said first passageway and down said upstream pump passageway and through said subsurface pump to said downhole motor and bit and flowing drilling fluids with cuttings up said annulus with a portion flowing into said apertures and a portion flowing to the surface.

140. The assembly of claim 138 wherein said first cross valve directs fluids down said second passageway and into said apertures with said first cuttings filter separating said drilling fluids flowing into said apertures into clean drilling fluids and drilling fluids with cuttings and directing the drilling fluids with cuttings upwardly through said flow bore to the surface, and said clean drilling fluids through said cuttings filter and subsurface pump to said downhole motor.

141. The assembly of claim 138 wherein said first check valve is closed and said second check valve is open whereby said downstream pump passageway communicates with said by-pass passageway, said surface pumps pumping drilling fluids down said first flow passageway and through said by-pass passageway and into said downstream pump passageway and through said subsurface pump pumping said drilling fluids through said first cuttings filter.

142. The assembly of claim 138 wherein said drilling fluids pass through said second cuttings filter as said drilling fluids are pumped uphole.

143. The assembly of claim 142 wherein said first check valve is closed and said second check valve is open whereby said downstream pump passageway communicates with said by-pass passageway, said surface pumps pumping drilling fluids down said second flow passageway and through said apertures, a portion of the drilling fluids flowing through said second cuttings filter and into said by-pass passageway for flow through said subsurface pump and a portion flowing through said upstream pump passageway to the surface.

* * * * *